US010881570B2

(12) United States Patent
Lim et al.

(10) Patent No.: US 10,881,570 B2
(45) Date of Patent: Jan. 5, 2021

(54) RECONFIGURABLE PELVIC SUPPORT FOR A SURGICAL FRAME AND METHOD FOR USE THEREOF

(71) Applicant: WARSAW ORTHOPEDIC, INC., Warsaw, IN (US)

(72) Inventors: Roy K. Lim, Germantown, TN (US); Richard A. Hynes, Melbourne Beach, FL (US)

(73) Assignee: WARSAW ORTHOPEDIC, INC, Warsaw, IN (US)

( * ) Notice: Subject to any disclaimer, the term of this patent is extended or adjusted under 35 U.S.C. 154(b) by 20 days.

(21) Appl. No.: 16/395,903

(22) Filed: Apr. 26, 2019

(65) Prior Publication Data

US 2020/0337927 A1 Oct. 29, 2020

(51) Int. Cl.

| | |
|---|---|
| ***A61G 13/12*** | (2006.01) |
| ***A61G 13/04*** | (2006.01) |
| ***A61G 13/00*** | (2006.01) |

(52) U.S. Cl.

CPC ..... *A61G 13/123* (2013.01); *A61G 13/0036* (2013.01); *A61G 13/04* (2013.01); *A61G 13/121* (2013.01); *A61G 13/0081* (2016.11); *A61G 13/1235* (2013.01)

(58) Field of Classification Search

CPC .. A61G 13/123; A61G 13/0036; A61G 13/04; A61G 13/08; A61G 13/1235; A61G 2200/32; A61G 13/0054; A61G 13/0081; A61G 13/104; A61G 13/121; A61G 13/124

See application file for complete search history.

(56) References Cited

U.S. PATENT DOCUMENTS

| | | | |
|---|---|---|---|
| 2,691,979 | A | 10/1954 | Watson |
| 3,060,925 | A | 10/1962 | Honsaker |
| 3,227,440 | A | 1/1966 | Scott |
| 3,293,667 | A | 12/1966 | Ohrberg |

(Continued)

FOREIGN PATENT DOCUMENTS

| | | |
|---|---|---|
| CN | 2100875 U | 4/1992 |
| CN | 201185976 | 1/2009 |

(Continued)

OTHER PUBLICATIONS

International Search Report dated Nov. 21, 2016 from International Application No. PCT/US2016/047394.

(Continued)

*Primary Examiner* — Nicholas F Polito
*Assistant Examiner* — George Sun

(57) ABSTRACT

A surgical frame and method for use thereof is provided. The surgical frame is capable of reconfiguration before, during, or after surgery. The surgical frame includes a main beam that can be rotated, raised/lowered, and tilted upwardly/downwardly to afford positioning and repositioning of a patient supported thereon. The surgical frame also includes a pelvic support for supporting a patient during movement of the main beam. The pelvic support is articulable between at least a retracted first position where the pelvic support is withdrawn from the pelvic area of the patient, and an extended second position where the pelvic area is supported thereby.

19 Claims, 52 Drawing Sheets

(56) References Cited

U.S. PATENT DOCUMENTS 3,306,287 A 2/1967 Arp
3,828,377 A 8/1974 Fary, Sr.
4,029,089 A 6/1977 Mulhlland
4,655,200 A 4/1987 Knight
4,705,026 A 11/1987 Chaussy
4,866,796 A 9/1989 Robinson
4,872,656 A 10/1989 Brendgord
4,901,384 A 2/1990 Eary
4,915,101 A 4/1990 Cuccia
5,009,407 A 4/1991 Watanabe
5,088,706 A 2/1992 Jackson
5,103,511 A 4/1992 Sequin
5,131,106 A 7/1992 Jackson
5,390,383 A 2/1995 Carn
5,410,769 A 5/1995 Waterman
5,444,882 A 8/1995 Andrews
5,613,254 A 3/1997 Clayman
5,642,302 A 6/1997 Dumont
5,860,899 A 1/1999 Rassman
5,991,651 A 11/1999 LaBarbera
6,003,176 A 12/1999 Wasley
6,076,525 A 6/2000 Hoffman
6,112,349 A 9/2000 Connolly
6,154,901 A 12/2000 Carr
6,260,220 B1 7/2001 Lamb
6,295,671 B1 10/2001 Reesby et al.
6,311,349 B1 11/2001 Kazakia
6,367,104 B1 4/2002 Fallbo, Sr. et al.
6,378,149 B1 4/2002 Sanders et al.
6,516,483 B1 2/2003 VanSteenburg
6,566,833 B2 5/2003 Barlett
6,615,430 B2 9/2003 Heimbrock
6,671,905 B2 1/2004 Bartlett et al.
6,681,423 B2 1/2004 Zachrisson
6,701,554 B2 3/2004 Heimbrock
6,701,558 B2 3/2004 VanSteenburg
6,715,169 B2 4/2004 Niederkrom
6,728,983 B2 5/2004 Bartlett et al.
6,732,390 B2 5/2004 Krywiczanin
6,739,006 B2 5/2004 Borders et al.
6,820,621 B2 * 11/2004 DeMayo ..... A61G 13/12 128/845
6,874,181 B1 4/2005 Connolly et al.
6,934,986 B2 8/2005 Krywiczanin et al.
6,941,951 B2 9/2005 Hubert et al.
6,966,081 B1 11/2005 Sharps
7,100,225 B1 9/2006 Bailey
7,189,214 B1 3/2007 Saunders
7,219,379 B2 5/2007 Krywiczanin et al.
7,234,180 B2 6/2007 Horton et al.
7,290,302 B2 11/2007 Sharps
7,426,930 B1 9/2008 Bailey
7,472,440 B2 1/2009 Bartlett et al.
7,484,253 B1 2/2009 Coppens
7,496,980 B2 3/2009 Sharps
7,600,281 B2 10/2009 Skripps
7,669,262 B2 3/2010 Skripps
7,739,762 B2 6/2010 Lamb et al.
7,882,583 B2 2/2011 Skripps
8,118,029 B2 2/2012 Gneiting et al.
8,234,730 B2 10/2012 Copeland et al.
8,286,283 B2 10/2012 Copeland et al.
8,286,637 B2 10/2012 Kaska
8,413,660 B2 4/2013 Weinstein et al.
8,439,948 B1 5/2013 King
8,443,473 B2 5/2013 Maxwell
8,584,281 B2 11/2013 Diel et al.
8,635,725 B2 1/2014 Tannoury et al.
9,072,646 B2 7/2015 Skripps et al.
9,265,680 B2 2/2016 Sharps
9,339,430 B2 5/2016 Jackson et al.
9,358,170 B2 6/2016 Jackson
9,414,982 B2 8/2016 Jackson
9,498,397 B2 11/2016 Hight et al.
9,522,078 B2 12/2016 Pizzini
9,554,959 B2 1/2017 Carn
9,655,793 B2 5/2017 Hertz
9,700,476 B2 7/2017 Hoel et al.
9,713,562 B2 7/2017 Perlman et al.
9,744,089 B2 8/2017 Jackson
9,937,006 B2 4/2018 Skripps et al.
9,993,380 B2 6/2018 Jackson
10,136,863 B2 11/2018 Kaiser
10,314,758 B2 * 6/2019 Dolliver ..... A61G 13/06
10,342,722 B2 7/2019 Garrido
10,406,054 B1 9/2019 Scholl et al.
10,426,684 B2 10/2019 Dubois et al.
10,543,142 B2 1/2020 Lim et al.
10,548,796 B2 2/2020 Lim et al.
10,576,006 B2 3/2020 Lim et al.
2002/0138905 A1 10/2002 Barltett et al.
2002/0138906 A1 10/2002 Barltett et al.
2002/0157186 A1 * 10/2002 VanSteenburg .... A61G 13/0081 5/621
2003/0140419 A1 7/2003 Barltett et al.
2003/0140420 A1 7/2003 Niederkrom
2003/0145382 A1 8/2003 Krywiczanin
2003/0178027 A1 * 9/2003 DeMayo ..... A61G 13/0081 128/845
2004/0010849 A1 1/2004 Krywiczanin et al.
2004/0133983 A1 7/2004 Newkirk
2005/0181917 A1 8/2005 Dayal
2006/0037141 A1 2/2006 Krywiczanin et al.
2006/0123546 A1 6/2006 Horton
2006/0162076 A1 7/2006 Bartlett et al.
2006/0162084 A1 7/2006 Mezue
2008/0034502 A1 * 2/2008 Copeland ..... A61G 13/12 5/621
2008/0134434 A1 6/2008 Celauro
2009/0139030 A1 6/2009 Yang
2010/0037397 A1 2/2010 Wood
2010/0192300 A1 8/2010 Tannoury
2011/0099716 A1 5/2011 Jackson
2012/0144589 A1 * 6/2012 Skripps ..... A61G 13/122 5/624
2012/0255122 A1 10/2012 Diel et al.
2013/0111666 A1 5/2013 Jackson
2013/0283526 A1 10/2013 Gagliardi
2013/0307298 A1 11/2013 Meiki
2014/0059773 A1 * 3/2014 Carn ..... A61G 13/123 5/624
2014/0068861 A1 * 3/2014 Jackson ..... A61B 5/7425 5/601
2014/0109316 A1 * 4/2014 Jackson ..... A61G 13/122 5/601
2014/0137327 A1 5/2014 Tannoury et al.
2015/0044956 A1 2/2015 Hacker
2015/0245971 A1 * 9/2015 Bernardoni ..... A61G 13/02 5/601
2015/0272681 A1 * 10/2015 Skripps ..... A61G 13/08 128/854
2016/0000621 A1 1/2016 Jackson
2016/0081582 A1 3/2016 Rapoport
2016/0089287 A1 3/2016 Buerstner
2016/0193099 A1 * 7/2016 Drake ..... A61G 13/125 5/624
2017/0027797 A1 * 2/2017 Dolliver ..... A61G 13/1245
2017/0049651 A1 * 2/2017 Lim ..... A61G 13/129
2017/0049653 A1 2/2017 Lim
2017/0079864 A1 3/2017 Riley
2017/0112698 A1 4/2017 Hight et al.
2017/0135891 A1 5/2017 Kettner
2017/0341232 A1 11/2017 Perplies
2018/0116891 A1 5/2018 Beale et al.
2018/0185228 A1 7/2018 Catacchio et al.
2018/0193104 A1 7/2018 Beale et al.
2018/0363596 A1 * 12/2018 Lim ..... A61G 13/04
2019/0000702 A1 1/2019 Lim et al.
2019/0000707 A1 1/2019 Lim et al.
2019/0046381 A1 2/2019 Lim et al.
2019/0046383 A1 * 2/2019 Lim ..... A61G 13/121
2019/0209409 A1 7/2019 Jackson et al.
2020/0000668 A1 1/2020 Lim et al.

(56) References Cited

U.S. PATENT DOCUMENTS

| | | | |
|---|---|---|---|
| 2020/0060913 | A1 | 2/2020 | Lim et al. |
| 2020/0060914 | A1 | 2/2020 | Lim et al. |
| 2020/0060915 | A1 | 2/2020 | Lim et al. |
| 2020/0138659 | A1 | 7/2020 | Lim et al. |

FOREIGN PATENT DOCUMENTS

| | | | |
|---|---|---|---|
| CN | 103298440 | A | 9/2013 |
| JP | 2012-228509 | | 11/2012 |
| JP | 2018069048 | | 5/2018 |
| WO | 2007058673 | | 5/2007 |
| WO | 2017031225 | | 2/2017 |
| WO | 2017139548 | | 8/2017 |

OTHER PUBLICATIONS

Office Action and Search Report dated Aug. 27, 2019 for corresponding Chinese application No. 201680046857.4.
Office Action dated Dec. 17, 2019 for corresponding Japanese Application No. 2018-504646 with English translation.
International Search Report and Written Opinion dated Dec. 4, 2019 from International Application No. PCT/US2019/046979.
Examination Report dated Apr. 8, 2020 from Australian Application No. 2016308175.
Second Office Action dated Mar. 24, 2020 from Chinese Application No. 201680046857.4.
Office Action dated Jun. 2, 2020 for corresponding Japanese application No. 2018-566265 with English translation.

* cited by examiner

RECONFIGURABLE PELVIC SUPPORT FOR A SURGICAL FRAME AND METHOD FOR USE THEREOF

FIELD

The present technology generally relates to a reconfigurable pelvic support for use with a surgical frame incorporating a main beam capable of rotation.

BACKGROUND

Access to a patient is of paramount concern during surgery. Surgical frames have been used to position and reposition patients during surgery. For example, surgical frames have been configured to manipulate the rotational position of the patient before, during, and even after surgery. Such surgical frames include support structures to facilitate the rotational movement of the patient. Typical support structures can include main beams supported at either end thereof for rotational movement about axes of rotation extending along the lengths of the surgical frames. The main beams can be positioned and repositioned to afford various positions of the patients positioned thereon. To illustrate, the main beams can be rotated for positioning a patient in prone positions, lateral positions, and positions 45° between the prone and lateral positions. However, to provide access to the anterior, posterior, and lateral sides of the patient adjacent the pelvic area of the patient, typical surgical frames do not provide direct support of the pelvic area. Instead, the areas surrounding the pelvic area of the patient are supported by the surgical frames to indirectly support the pelvic area. Nevertheless, there is a desire to support the pelvic area of the patient during rotation of a main beam.

SUMMARY

The techniques of this disclosure generally relate to a reconfigurable pelvic support attached relative to a rotatable main beam, and articulable between at least a retracted first position where the pelvic support is withdrawn from the pelvic area of a patient, and an extended second position where the pelvic area is supported thereby on the rotatable main beam.

In one aspect, the present disclosure provides a positioning frame for supporting a patient during surgery including an adjustable pelvic support, the positioning frame including a first vertical support portion and a second vertical support portion; a main beam having a first end, a second end, and a length extending between the first and second end, the main beam defining an axis of rotation relative to the first vertical support portion and the second vertical support portion, the main beam being rotatable about the axis of rotation between at least a first rotational position and a second rotational position, the axis of rotation substantially corresponding to a cranial-caudal axis of the patient when the patient is supported on the positioning frame, the main beam including a first portion at the first end rotatably interconnected relative to the first vertical support portion, a second portion at the second end rotatably interconnected relative the second vertical support portion, and an elongated portion extending between the first portion and the second portion of the main beam. The positioning frame including a chest support portion and a leg support portion attached to the elongated portion of the main beam, the chest support being configured for support of at least a portion of a chest of the patient and the leg support being configured for support of a portion of at least one leg of the patient; and an adjustable pelvic support including a first arm portion, a second arm portion, and a head portion, the first arm portion including a first end portion and a second end portion, the second arm portion including a first end portion and a second end portion, the head portion including a pad portion for contacting a portion of the pelvic area of the patient, the first end portion of the first arm portion being pivotally attached relative to the elongated portion of the main beam, the first end portion of the second arm portion being pivotally attached relative to the second end portion of the first arm portion, the head portion being attached relative to the second end portion of the second arm portion, the first arm portion being moveable between a first rotational position and a second rotational position relative to the elongated portion of the main beam, and the second arm portion being moveable between a first rotational position and a second rotational position relative to the first arm portion to facilitate positioning and repositioning of the pad portion of head portion to contact the portion of the pelvic area of the patient during rotation of the main beam between the first rotational position and the second rotational position.

In one aspect, the present disclosure provides A positioning frame for supporting a patient during surgery including an adjustable pelvic support, the positioning frame including a first vertical support portion and a second vertical support portion; a main beam having a first end, a second end, and a length extending between the first and second end, the main beam defining an axis of rotation relative to the first vertical support portion and the second vertical support portion, the main beam being rotatable about the axis of rotation between at least a first rotational position and a second rotational position, the axis of rotation substantially corresponding to a cranial-caudal axis of the patient when the patient is supported on the positioning frame, the main beam including a first portion at the first end rotatably interconnected relative to the first vertical support portion, a second portion at the second end rotatably interconnected relative the second vertical support portion, and an elongated portion extending between the first portion and the second portion of the main beam, a chest support portion and a leg support portion attached to the elongated portion of the main beam, the chest support being configured for support of at least a portion of a chest of the patient and the leg support being configured for support of a portion of at least one leg of the patient; and an adjustable pelvic support including a tilt positioner, a first arm portion, a second arm portion, and a head portion, the tilt positioner being attached to the main beam, the first arm portion including a first end portion and a second end portion, the second arm portion including a first end portion and a second end portion, the head portion including a pad portion for contacting a portion of the pelvic area of the patient, the first end portion of the first arm portion being pivotally attached to the tilt positioner, the first end portion of the second arm portion being pivotally attached to the second end portion of the first arm portion, the head portion being attached relative to the second end portion of the second arm portion, the tilt positioner being configured to tilt the first arm portion between a first tilt position away from the patient and a second tilt position toward the patient, and the first arm portion being moveable between a first rotational position and a second rotational position relative to the elongated portion of the main beam, and the second arm portion being moveable between a first rotational position and a second rotational position relative to the first arm portion to facilitate positioning and repositioning of the pad portion of head portion to contact the portion of the pelvic area of the patient during rotation of the main beam between the first rotational position and the second rotational position.

In one aspect, the present disclosure provides a positioning frame for supporting a patient during surgery including an adjustable pelvic support, the positioning frame including a first vertical support portion and a second vertical support portion; a main beam having a first end, a second end, and a length extending between the first and second end, the main beam defining an axis of rotation relative to the first vertical support portion and the second vertical support portion, the main beam being rotatable about the axis of rotation between at least a first rotational position and a second rotational position, the axis of rotation substantially corresponding to a cranial-caudal axis of the patient when the patient is supported on the positioning frame, the main beam including a first portion at the first end rotatably interconnected relative to the first vertical support portion, a second portion at the second end rotatably interconnected relative the second vertical support portion, and an elongated portion extending between the first portion and the second portion of the main beam, a chest support portion and a leg support portion attached to the elongated portion of the main beam, and the chest support being configured for support of at least a portion of a chest of the patient and the leg support being configured for support of a portion of at least one leg of the patient. The positioning frame also including an adjustable pelvic support including a first arm portion, a second arm portion, a head portion, a first connecting linkage, and a second connecting linkage, the first arm portion including a first end portion and a second end portion, the second arm portion including a first end portion and a second end portion, the head portion including a pad portion for contacting a portion of the pelvic area of the patient, the first end portion of the first arm portion being pivotally attached relative to the elongated portion of the main beam, the first end portion of the second arm portion being pivotally attached relative to the second end portion of the first arm portion, the head portion being attached relative to the second end portion of the second arm portion, the first connecting linkage being connected relative to the main beam and the second end of the first arm portion, the second connecting linkage being connected relative to the main beam and the first end portion of the second arm portion, the first arm portion being moveable between a first rotational position and a second rotational position relative to the elongated portion of the main beam, and the second arm portion being moveable between a first rotational position and a second rotational position relative to the first arm portion to facilitate positioning and repositioning of the pad portion of head portion to contact the portion of the pelvic area of the patient during rotation of the main beam between the first rotational position and the second rotational, the first connecting linkage being configured to stop movement of the first arm portion in various positions between the first rotational position and the second rotational position thereof, and the second connecting linkage between configured to stop movement of the second arm portion in various positions between the first rotational position and the second rotational position thereof.

The details of one or more aspects of the disclosure as set forth in the accompanying drawings and the description below. Other features, objects, and advantages of the techniques described in this disclosure will be apparent from the description and drawings, and from the claims.

Figure 1:
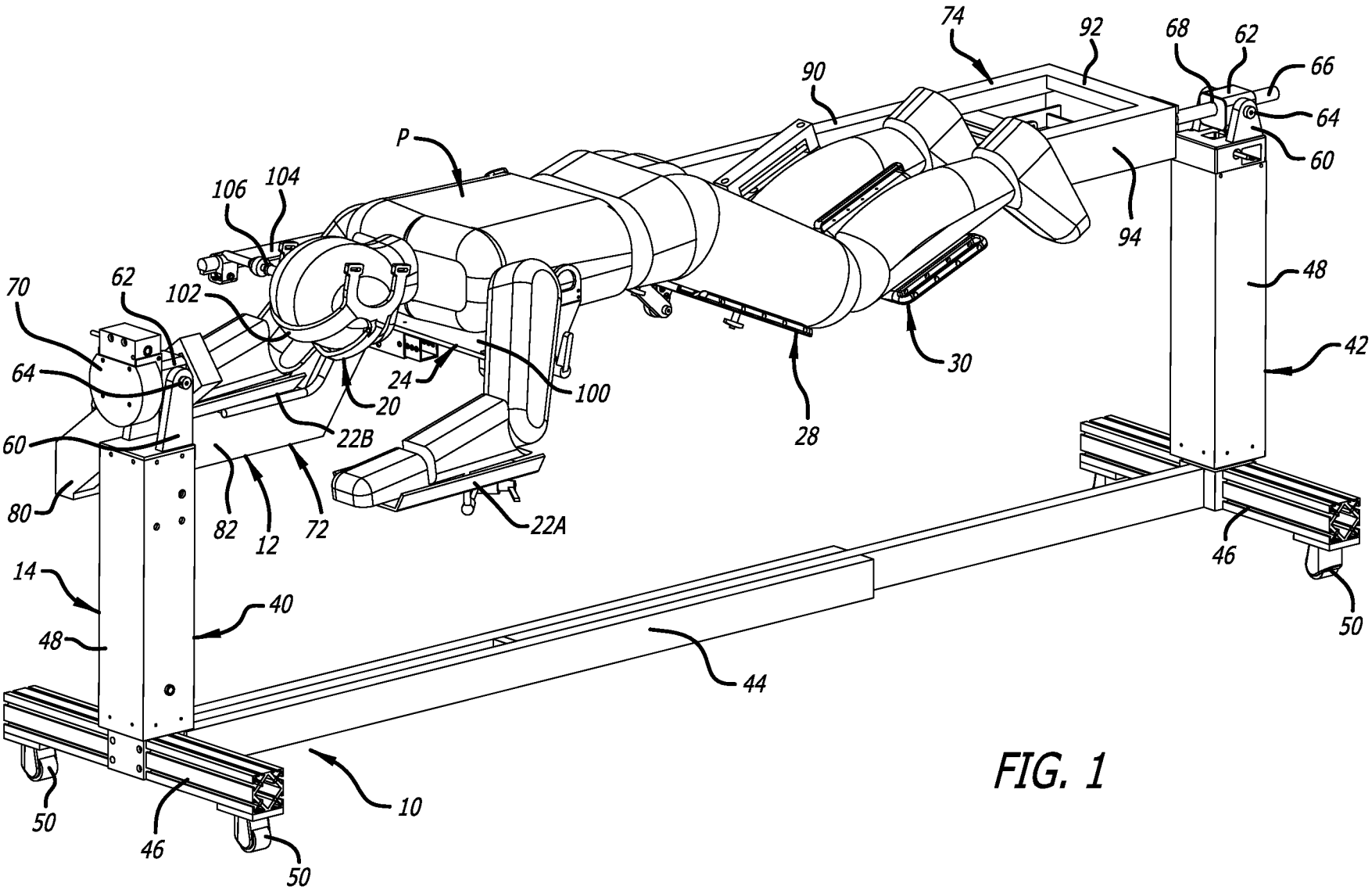
FIG. 1 is a top perspective view that illustrates a prior art surgical frame with a patient positioned thereon in a prone position.
Figure 2:
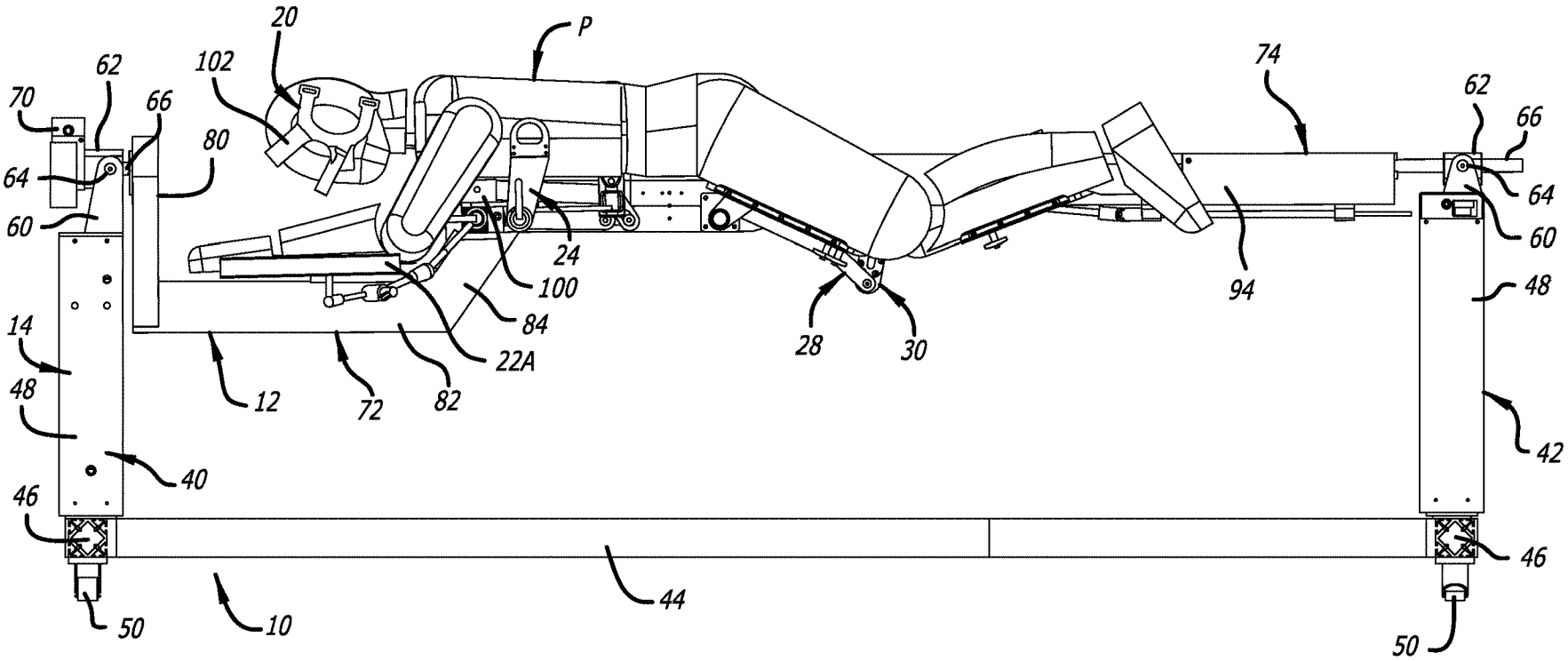
FIG. 2 is a side elevational view that illustrates the surgical frame of FIG. 1 with the patient positioned thereon in a prone position.
Figure 3:
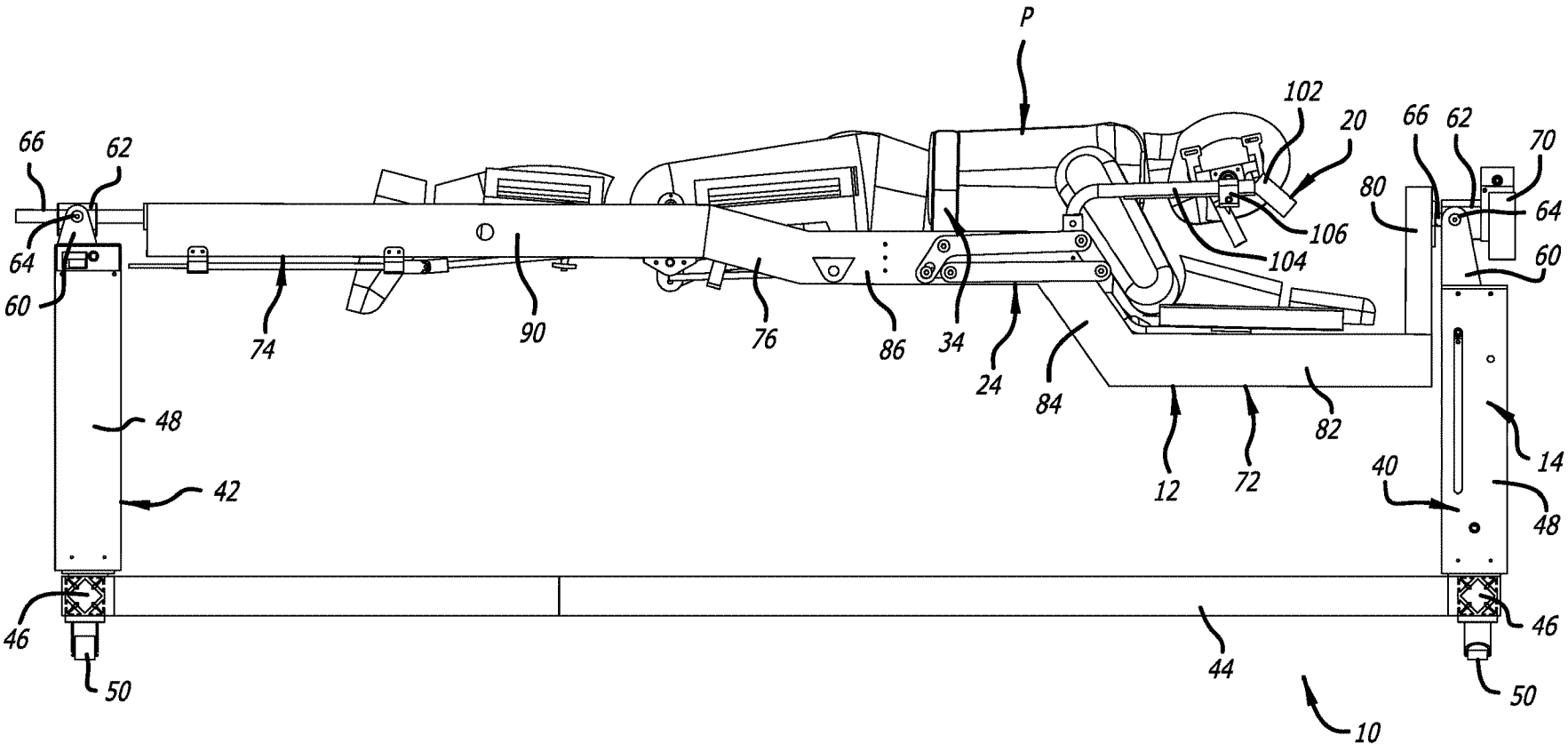
FIG. 3 is another side elevational view that illustrates the surgical frame of FIG. 1 with the patient positioned thereon in a prone position.

The details of one or more aspects of the disclosure are set forth in the accompanying drawings and the description below. Other features, objects, and advantages of the techniques described in this disclosure will be apparent from the description and drawings, and from the claims.

DETAILED DESCRIPTION

FIGS. 1-26 depict a prior art embodiment and components of a surgical support frame generally indicated by the numeral 10. FIGS. 1-26 were previously described in U.S. Ser. No. 15/239,256, which is hereby incorporated by reference herein in its entirety. Furthermore, FIGS. 27-30 were previously described in U.S. Ser. No. 15/639,080, which is hereby incorporated by reference herein in its entirety.

As discussed below, the surgical frame 10 serves as an exoskeleton to support the body of the patient P as the patient's body is manipulated thereby, and, in doing so, serves to support the patient P such that the patient's spine does not experience unnecessary torsion.

The surgical frame 10 is configured to provide a relatively minimal amount of structure adjacent the patient's spine to facilitate access thereto and to improve the quality of imaging available before and during surgery. Thus, the surgeon's workspace and imaging access are thereby increased. Furthermore, radio-lucent or low magnetic susceptibility materials can be used in constructing the structural components adjacent the patient's spine in order to further enhance imaging quality.

The surgical frame 10 has a longitudinal axis and a length therealong. As depicted in FIGS. 1-5, for example, the surgical frame 10 includes an offset structural main beam 12 and a support structure 14. The offset main beam 12 is spaced from the ground by the support structure 14. As discussed below, the offset main beam 12 is used in supporting the patient P on the surgical frame 10 and various support components of the surgical frame 10 that directly contact the patient P (such as a head support 20, arm supports 22A and 22B, torso-lift supports 24 and 160, a sagittal adjustment assembly 28 including a pelvic-tilt mechanism 30 and a leg adjustment mechanism 32, and a coronal adjustment assembly 34). As discussed below, an operator such as a surgeon can control actuation of the various support components to manipulate the position of the patient's body. Soft straps (not shown) are used with these various support components to secure the patient P to the frame and to enable either manipulation or fixation of the patient P. Reusable soft pads can be used on the load-bearing areas of the various support components.

Figure 4:
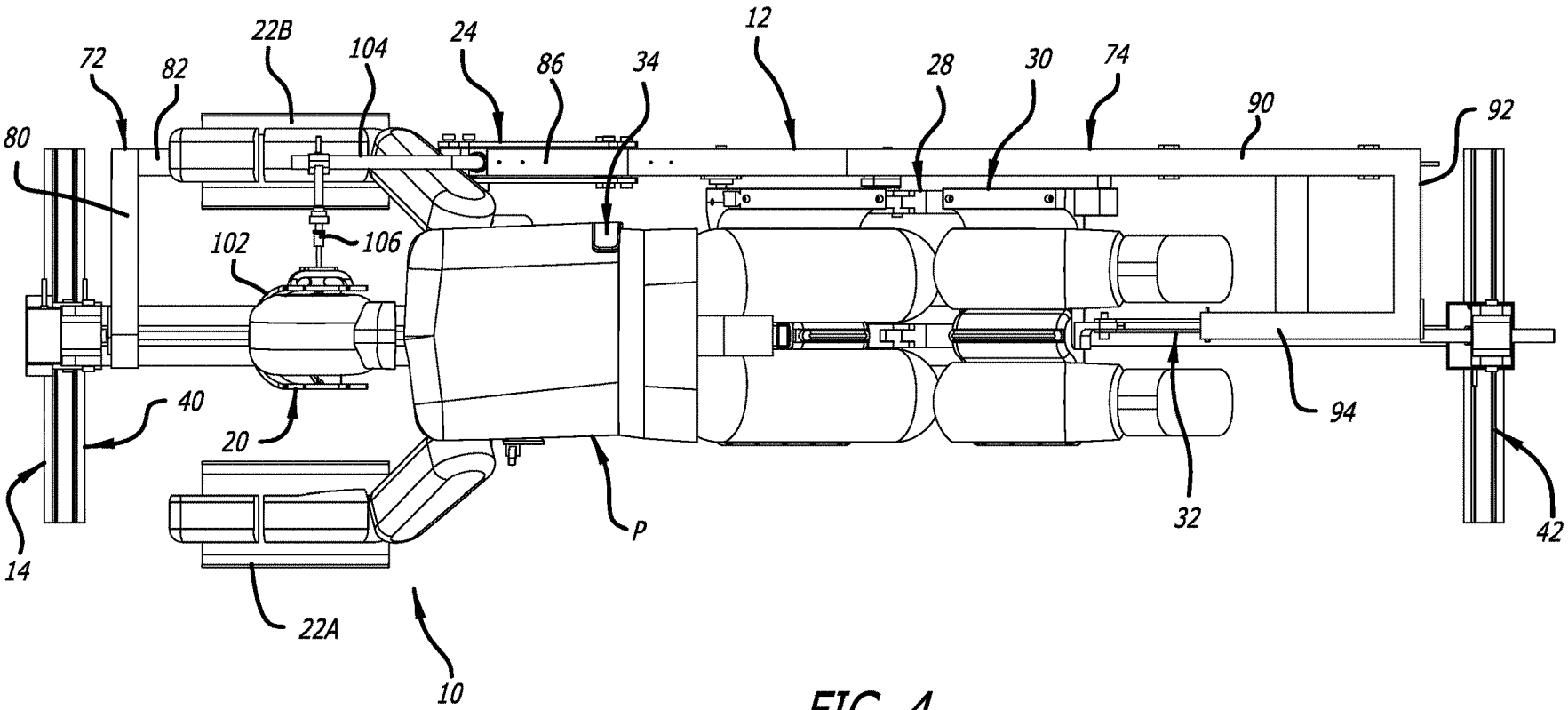
FIG. 4 is a top plan view that illustrates the surgical frame of FIG. 1 with the patient positioned thereon in a prone position.
Figure 5:
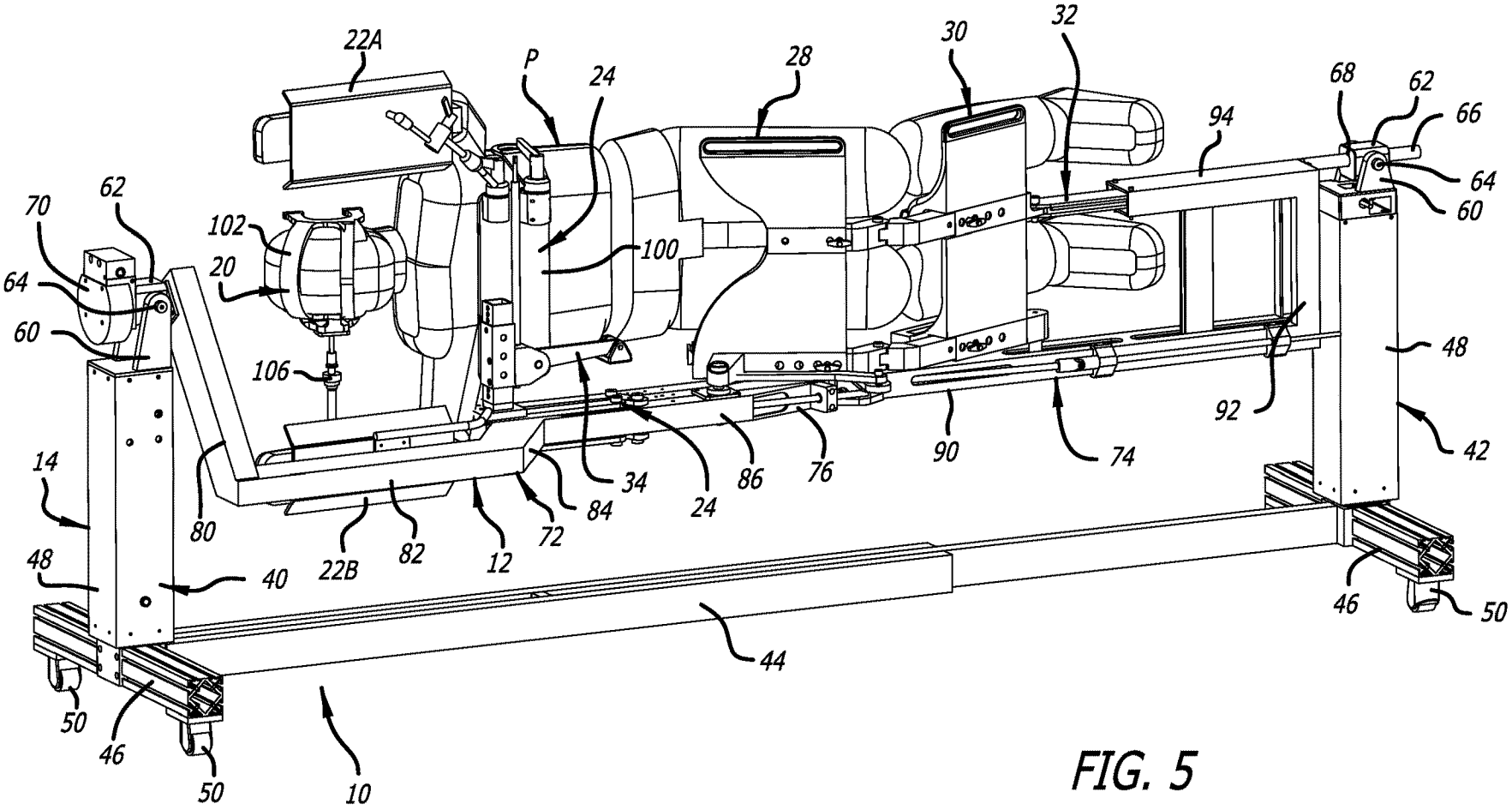
FIG. 5 is a top perspective view that illustrates the surgical frame of FIG. 1 with the patient positioned thereon in a lateral position.

The offset main beam 12 is used to facilitate rotation of the patient P. The offset main beam 12 can be rotated a full 360° before and during surgery to facilitate various positions of the patient P to afford various surgical pathways to the patient's spine depending on the surgery to be performed. For example, the offset main beam 12 can be positioned to place the patient P in a prone position (e.g., FIGS. 1-4), a lateral position (e.g., FIG. 5), and in a position 45° between the prone and lateral positions. Furthermore, the offset main beam 12 can be rotated to afford anterior, posterior, lateral, anterolateral, and posterolateral pathways to the spine. As such, the patient's body can be flipped numerous times before and during surgery without compromising sterility or safety. The various support components of the surgical frame 10 are strategically placed to further manipulate the patient's body into position before and during surgery. Such intraoperative manipulation and positioning of the patient P affords a surgeon significant access to the patient's body. To illustrate, when the offset main beam 12 is rotated to position the patient P in a lateral position, as depicted in FIG. 5, the head support 20, the arm supports 22A and 22B, the torso-lift support 24, the sagittal adjustment assembly 28, and/or the coronal adjustment assembly 34 can be articulated such that the surgical frame 10 is OLIF-capable or DLIF-capable.

As depicted in FIG. 1, for example, the support structure 14 includes a first support portion 40 and a second support portion 42 interconnected by a cross member 44. Each of the first and second support portions 40 and 42 include a horizontal portion 46 and a vertical support post 48. The horizontal portions 46 are connected to the cross member 44, and casters 50 can be attached to the horizontal portions 46 to facilitate movement of the surgical frame 10.

The vertical support posts 48 can be adjustable to facilitate expansion and contraction of the heights thereof. Expansion and contraction of the vertical support posts 48 facilitates raising and lowering, respectively, of the offset main beam 12. As such, the vertical support posts 48 can be adjusted to have equal or different heights. For example, the vertical support posts 48 can be adjusted such that the vertical support post 48 of the second support portion 42 is raised 12 inches higher than the vertical support post 48 of the first support portion 40 to place the patient P in a reverse Trendelenburg position.

Furthermore, cross member 44 can be adjustable to facilitate expansion and contraction of the length thereof. Expansion and contraction of the cross member 44 facilitates lengthening and shortening, respectively, of the distance between the first and second support portions 40 and 42.

The vertical support post 48 of the first and second support portions 40 and 42 have heights at least affording rotation of the offset main beam 12 and the patient P positioned thereon. Each of the vertical support posts 48 include a clevis 60, a support block 62 positioned in the clevis 60, and a pin 64 pinning the clevis 60 to the support block 62. The support blocks 62 are capable of pivotal movement relative to the clevises 60 to accommodate different heights of the vertical support posts 48. Furthermore, axles 66 extending outwardly from the offset main beam 12 are received in apertures 68 formed the support blocks 62. The axles 66 define an axis of rotation of the offset main beam 12, and the interaction of the axles 66 with the support blocks 62 facilitate rotation of the offset main beam 12.

Furthermore, a servomotor 70 can be interconnected with the axle 66 received in the support block 62 of the first support portion 40. The servomotor 70 can be computer controlled and/or operated by the operator of the surgical frame 10 to facilitate controlled rotation of the offset main beam 12. Thus, by controlling actuation of the servomotor 70, the offset main beam 12 and the patient P supported thereon can be rotated to afford the various surgical pathways to the patient's spine.

As depicted in FIGS. 1-5, for example, the offset main beam 12 includes a forward portion 72 and a rear portion 74. The forward portion 72 supports the head support 20, the arm supports 22A and 22B, the torso-lift support 24, and the coronal adjustment assembly 34, and the rear portion 74 supports the sagittal adjustment assembly 28. The forward and rear portions 72 and 74 are connected to one another by connection member 76 shared therebetween. The forward portion 72 includes a first portion 80, a second portion 82, a third portion 84, and a fourth portion 86. The first portion 80 extends transversely to the axis of rotation of the offset main beam 12, and the second and fourth portions 82 and 86 are aligned with the axis of rotation of the offset main beam 12. The rear portion 74 includes a first portion 90, a second portion 92, and a third portion 94. The first and third portions 90 and 94 are aligned with the axis of rotation of the offset main beam 12, and the second portion 92 extends transversely to the axis of rotation of the offset main beam 12.

The axles 66 are attached to the first portion 80 of the forward portion 72 and to the third portion 94 of the rear portion 74. The lengths of the first portion 80 of the forward portion 72 and the second portion 92 of the rear portion 74 serve in offsetting portions of the forward and rear portions 72 and 74 from the axis of rotation of the offset main beam 12. This offset affords positioning of the cranial-caudal axis of patient P approximately aligned with the axis of rotation of the offset main beam 12.

Programmable settings controlled by a computer controller (not shown) can be used to maintain an ideal patient height for a working position of the surgical frame 10 at a near-constant position through rotation cycles, for example, between the patient positions depicted in FIGS. 1 and 5. This allows for a variable axis of rotation between the first portion 40 and the second portion 42.

Figure 6:
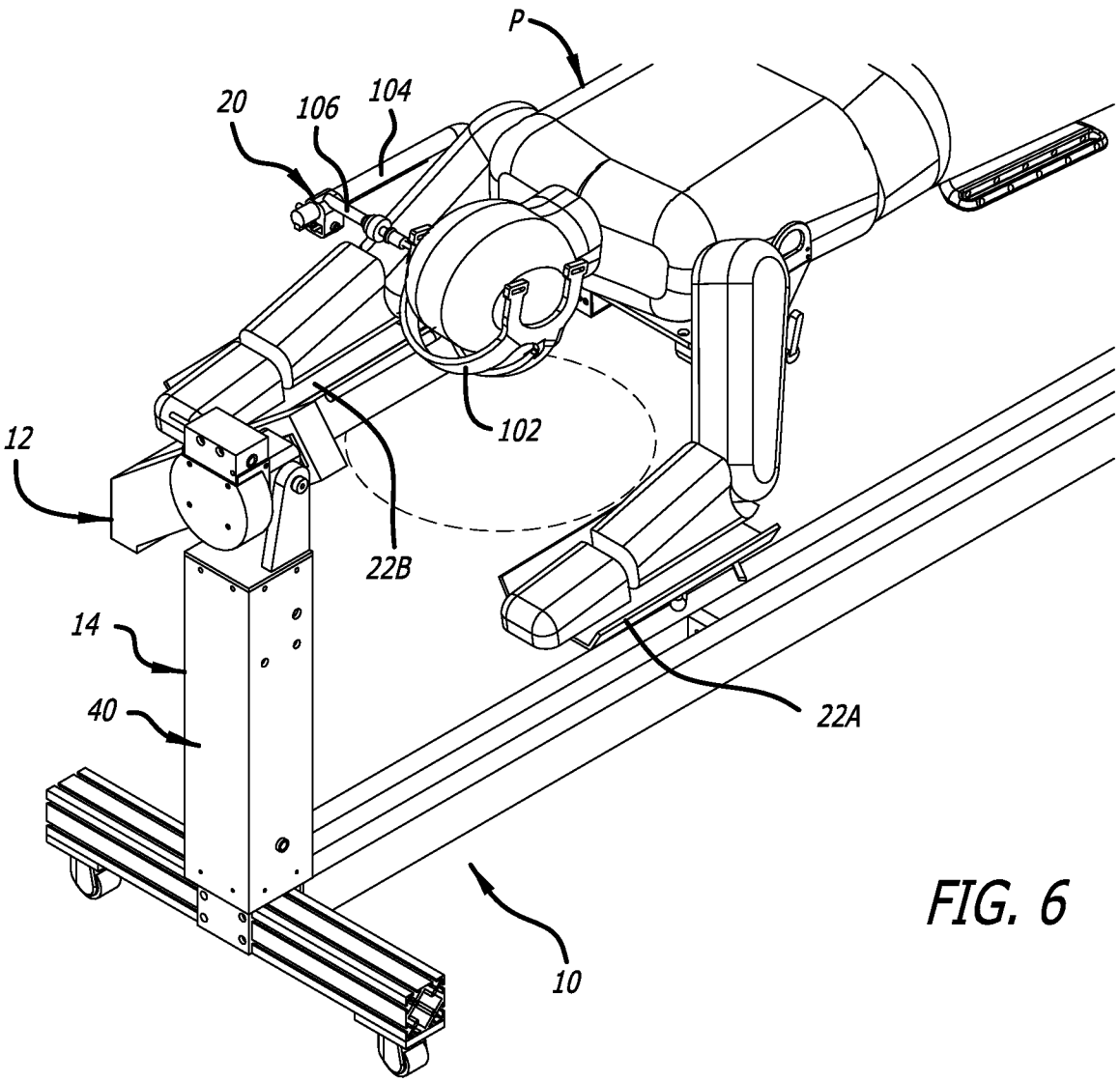
FIG. 6 is a top perspective view that illustrates portions of the surgical frame of FIG. 1 showing an area of access to the head of the patient positioned thereon in a prone position.

As depicted in FIG. 5, for example, the head support 20 is attached to a chest support plate 100 of the torso-lift support 24 to support the head of the patient P. If the torso-lift support 24 is not used, the head support 20 can be directly attached to the forward portion 72 of the offset main beam 12. As depicted in FIGS. 4 and 6, for example, the head support 20 further includes a facial support cradle 102, an axially adjustable head support beam 104, and a temple support portion 106. Soft straps (not shown) can be used to secure the patient P to the head support 20. The facial support cradle 102 includes padding across the forehead and cheeks, and provides open access to the mouth of the patient P. The head support 20 also allows for imaging access to the cervical spine. Adjustment of the head support 20 is possible via adjusting the angle and the length of the head support beam 104 and the temple support portion 106.

As depicted in FIG. 5, for example, the arm supports 22A and 22B contact the forearms and support the remainder of the arms of the patient P, with the first arm support 22A and the second arm support 22B attached to the chest support plate 100 of the torso-lift support 24. If the torso-lift support 24 is not used, the arm supports 22A and 22B can both be directly attached to the offset main beam 12. The arm supports 22A and 22B are positioned such that the arms of the patient P are spaced away from the remainder of the patient's body to provide access (FIG. 6) to at least portions of the face and neck of the patient P, thereby providing greater access to the patient.

Figure 7:
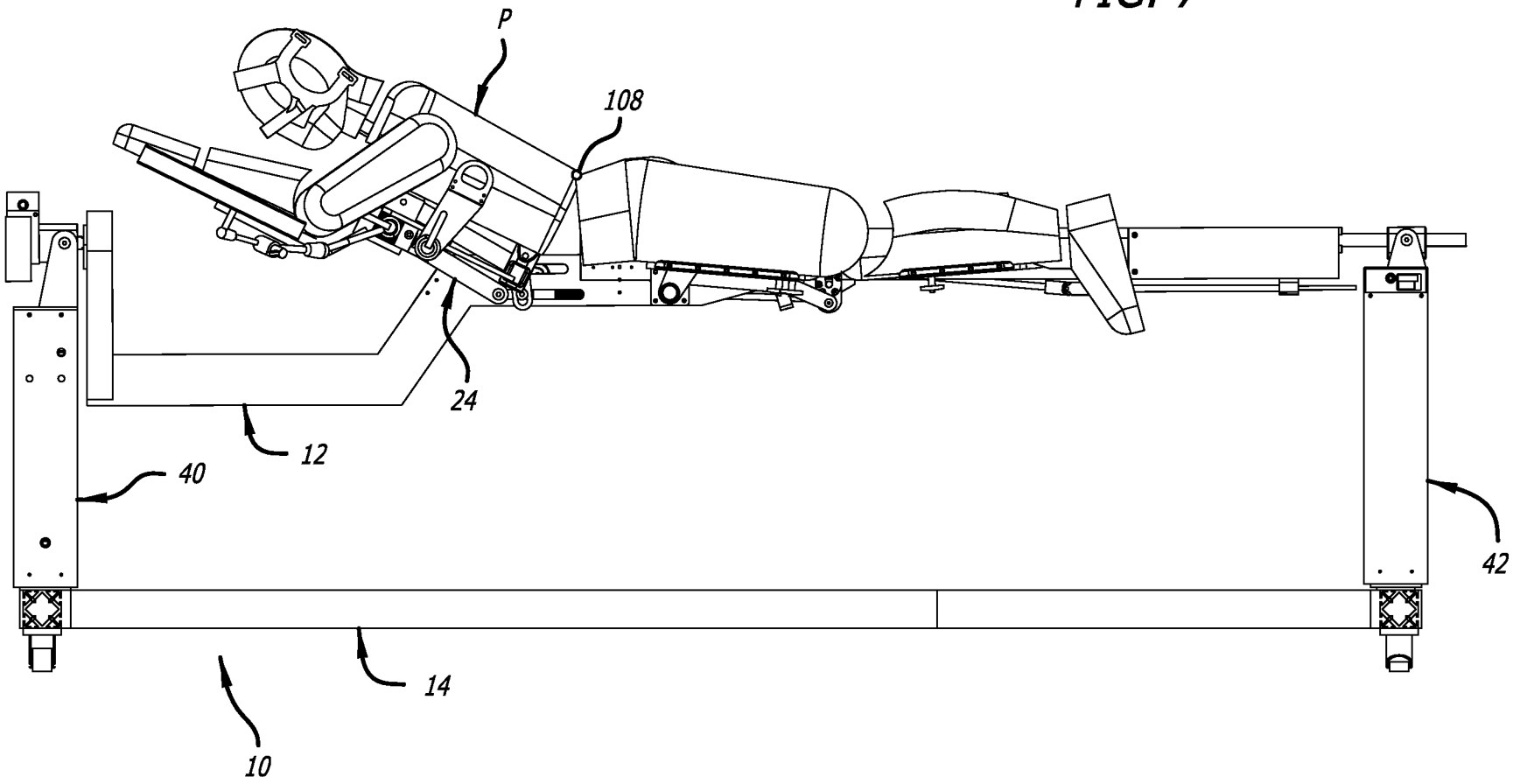
FIG. 7 is a side elevational view that illustrates the surgical frame of FIG. 1 showing a torso-lift support supporting the patient in a lifted position.
Figure 8:
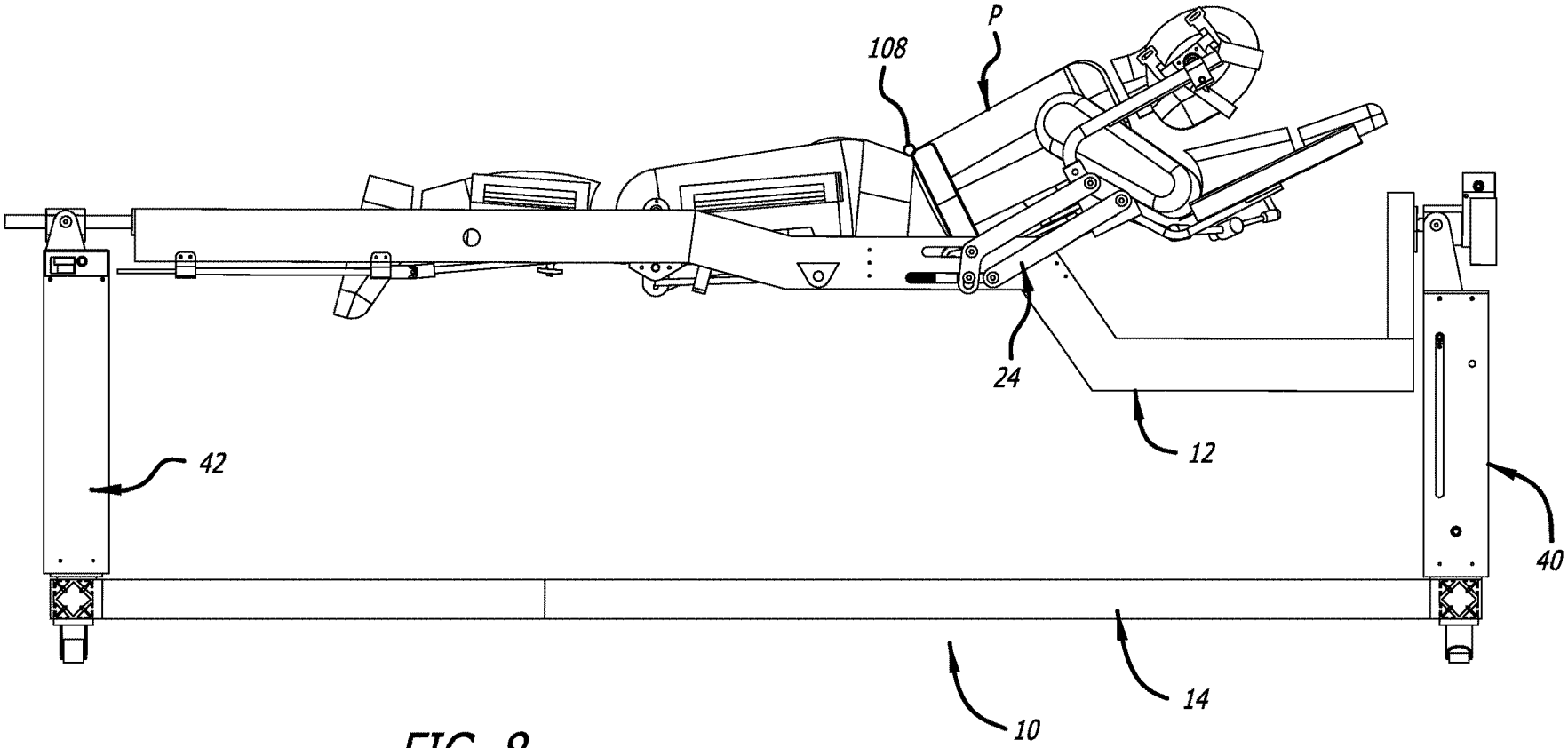
FIG. 8 is another side elevational view that illustrates the surgical frame of FIG. 1 showing the torso-lift support supporting the patient in the lifted position.
Figure 9:
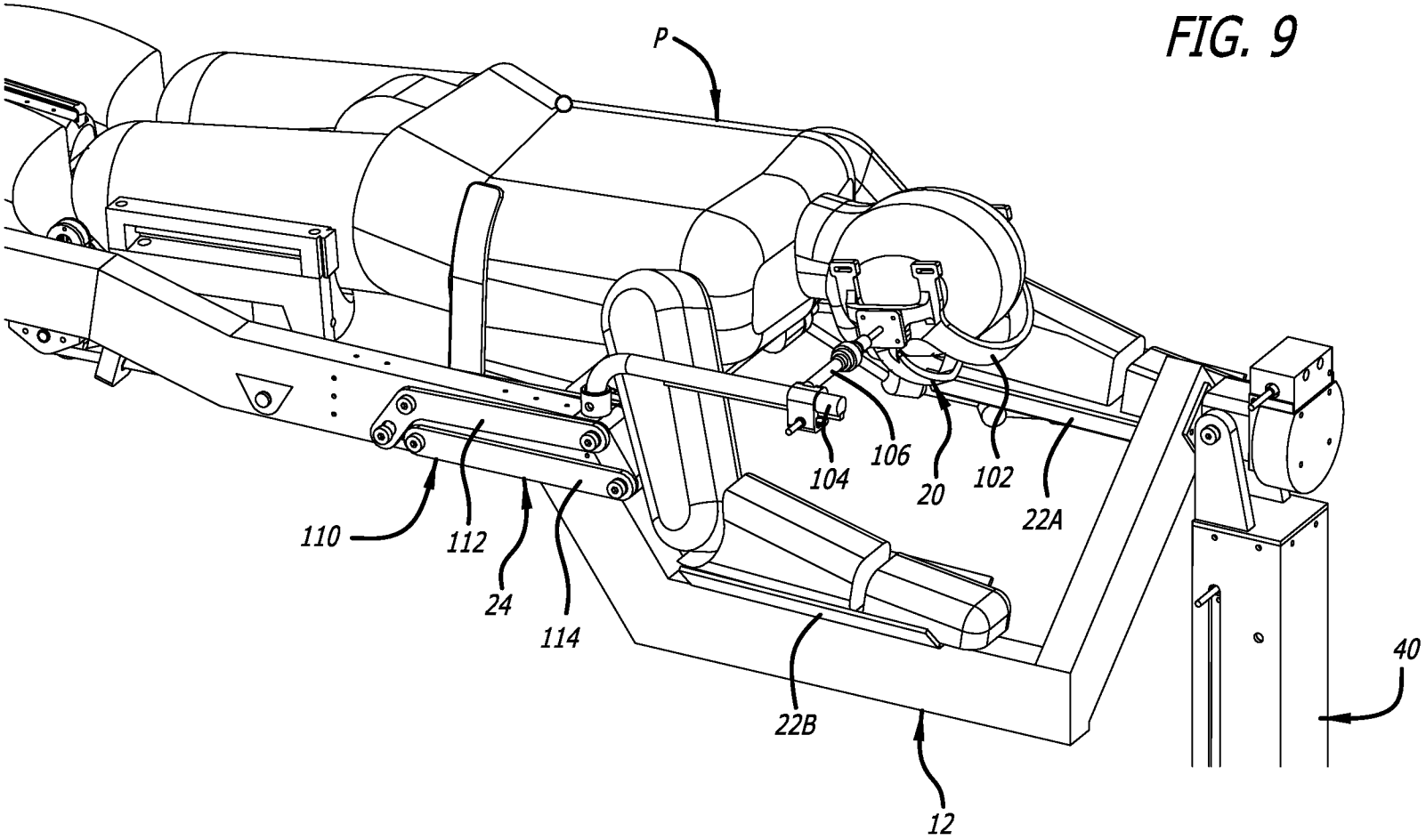
FIG. 9 is an enlarged top perspective view that illustrates portions of the surgical frame of FIG. 1 showing the torso-lift support supporting the patient in an unlifted position.

As depicted in FIGS. 7-12, for example, the surgical frame 10 includes a torso-lift capability for lifting and lowering the torso of the patient P between an uplifted position and a lifted position, which is described in detail below with respect to the torso-lift support 24. As depicted in FIGS. 7 and 8, for example, the torso-lift capability has an approximate center of rotation ("COR") 108 that is located at a position anterior to the patient's spine about the L2 of the lumbar spine, and is capable of elevating the upper body of the patient at least an additional six inches when measured at the chest support plate 100.

As depicted in FIGS. 9-12, for example, the torso-lift support 24 includes a "crawling" four-bar mechanism 110 attached to the chest support plate 100. Soft straps (not shown) can be used to secure the patient P to the chest support plate 100. The head support 20 and the arm supports 22A and 22B are attached to the chest support plate 100, thereby moving with the chest support plate 100 as the chest support plate 100 is articulated using the torso-lift support 24. The fixed COR 108 is defined at the position depicted in FIGS. 7 and 8. Appropriate placement of the COR 108 is important so that spinal cord integrity is not compromised (i.e., overly compressed or stretched) during the lift maneuver performed by the torso-lift support 24.

Figure 10:
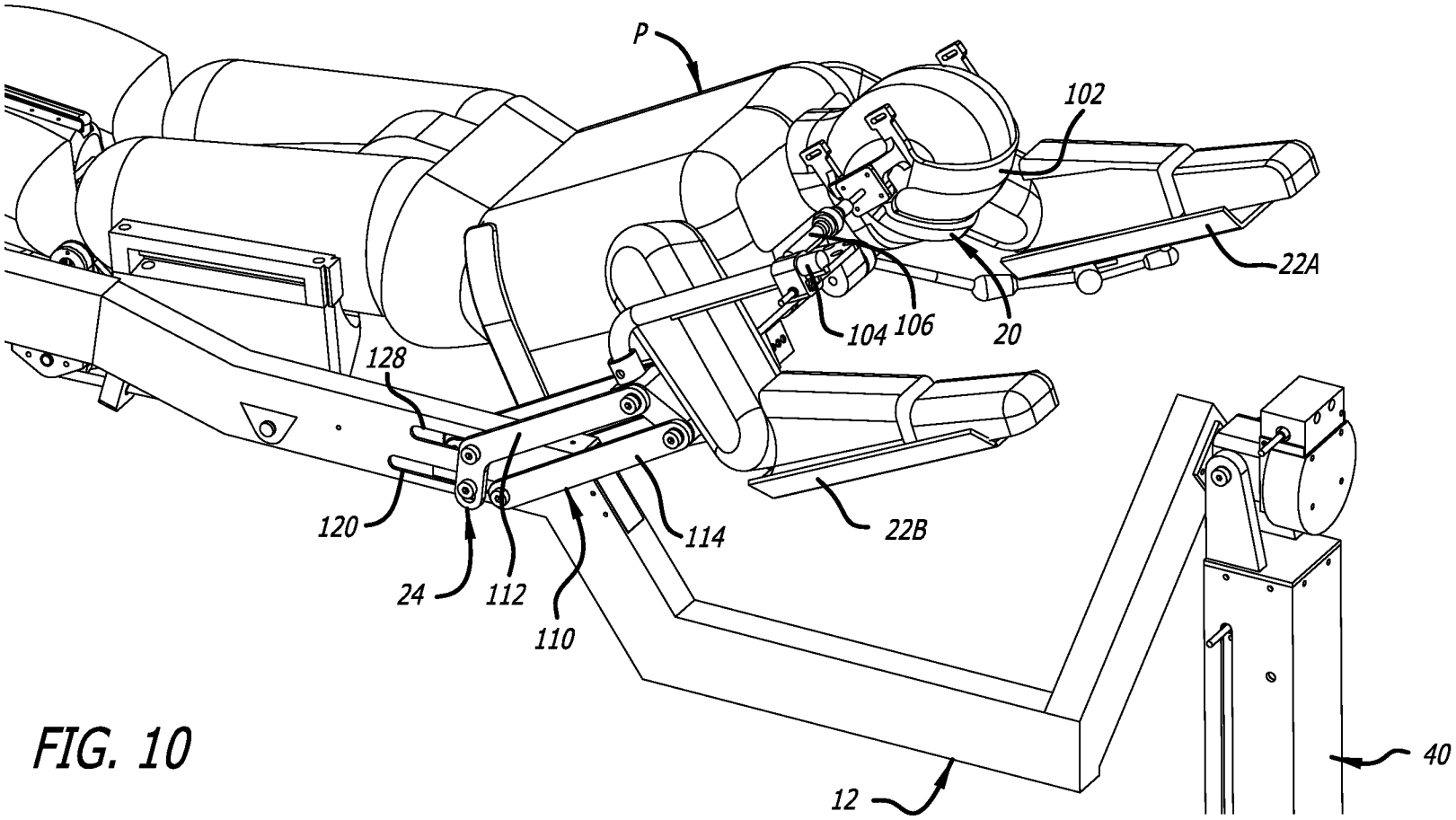
FIG. 10 is an enlarged top perspective view that illustrates portions of the surgical frame of FIG. 1 showing the torso-lift support supporting the patient in the lifted position.
Figure 11:
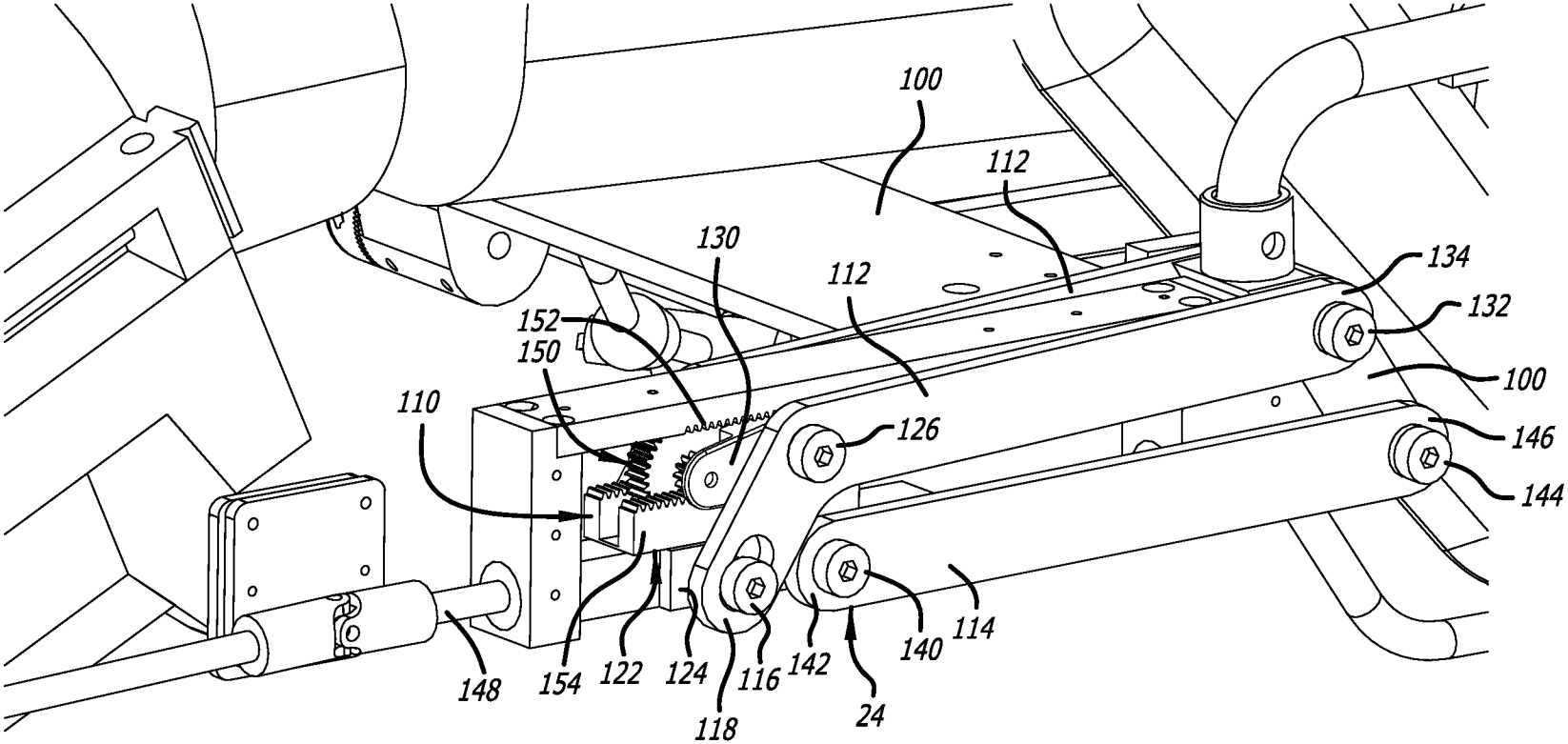
FIG. 11 is an enlarged top perspective view that illustrates componentry of the torso-lift support in the unlifted position.
Figure 12:
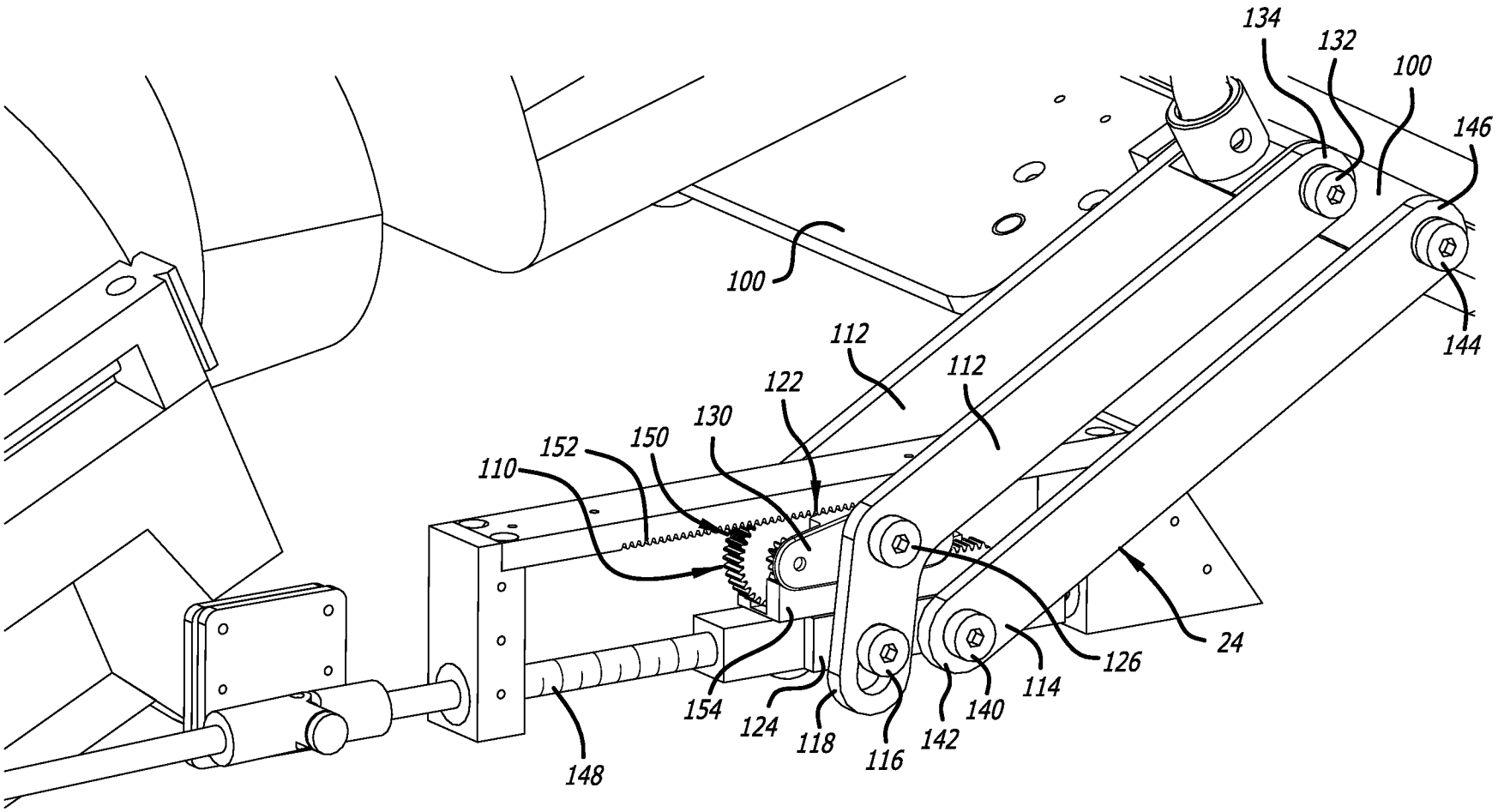
FIG. 12 is an enlarged top perspective view that illustrates the componentry of the torso-lift support in the lifted position.

As depicted in FIGS. 10-12, for example, the four-bar mechanism 110 includes first links 112 pivotally connected between offset main beam 12 and the chest support plate 100, and second links 114 pivotally connected between the offset main beam 12 and the chest support plate 100. As depicted in FIGS. 11 and 12, for example, in order to maintain the COR 108 at the desired fixed position, the first and second links 112 and 114 of the four-bar mechanism 110 crawl toward the first support portion 40 of the support structure 14, when the patient's upper body is being lifted. The first and second links 112 and 114 are arranged such that neither the surgeon's workspace nor imaging access are compromised while the patient's torso is being lifted.

As depicted in FIGS. 11 and 12, for example, each of the first links 112 define an L-shape, and includes a first pin 116 at a first end 118 thereof. The first pin 116 extends through first elongated slots 120 defined in the offset main beam 12, and the first pin 116 connects the first links 112 to a dual rack and pinion mechanism 122 via a drive nut 124 provided within the offset main beam 12, thus defining a lower pivot point thereof. Each of the first links 112 also includes a second pin 126 positioned proximate the corner of the L-shape. The second pin 126 extends through second elongated slots 128 defined in the offset main beam 12, and is linked to a carriage 130 of rack and pinion mechanism 122. Each of the first links 112 also includes a third pin 132 at a second end 134 that is pivotally attached to chest support plate 100, thus defining an upper pivot point thereof.

As depicted in FIGS. 11 and 12, for example, each of the second links 114 includes a first pin 140 at a first end 142 thereof. The first pin 140 extends through the first elongated slot 120 defined in the offset main beam 12, and the first pin 140 connects the second links 114 to the drive nut 124 of the rack and pinion mechanism 122, thus defining a lower pivot point thereof. Each of the second links 114 also includes a second pin 144 at a second end 146 that is pivotally connected to the chest support plate 100, thus defining an upper pivot point thereof.

As depicted in FIGS. 11 and 12, the rack and pinion mechanism 122 includes a drive screw 148 engaging the drive nut 124. Coupled gears 150 are attached to the carriage 130. The larger of the gears 150 engage an upper rack 152 (fixed within the offset main beam 12), and the smaller of the gears 150 engage a lower rack 154. The carriage 130 is defined as a gear assembly that floats between the two racks 152 and 154.

As depicted in FIGS. 11 and 12, the rack and pinion mechanism 122 converts rotation of the drive screw 148 into linear translation of the first and second links 112 and 114 in the first and second elongated slots 120 and 128 toward the first portion 40 of the support structure 14. As the drive nut 124 translates along drive screw 148 (via rotation of the drive screw 148), the carriage 130 translates towards the first portion 40 with less travel due to the different gear sizes of the coupled gears 150. The difference in travel, influenced by different gear ratios, causes the first links 112 pivotally attached thereto to lift the chest support plate 100. Lowering of the chest support plate 100 is accomplished by performing this operation in reverse. The second links 114 are "idler" links (attached to the drive nut 124 and the chest support plate 100) that controls the tilt of the chest support plate 100 as it is being lifted and lowered. All components associated with lifting while tilting the chest plate predetermine where COR 108 resides. Furthermore, a servomotor (not shown) interconnected with the drive screw 148 can be computer controlled and/or operated by the operator of the surgical frame 10 to facilitate controlled lifting and lowering of the chest support plate 100. A safety feature can be provided, enabling the operator to read and limit a lifting and lowering force applied by the torso-lift support 24 in order to prevent injury to the patient P. Moreover, the torso-lift support 24 can also include safety stops (not shown) to prevent over-extension or compression of the patient P, and sensors (not shown) programmed to send patient position feedback to the safety stops.

Figure 13A:
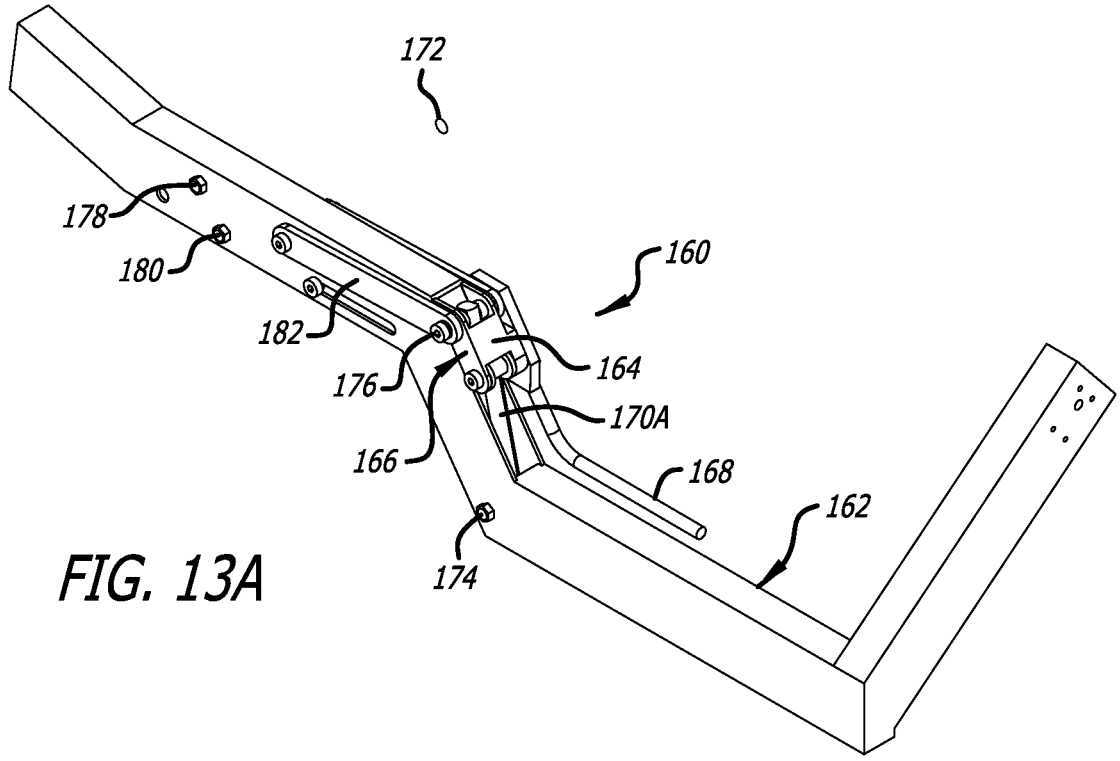
FIG. 13A is a perspective view of an embodiment that illustrates a structural offset main beam for use with another embodiment of a torso-lift support showing the torso-lift support in a retracted position.

An alternative preferred embodiment of a torso-lift support is generally indicated by the numeral 160 in FIGS. 13A-15. As depicted in FIGS. 13A-13C, an alternate offset main beam 162 is utilized with the torso-lift support 160. Furthermore, the torso-lift support 160 has a support plate 164 pivotally linked to the offset main beam 162 by a chest support lift mechanism 166. An arm support rod/plate 168 is connected to the support plate 164, and the second arm support 22B. The support plate 164 is attached to the chest support plate 100, and the chest support lift mechanism 166 includes various actuators 170A, 170B, and 170C used to facilitate positioning and repositioning of the support plate 164 (and hence, the chest support plate 100).

Figure 13B:
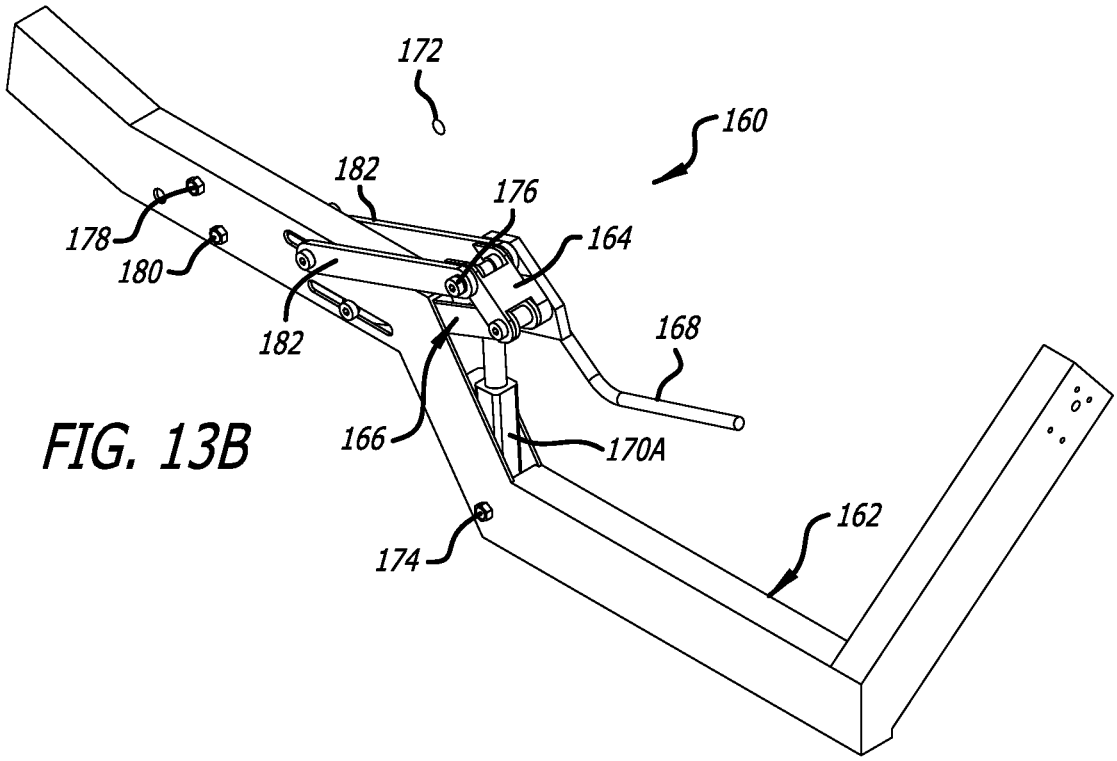
FIG. 13B is a perspective view similar to FIG. 13A showing the torso-lift support at half travel.
Figure 13C:
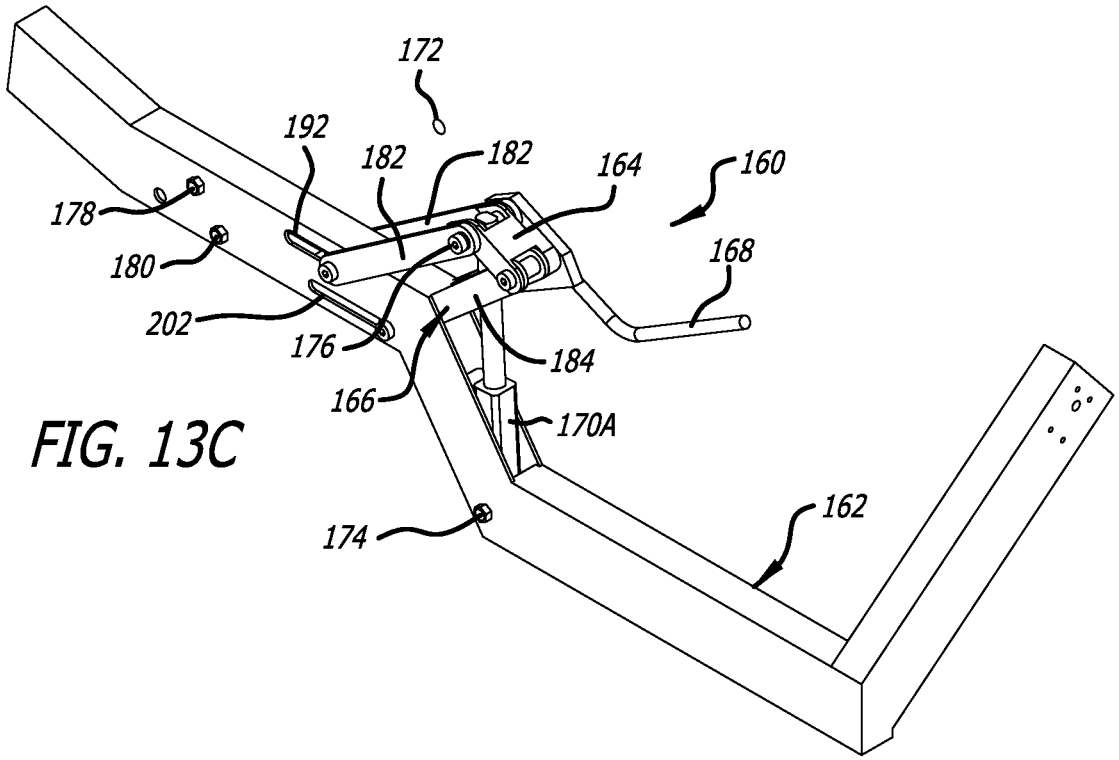
FIG. 13C is a perspective view similar to FIGS. 13A and 13B showing the torso-lift support at full travel.

As discussed below, the torso-lift support 160 depicted in FIGS. 13A-15 enables a COR 172 thereof to be programmably altered such that the COR 172 can be a fixed COR or a variable COR. As their names suggest, the fixed COR stays in the same position as the torso-lift support 160 is actuated, and the variable COR moves between a first position and a second position as the torso-lift support 160 is actuated between its initial position and final position at full travel thereof. Appropriate placement of the COR 172 is important so that spinal cord integrity is not compromised (i.e., overly compressed or stretched). Thus, the support plate 164 (and hence, the chest support plate 100) follows a path coinciding with a predetermined COR 172 (either fixed or variable). FIG. 13A depicts the torso-lift support 160 retracted, FIG. 13B depicts the torso-lift support 160 at half travel, and FIG. 13C depicts the torso-lift support 160 at full travel.

Figure 14:
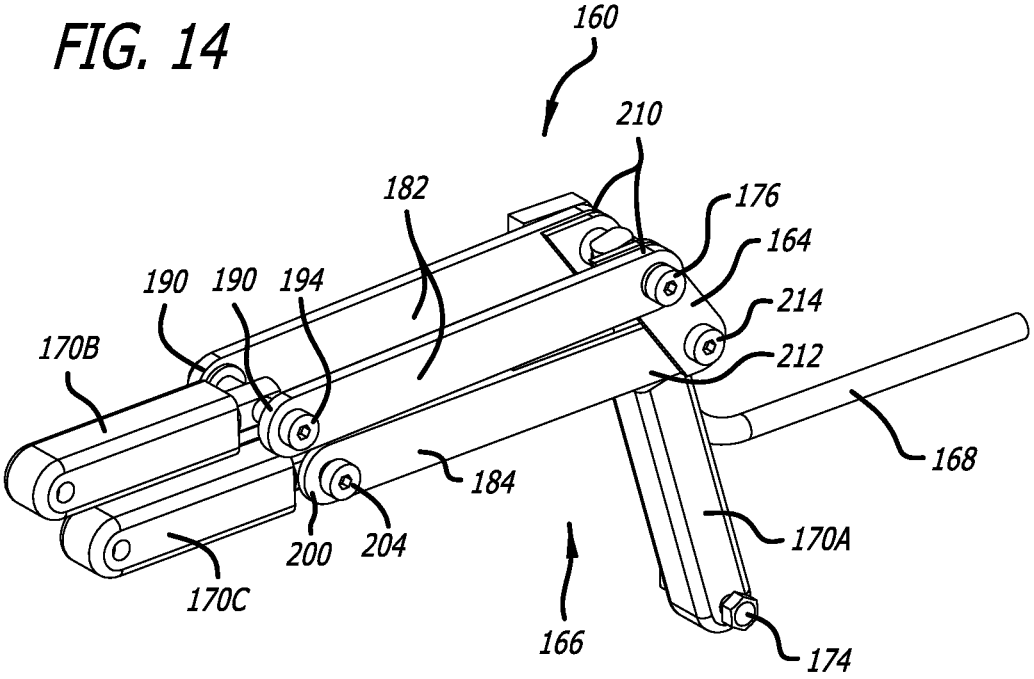
FIG. 14 is a perspective view that illustrates a chest support lift mechanism of the torso-lift support of FIGS. 13A-13C with actuators thereof retracted.
Figure 15:
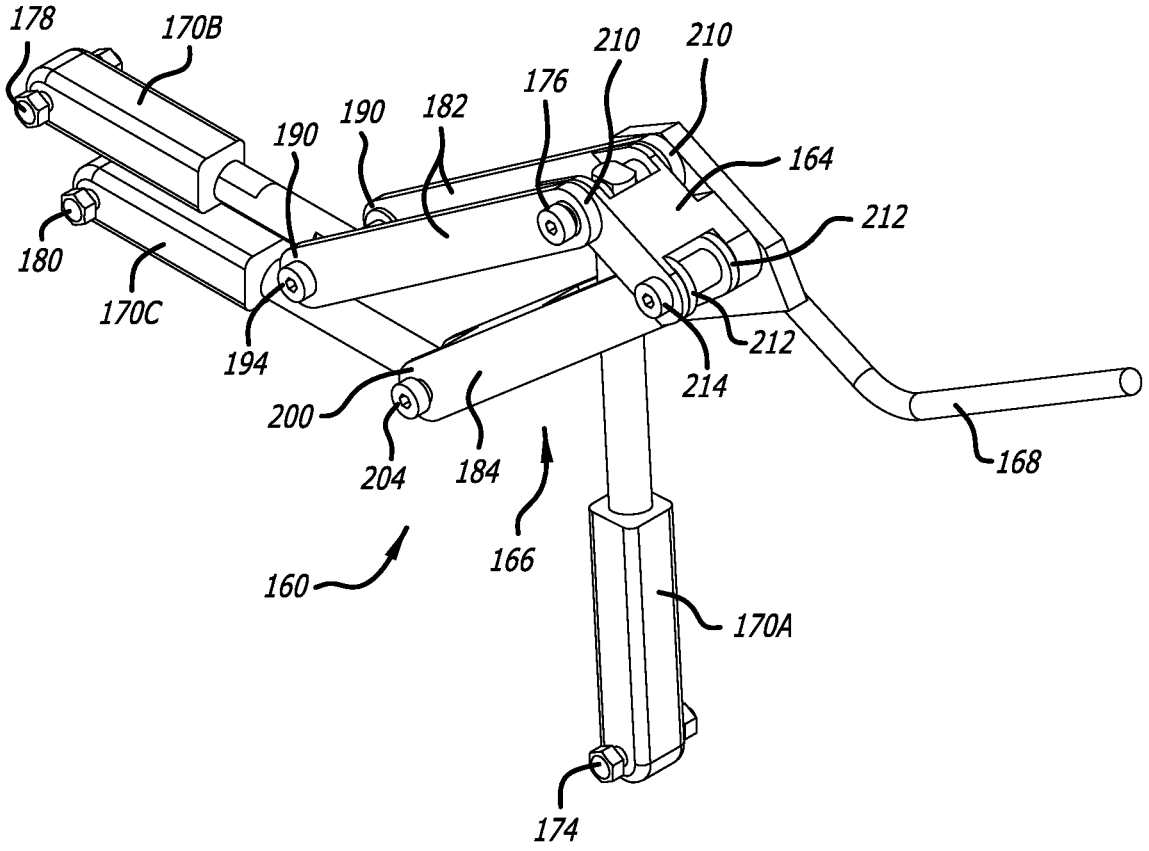
FIG. 15 is another perspective view that illustrates a chest support lift mechanism of the torso-lift support of FIGS. 13A-13C with the actuators thereof extended.

As discussed above, the chest support lift mechanism 166 includes the actuators 170A, 170B, and 170C to position and reposition the support plate 164 (and hence, the chest support plate 100). As depicted in FIGS. 14 and 15, for example, the first actuator 170A, the second actuator 170B, and the third actuator 170C are provided. Each of the actuators 170A, 170B, and 170C are interconnected with the offset main beam 12 and the support plate 164, and each of the actuators 170A, 170B, and 170C are moveable between a retracted and extended position. As depicted in FIGS. 13A-13C, the first actuator 170A is pinned to the offset main beam 162 using a pin 174 and pinned to the support plate 164 using a pin 176. Furthermore, the second and third actuators 170B and 170C are received within the offset main beam 162. The second actuator 170B is interconnected with the offset main beam 162 using a pin 178, and the third actuator 170C is interconnected with the offset main beam 162 using a pin 180.

The second actuator 170B is interconnected with the support plate 164 via first links 182, and the third actuator 170C is interconnected with the support plate 164 via second links 184. First ends 190 of the first links 182 are pinned to the second actuator 170B and elongated slots 192 formed in the offset main beam 162 using a pin 194, and first ends 200 of the second links 184 are pinned to the third actuator 170C and elongated slots 202 formed in the offset main beam 162 using a pin 204. The pins 194 and 204 are moveable within the elongated slots 192 and 202. Furthermore, second ends 210 of the first links 182 are pinned to the support plate 164 using the pin 176, and second ends 212 of the second links 184 are pinned to the support plate 164 using a pin 214. To limit interference therebetween, as depicted in FIGS. 13A-13C, the first links 182 are provided on the exterior of the offset main beam 162, and, depending on the position thereof, the second links 184 are positioned on the interior of the offset main beam 162.

Actuation of the actuators 170A, 170B, and 170C facilitates movement of the support plate 164. Furthermore, the amount of actuation of the actuators 170A, 170B, and 170C can be varied to affect different positions of the support plate 164. As such, by varying the amount of actuation of the actuators 170A, 1706, and 170C, the COR 172 thereof can be controlled. As discussed above, the COR 172 can be predetermined, and can be either fixed or varied. Furthermore, the actuation of the actuators 170A, 170B, and 170C can be computer controlled and/or operated by the operator of the surgical frame 10, such that the COR 172 can be programmed by the operator. As such, an algorithm can be used to determine the rates of extension of the actuators 170A, 1706, and 170C to control the COR 172, and the computer controls can handle implementation of the algorithm to provide the predetermined COR. A safety feature can be provided, enabling the operator to read and limit a lifting force applied by the actuators 170A, 170B, and 170C in order to prevent injury to the patient P. Moreover, the torso-lift support 160 can also include safety stops (not shown) to prevent over-extension or compression of the patient P, and sensors (not shown) programmed to send patient position feedback to the safety stops.

FIGS. 16-23 depict portions of the sagittal adjustment assembly 28. The sagittal adjustment assembly 28 can be used to distract or compress the patient's lumbar spine during or after lifting or lowering of the patient's torso by the torso-lift supports. The sagittal adjustment assembly 28 supports and manipulates the lower portion of the patient's body. In doing so, the sagittal adjustment assembly 28 is configured to make adjustments in the sagittal plane of the patient's body, including tilting the pelvis, controlling the position of the upper and lower legs, and lordosing the lumbar spine.

Figure 16:
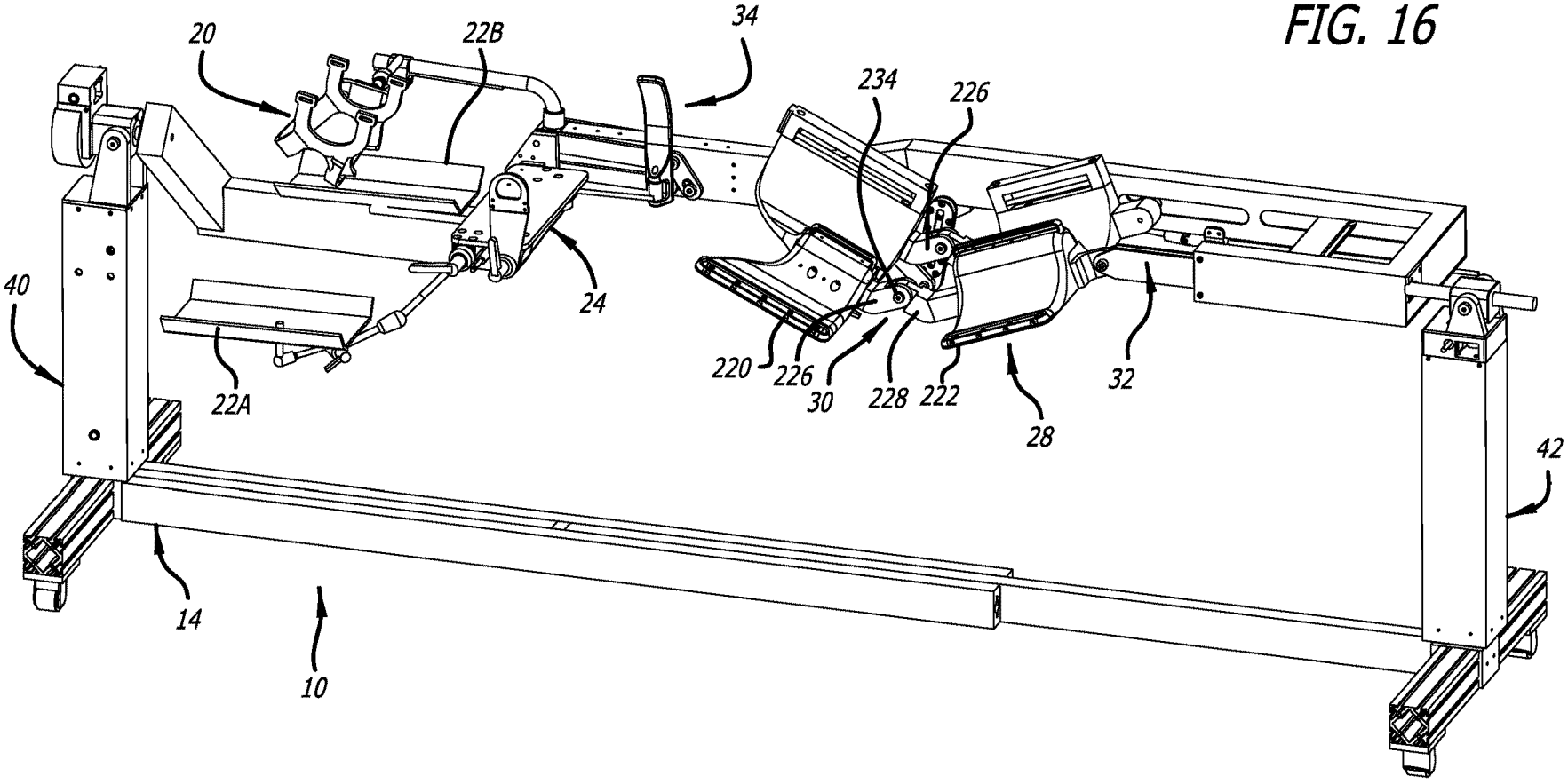
FIG. 16 is a top perspective view that illustrates the surgical frame of FIG. 1.
Figure 17:
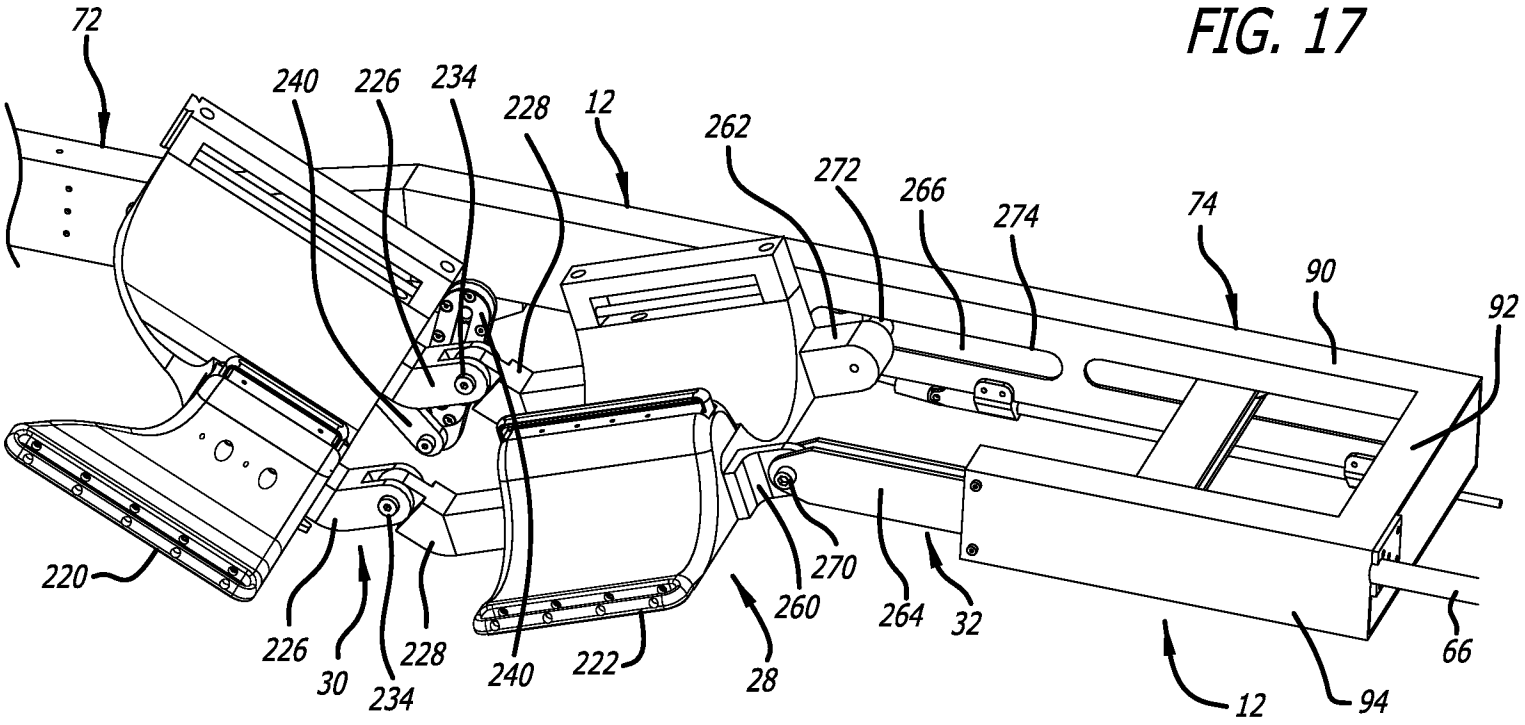
FIG. 17 is an enlarged top perspective view that illustrates portions of the surgical frame of FIG. 1 showing a sagittal adjustment assembly including a pelvic-tilt mechanism and leg adjustment mechanism.

As depicted in FIGS. 16 and 17, for example, the sagittal adjustment assembly 28 includes the pelvic-tilt mechanism 30 for supporting the thighs and lower legs of the patient P. The pelvic-tilt mechanism 30 includes a thigh cradle 220 configured to support the patient's thighs, and a lower leg cradle 222 configured to support the patient's shins. Different sizes of thigh and lower leg cradles can be used to accommodate different sizes of patients, i.e., smaller thigh and lower leg cradles can be used with smaller patients, and larger thigh and lower leg cradles can be used with larger patients. Soft straps (not shown) can be used to secure the patient P to the thigh cradle 220 and the lower leg cradle 222. The thigh cradle 220 and the lower leg cradle 222 are moveable and pivotal with respect to one another and to the offset main beam 12. To facilitate rotation of the patient's hips, the thigh cradle 220 and the lower leg cradle 222 can be positioned anterior and inferior to the patient's hips.

Figure 18:
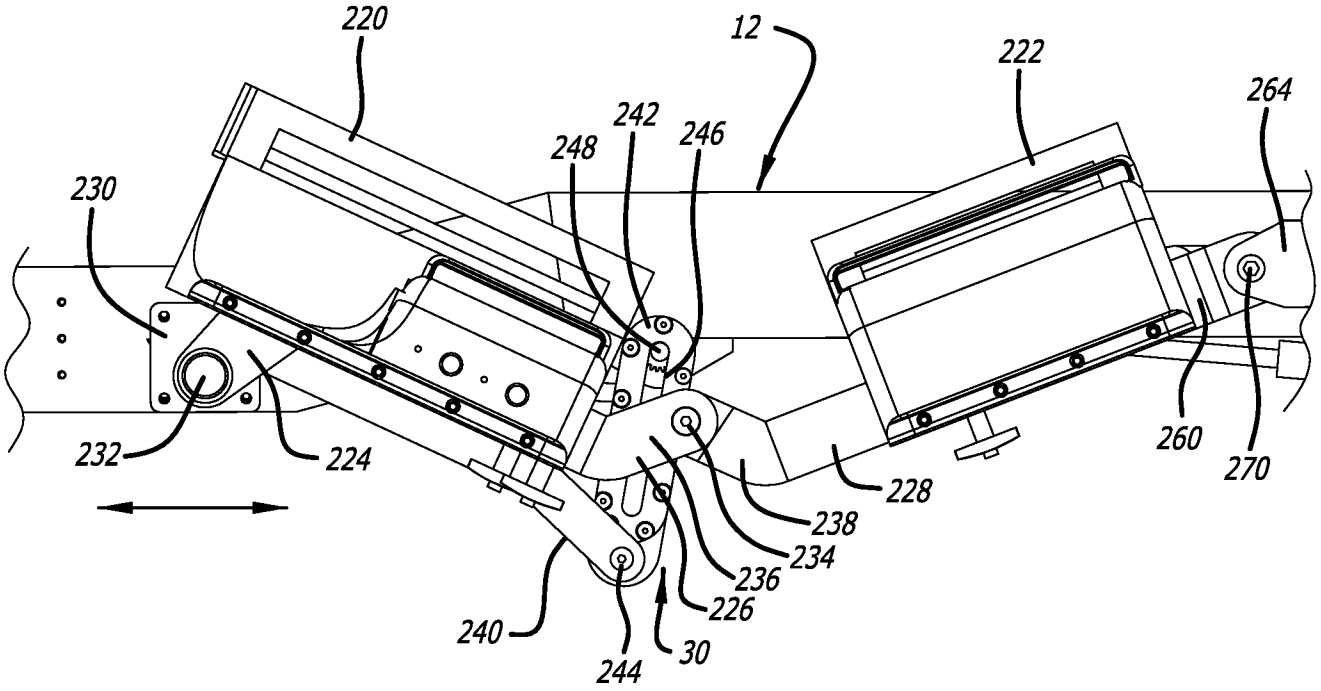
FIG. 18 is an enlarged side elevational view that illustrates portions of the surgical frame of FIG. 1 showing the pelvic-tilt mechanism.
Figure 25:
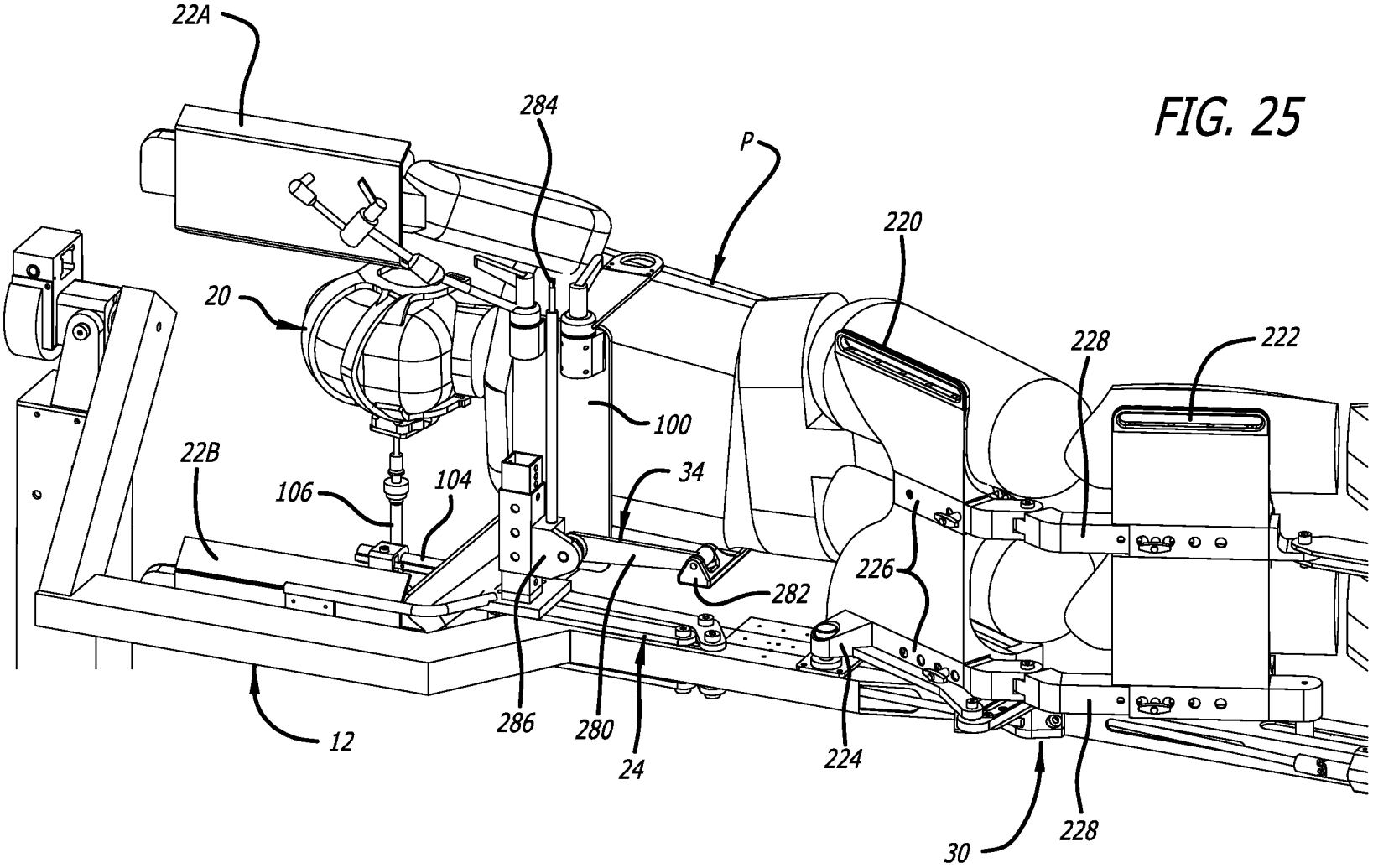
FIG. 25 is a top perspective view that illustrates portions of the surgical frame of FIG. 1 showing operation of the coronal adjustment assembly.

As depicted in FIGS. 18 and 25, for example, a first support strut 224 and second support struts 226 are attached to the thigh cradle 220. Furthermore, third support struts 228 are attached to the lower leg cradle 222. The first support strut 224 is pivotally attached to the offset main beam 12 via a support plate 230 and a pin 232, and the second support struts 226 are pivotally attached to the third support struts 228 via pins 234. The pins 234 extend through angled end portions 236 and 238 of the second and third support struts 226 and 228, respectively. Furthermore, the lengths of second and third support struts 226 and 228 are adjustable to facilitate expansion and contraction of the lengths thereof.

To accommodate patients with different torso lengths, the position of the thigh cradle 220 can be adjustable by moving the support plate 230 along the offset main beam 12. Furthermore, to accommodate patients with different thigh and lower leg lengths, the lengths of the second and third support struts 226 and 228 can be adjusted.

Figure 19:
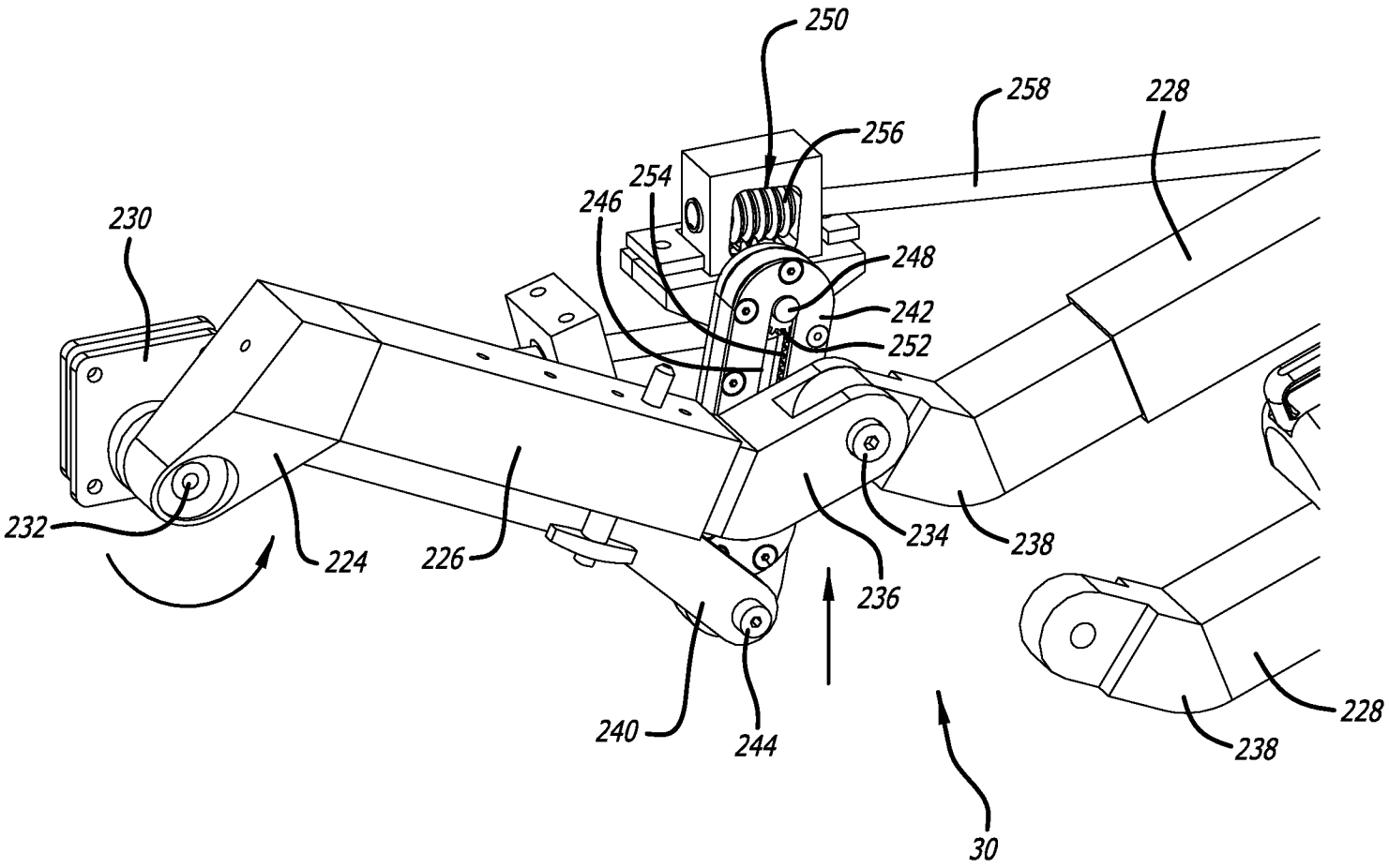
FIG. 19 is an enlarged perspective view that illustrates componentry of the pelvic-tilt mechanism.
Figure 20:
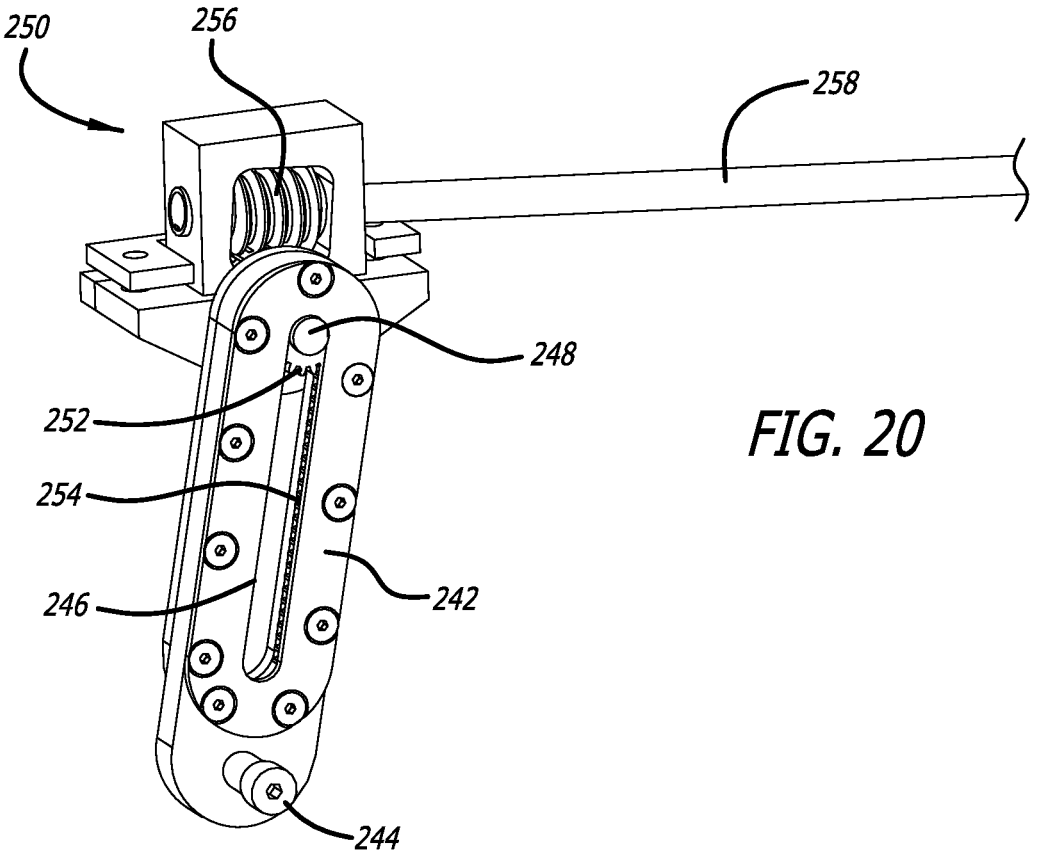
FIG. 20 is an enlarged perspective view that illustrates a captured rack and a worm gear assembly of the componentry of the pelvic-tilt mechanism.
Figure 21:
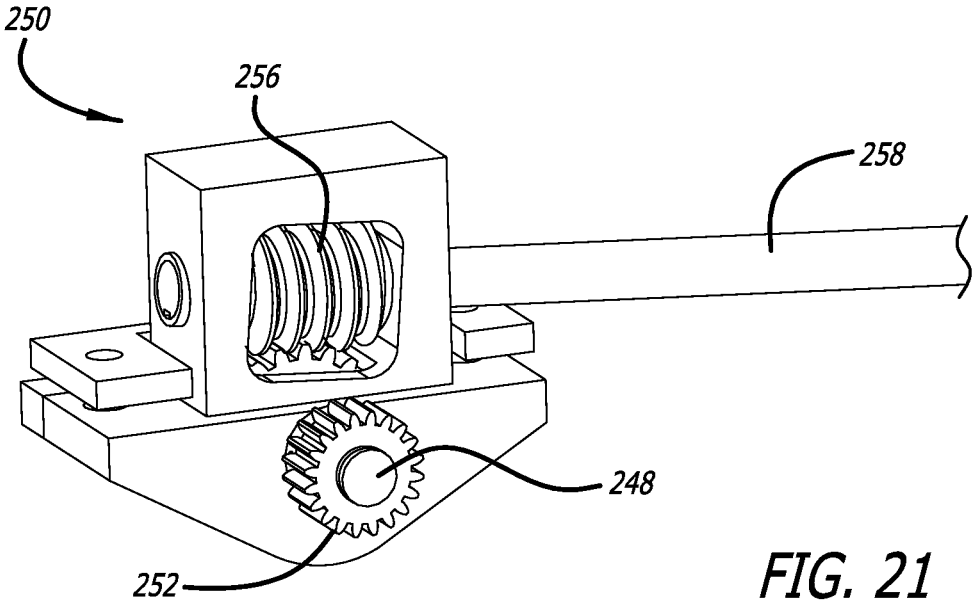
FIG. 21 is an enlarged perspective view that illustrates the worm gear assembly of FIG. 20.

To control the pivotal angle between the second and third support struts 226 and 228 (and hence, the pivotal angle between the thigh cradle 220 and lower leg cradle 222), a link 240 is pivotally connected to a captured rack 242 via a pin 244. The captured rack 242 includes an elongated slot 246, through which is inserted a worm gear shaft 248 of a worm gear assembly 250. The worm gear shaft 248 is attached to a gear 252 provided on the interior of the captured rack 242. The gear 252 contacts teeth 254 provided inside the captured rack 242, and rotation of the gear 252 (via contact with the teeth 254) causes motion of the captured rack 242 upwardly and downwardly. The worm gear assembly 250, as depicted in FIGS. 19-21, for example, includes worm gears 256 which engage a drive shaft 258, and which are connected to the worm gear shaft 248.

The worm gear assembly 250 also is configured to function as a brake, which prevents unintentional movement of the sagittal adjustment assembly 28. Rotation of the drive shaft 258 causes rotation of the worm gears 256, thereby causing reciprocal vertical motion of the captured rack 242. The vertical reciprocal motion of the captured rack 242 causes corresponding motion of the link 240, which in turn pivots the second and third support struts 226 and 228 to correspondingly pivot the thigh cradle 220 and lower leg cradle 222. A servomotor (not shown) interconnected with the drive shaft 258 can be computer controlled and/or operated by the operator of the surgical frame 10 to facilitate controlled reciprocal motion of the captured rack 242.

The sagittal adjustment assembly 28 also includes the leg adjustment mechanism 32 facilitating articulation of the thigh cradle 220 and the lower leg cradle 222 with respect to one another. In doing so, the leg adjustment mechanism 32 accommodates the lengthening and shortening of the patient's legs during bending thereof. As depicted in FIG. 17, for example, the leg adjustment mechanism 32 includes a first bracket 260 and a second bracket 262 attached to the lower leg cradle 222. The first bracket 260 is attached to a first carriage portion 264, and the second bracket 262 is attached to a second carriage portion 266 via pins 270 and 272, respectively. The first carriage portion 264 is slidable within third portion 94 of the rear portion 74 of the offset main beam 12, and the second carriage portion 266 is slidable within the first portion 90 of the rear portion 74 of the offset main beam 12. An elongated slot 274 is provided in the first portion 90 to facilitate engagement of the second bracket 262 and the second carriage portion 266 via the pin 272. As the thigh cradle 220 and the lower leg cradle 222 articulate with respect to one another (and the patient's legs bend accordingly), the first carriage 264 and the second carriage 266 can move accordingly to accommodate such movement.

Figure 22:
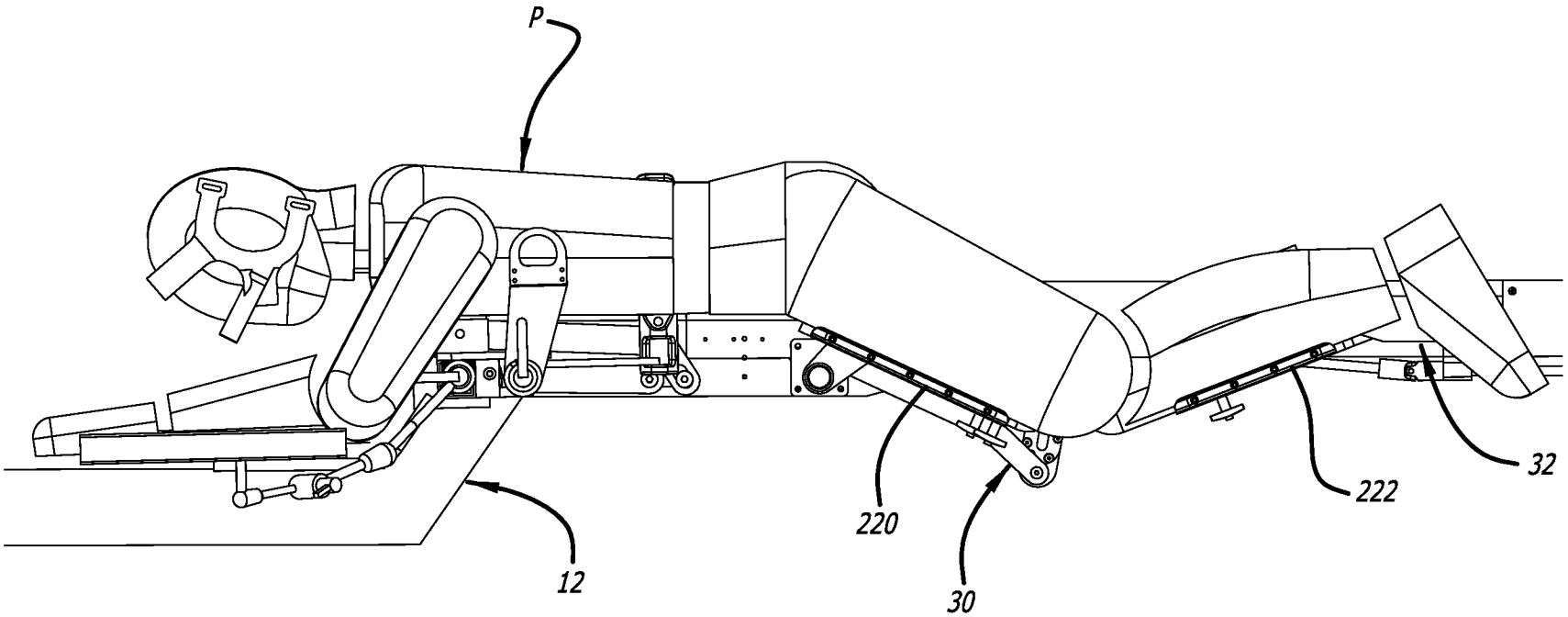
FIG. 22 is a side elevational view that illustrates portions of the surgical frame of FIG. 1 showing the patient positioned thereon and the pelvic-tilt mechanism of the sagittal adjustment assembly in the flexed position.
Figure 23:
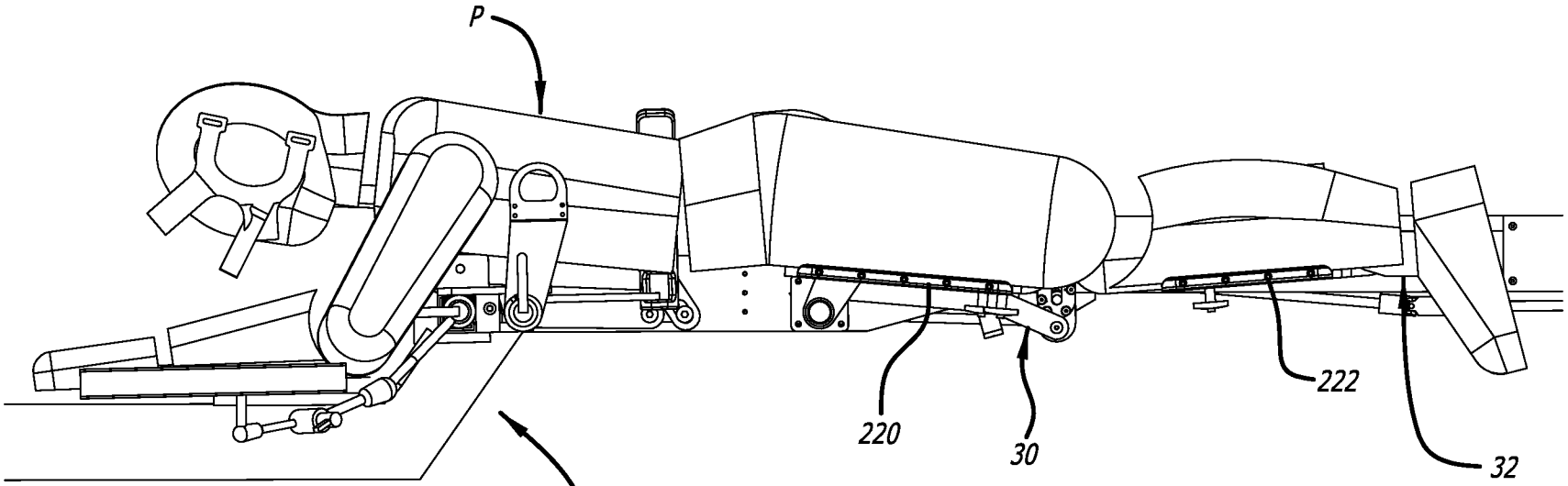
FIG. 23 is another side elevational view that illustrates portions of the surgical frame of FIG. 1 showing the patient positioned thereon and the pelvic-tilt mechanism of the sagittal adjustment assembly in the fully extended position.

The pelvic-tilt mechanism 30 is movable between a flexed position and a fully extended position. As depicted in FIG. 22, in the flexed position, the lumbar spine is hypo-lordosed. This opens the posterior boundaries of the lumbar vertebral bodies and allows for easier placement of any interbody devices. The lumbar spine stretches slightly in this position. As depicted in FIG. 23, in the extended position, the lumbar spine is lordosed. This compresses the lumbar spine. When posterior fixation devices, such as rods and screws, are placed, optimal sagittal alignment can be achieved. During sagittal alignment, little to negligible angle change occurs between the thighs and the pelvis. The pelvic-tilt mechanism 30 also can hyper-extend the hips as a means of lordosing the spine, in addition to tilting the pelvis. One of ordinary skill will recognize, however, that straightening the patient's legs does not lordose the spine. Leg straightening is a consequence of rotating the pelvis while maintaining a fixed angle between the pelvis and the thighs.

The sagittal adjustment assembly 28, having the configuration described above, further includes an ability to compress and distract the spine dynamically while in the lordosed or flexed positions. The sagittal adjustment assembly 28 also includes safety stops (not shown) to prevent over-extension or compression of the patient, and sensors (not shown) programmed to send patient position feedback to the safety stops.

Figure 24:
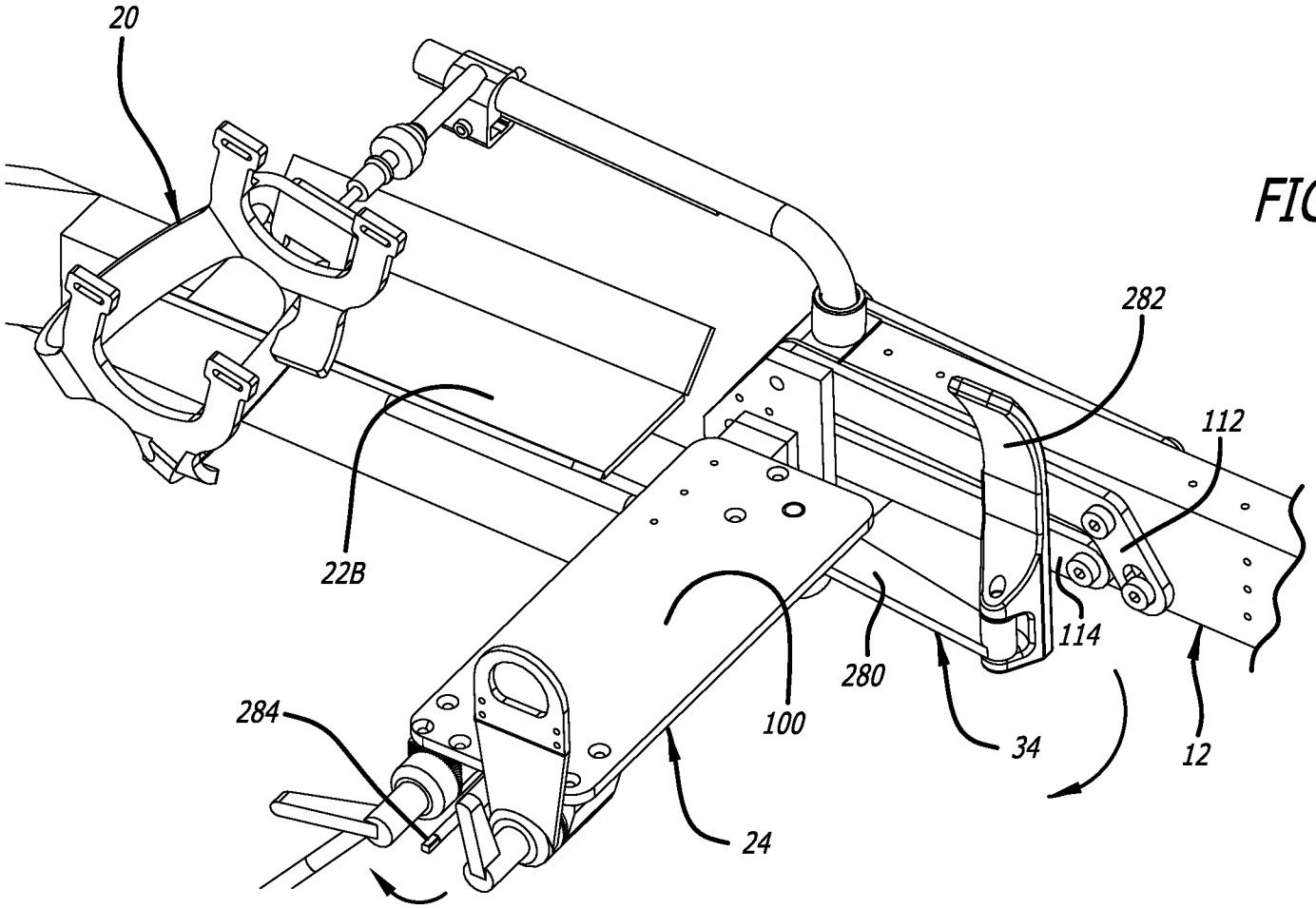
FIG. 24 is an enlarged top perspective view that illustrates portions of the surgical frame of FIG. 1 showing a coronal adjustment assembly.
Figure 26:
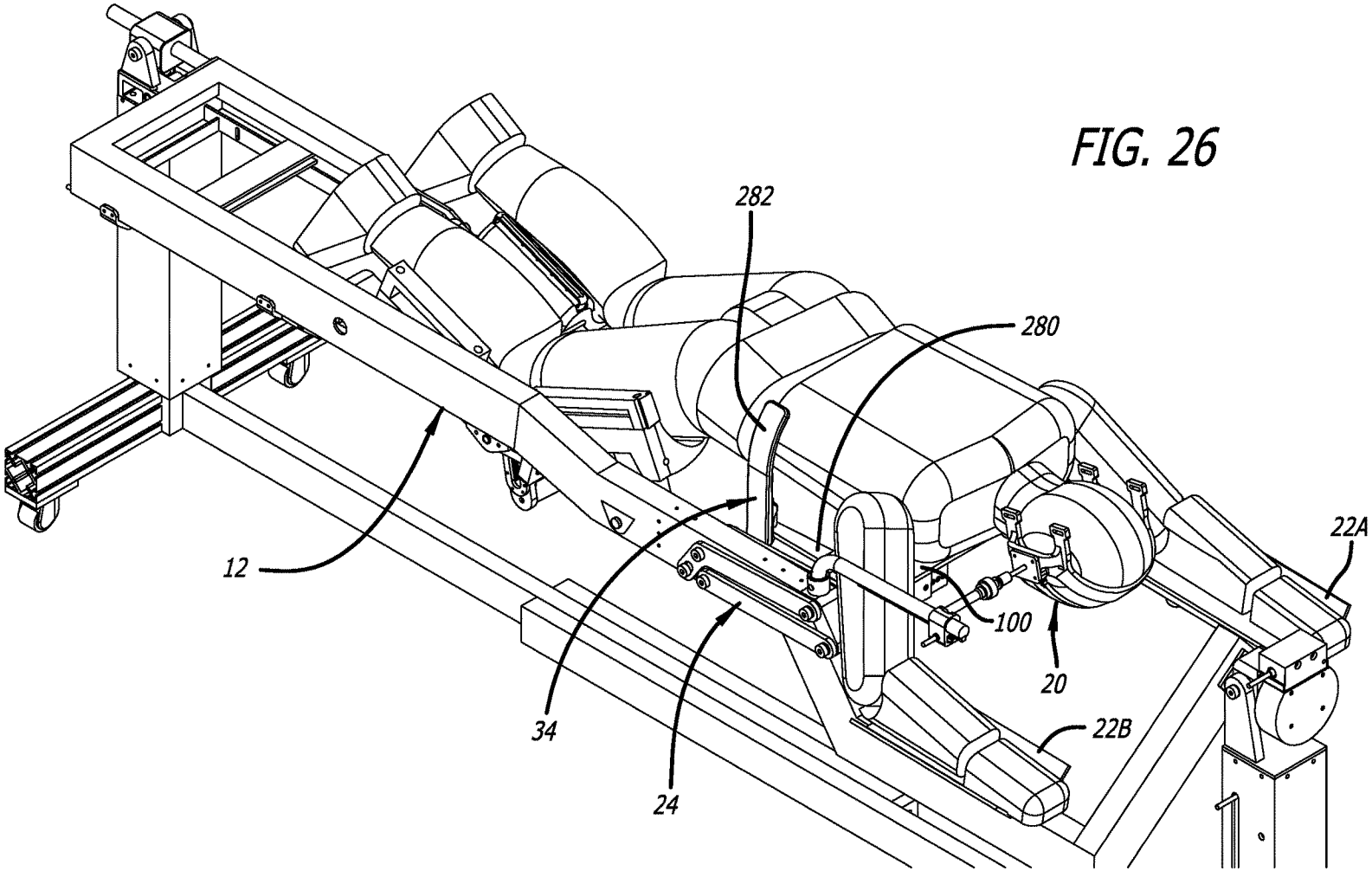
FIG. 26 is a top perspective view that illustrates a portion of the surgical frame of FIG. 1 showing operation of the coronal adjustment assembly.
Figure 27:
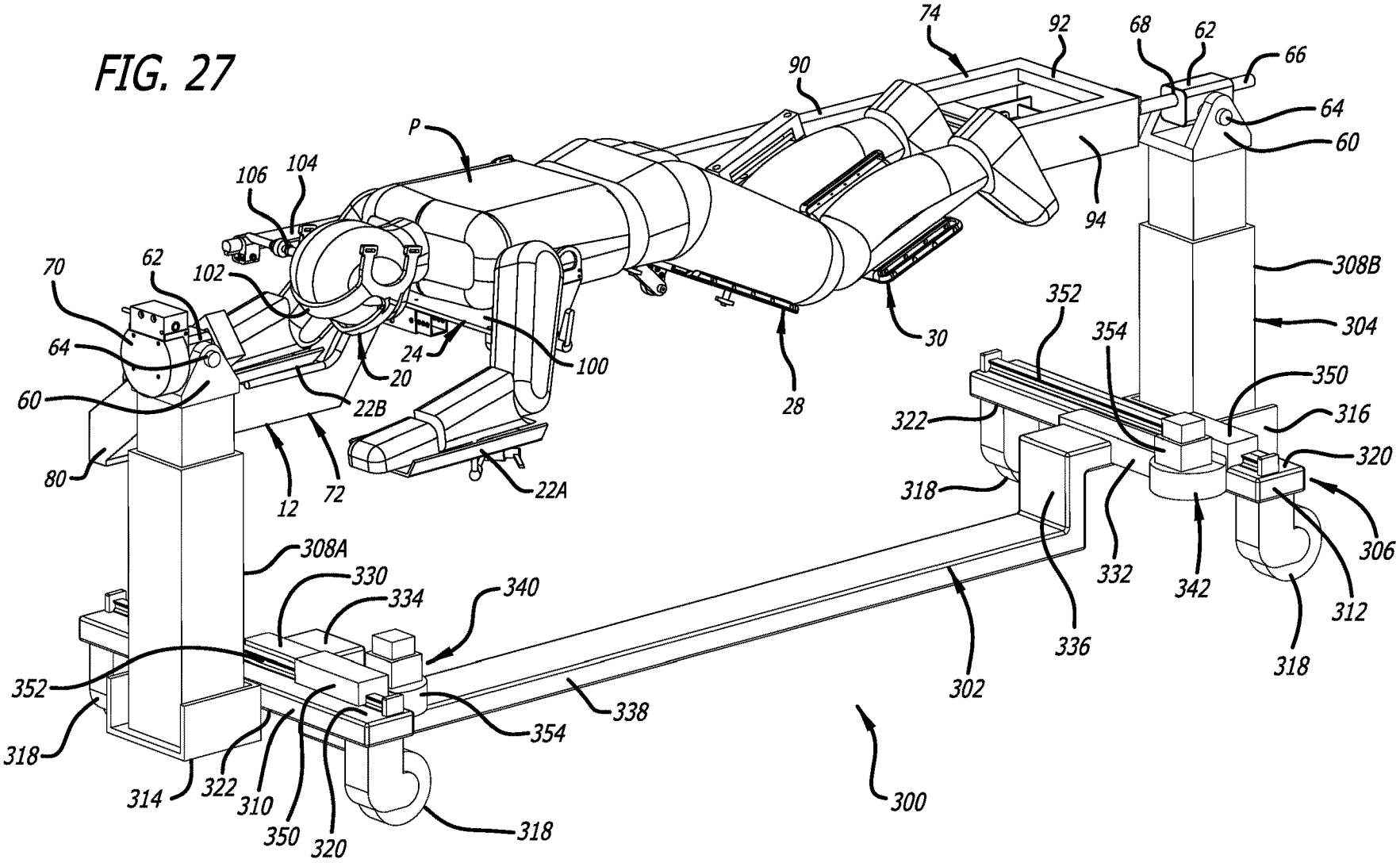
FIG. 27 is a top perspective view that illustrates a prior art surgical frame in accordance with an embodiment of the present invention with the patient positioned thereon in a prone position showing a translating beam thereof in a first position.

As depicted in FIGS. 24-26, for example, the coronal adjustment assembly 34 is configured to support and manipulate the patient's torso, and further to correct a spinal deformity, including but not limited to a scoliotic spine. As depicted in FIGS. 24-26, for example, the coronal adjustment assembly 34 includes a lever 280 linked to an arcuate radio-lucent paddle 282. As depicted in FIGS. 24 and 25, for example, a rotatable shaft 284 is linked to the lever 280 via a transmission 286, and the rotatable shaft 284 projects from an end of the chest support plate 100. Rotation of the rotatable shaft 284 is translated by the transmission 286 into rotation of the lever 280, causing the paddle 282, which is linked to the lever 280, to swing in an arc. Furthermore, a servomotor (not shown) interconnected with the rotatable shaft 284 can be computer controlled and/or operated by the operator of the surgical frame 10 to facilitate controlled rotation of the lever 280.

As depicted in FIG. 24, for example, adjustments can be made to the position of the paddle 282 to manipulate the torso and straighten the spine. As depicted in FIG. 25, when the offset main beam 12 is positioned such that the patient P is positioned in a lateral position, the coronal adjustment assembly 34 supports the patient's torso. As further depicted in FIG. 26, when the offset main beam 12 is positioned such that the patient P is positioned in a prone position, the coronal adjustment assembly 34 can move the torso laterally, to correct a deformity, including but not limited to a scoliotic spine. When the patient is strapped in via straps (not shown) at the chest and legs, the torso is relatively free to move and can be manipulated. Initially, the paddle 282 is moved by the lever 280 away from the offset main beam 12. After the paddle 282 has been moved away from the offset main beam 12, the torso can be pulled with a strap towards the offset main beam 12. The coronal adjustment assembly 34 also includes safety stops (not shown) to prevent over-extension or compression of the patient, and sensors (not shown) programmed to send patient position feedback to the safety stops.

A preferred embodiment of a surgical frame incorporating a translating beam is generally indicated by the numeral 300 in FIGS. 27-30. Like the surgical frame 10, the surgical frame 300 serves as an exoskeleton to support the body of the patient P as the patient's body is manipulated thereby. In doing so, the surgical frame 300 serves to support the patient P such that the patient's spine does not experience unnecessary stress/torsion.

The surgical frame 300 includes translating beam 302 that is generally indicated by the numeral 302 in FIGS. 27-30. The translating beam 302 is capable of translating motion affording it to be positioned and repositioned with respect to portions of the remainder of the surgical frame 300. As discussed below, the positioning and repositioning of the translating beam 302, for example, affords greater access to a patient receiving area A defined by the surgical frame 300, and affords greater access to the patient P by a surgeon and/or a surgical assistant (generally indicated by the letter S in FIG. 30) via access to either of the lateral sides $L_1$ and $L_2$ (FIG. 30) of the surgical frame 300.

As discussed below, by affording greater access to the patient receiving area A, the surgical frame 300 affords transfer of the patient P from and to a surgical table/gurney. Using the surgical frame 300, the surgical table/gurney can be conventional, and there is no need to lift the surgical table/gurney over portions of the surgical frame 300 to afford transfer of the patient P thereto.

The surgical frame 300 is configured to provide a relatively minimal amount of structure adjacent the patient's spine to facilitate access thereto and to improve the quality of imaging available before, during, and even after surgery. Thus, the workspace of a surgeon and/or a surgical assistant and imaging access are thereby increased. The workspace, as discussed below, can be further increased by positioning and repositioning the translating beam 302. Furthermore, radio-lucent or low magnetic susceptibility materials can be used in constructing the structural components adjacent the patient's spine in order to further enhance imaging quality.

The surgical frame 300, as depicted in FIGS. 27-30, is similar to the surgical frame 10 except that surgical frame 300 includes a support structure 304 having a support platform 306 incorporating the translating beam 302. The surgical frame 300 incorporates the offset main beam 12 and the features associated therewith from the surgical table 300. As such, the element numbering used to describe the surgical frame 10 is also applicable to portions of the surgical frame 300.

Rather than including the cross member 44, and the horizontal portions 46 and the vertical portions 48 of the first and second support portions 40 and 42, the support structure 304 includes the support platform 306, a first vertical support post 308A, and a second vertical support post 308B. As depicted in FIGS. 27-30, the support platform 306 extends from adjacent one longitudinal end to adjacent the other longitudinal end of the surgical frame 300, and the support platform 306 supports the first vertical support post 308A at the one longitudinal end and supports the second vertical support post 308B at the other longitudinal end.

As depicted in FIGS. 27-30, the support platform 306 (in addition to the translating beam 302) includes a first end member 310, a second end member 312, a first support bracket 314, and a second support bracket 316. Casters 318 are attached to the first and second end members 310 and 312. The first end member 310 and the second end member 312 each include an upper surface 320 and a lower surface 322. The casters 318 can be attached to the lower surface of each of the first and second end members 310 and 312 at each end thereof, and the casters 318 can be spaced apart from one another to afford stable movement of the surgical frame 300. Furthermore, the first support bracket 314 supports the first vertical support post 308A, and the second support bracket 316 supports the vertical second support post 308B.

The translating beam 302 is interconnected with the first and second end members 310 and 312 of the support platform 306, and as depicted in FIGS. 27-30, the translating beam 302 is capable of movement with respect to the first and second end members 310 and 312. The translating beam 302 includes a first end member 330, a second end member 332, a first L-shaped member 334, a second L-shaped member 336, and a cross member 338. The first L-shaped member 334 is attached to the first end member 330 and the cross member 338, and the second L-shaped member 336 is attached to the second end member 332 and the cross member 338. Portions of the first and second L-shaped members 334 and 336 extend downwardly relative to the first and second end members 330 and 332 such that the cross member 338 is positioned vertically below the first and second end member 330 and 332. The vertical position of the cross member 338 relative to the remainder of the surgical frame 300 lowers the center of gravity of the surgical frame 300, and in doing so, serves in adding to the stability of the surgical frame 300.

The translating beam 302, as discussed above, is capable of being positioned and repositioned with respect to portions of the remainder of the surgical frame 300. To that end, the support platform 306 includes a first translation mechanism 340 and a second translation mechanism 342. The first translation mechanism 340 facilitates attachment between the first end members 310 and 330, and the second translation mechanism 342 facilitates attachment between the second end members 312 and 332. The first and second translation mechanism 340 and 342 also facilitate movement of the translating beam 302 relative to the first end member 310 and the second end member 312.

The first and second translation mechanisms 340 and 342 can each include a transmission 350 and a track 352 for facilitating movement of the translating beam 302. The tracks 352 are provided on the upper surface 320 of the first and second end members 310 and 312, and the transmissions 350 are interoperable with the tracks 352. The first and second transmission mechanisms 340 and 342 can each include an electrical motor 354 or a hand crank (not shown) for driving the transmissions 350. Furthermore, the transmissions 350 can include, for example, gears or wheels driven thereby for contacting the tracks 352. The interoperability of the transmissions 350, the tracks 352, and the motors 354 or hand cranks form a drive train for moving the translating beam 302. The movement afforded by the first and second translation mechanism 340 and 342 allows the translating beam 302 to be positioned and repositioned relative to the remainder of the surgical frame 300.

The surgical frame 300 can be configured such that operation of the first and second translation mechanism 340 and 342 can be controlled by an operator such as a surgeon and/or a surgical assistant. As such, movement of the translating beam 302 can be effectuated by controlled automation. Furthermore, the surgical frame 300 can be configured such that movement of the translating beam 302 automatically coincides with the rotation of the offset main beam 12. By tying the position of the translating beam 302 to the rotational position of the offset main beam 12, the center of gravity of the surgical frame 300 can be maintained in positions advantageous to the stability thereof.

During use of the surgical frame 300, access to the patient receiving area A and the patient P can be increased or decreased by moving the translating beam 302 between the lateral sides $L_1$ and $L_2$ of the surgical frame 300. Affording greater access to the patient receiving area A facilitates transfer of the patient P between the surgical table/gurney and the surgical frame 300. Furthermore, affording greater access to the patient P facilitates ease of access by a surgeon and/or a surgical assistant to the surgical site on the patient P.

Figure 28:
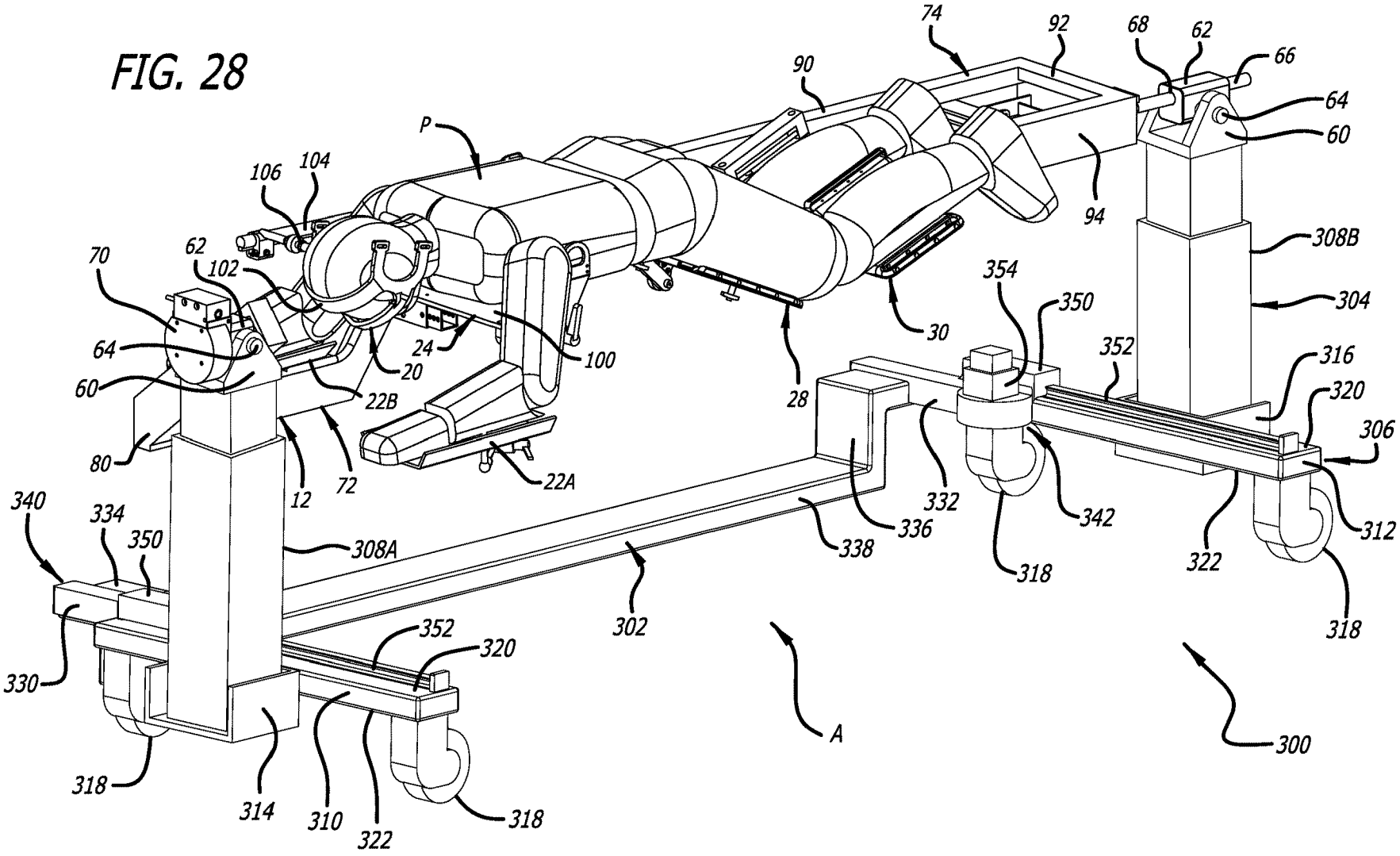
FIG. 28 is another top perspective view that illustrates the surgical frame of FIG. 27 with the patient in a prone position showing the translating beam thereof in a second position.
Figure 29:
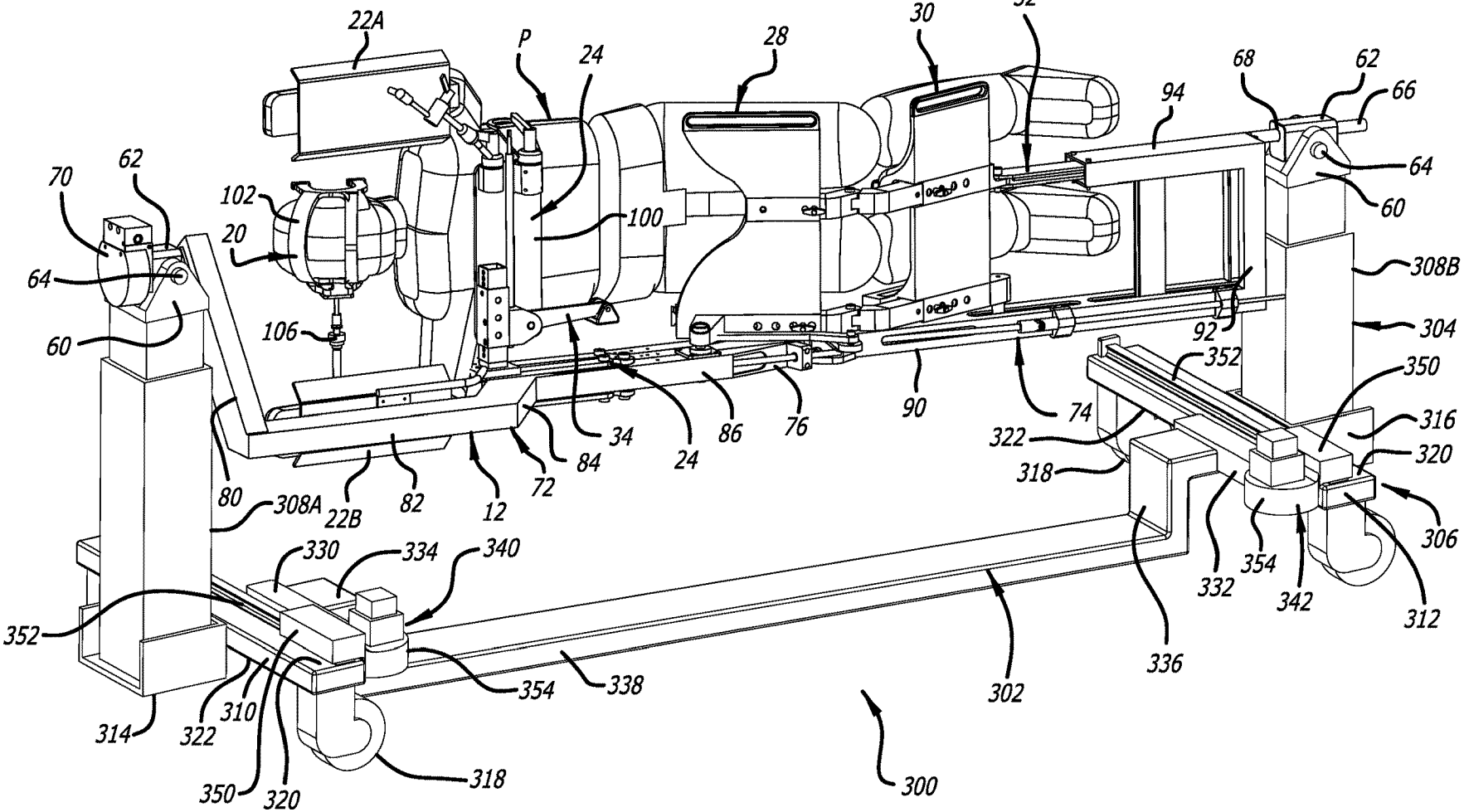
FIG. 29 is yet another top perspective view that illustrates the surgical frame of FIG. 27 with the patient in a lateral position showing the translating beam thereof in a third position.
Figure 30:
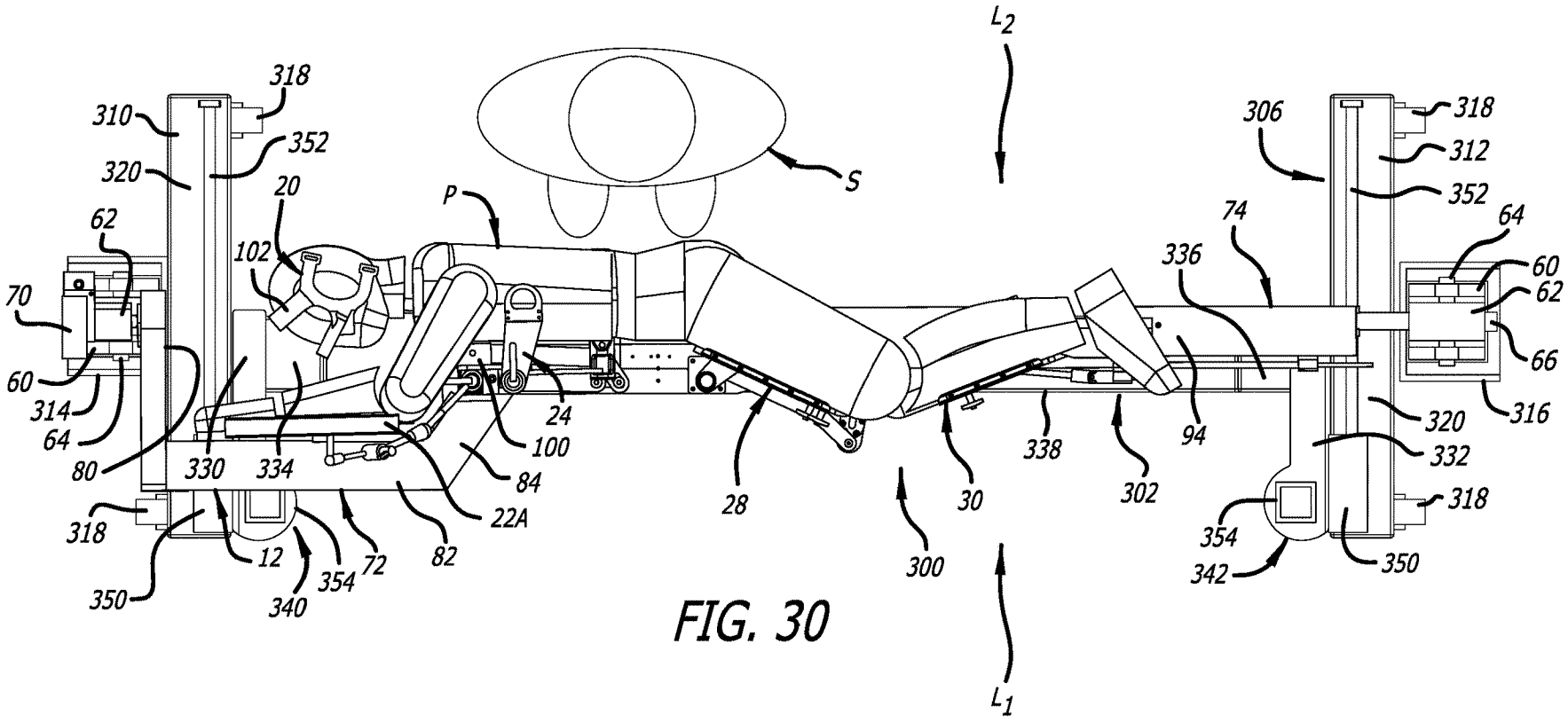
FIG. 30 is top plan view that illustrates the surgical frame of FIG. 27 with the patient in a lateral position showing the translating beam thereof in the third position.

The translating beam 302 is moveable using the first and second translation mechanisms 340 and 342 between a first terminal position (FIG. 28) and a second terminal position (FIGS. 29 and 30). The translating beam 302 is positionable at various positions (FIG. 27) between the first and second terminal positions. When the translating beam 302 is in the first terminal position, as depicted in FIG. 28, the translating beam 302 and its cross member 338 are positioned on the lateral side $L_1$ of the surgical frame 300. Furthermore, when the translating beam 302 is in the second terminal position, as depicted in FIGS. 29 and 30, the translating beam 302 and its cross member 338 are positioned in the middle of the surgical frame 300.

With the translating beam 302 and its cross member 338 moved to be positioned at the lateral side $L_1$, the surgical table/gurney and the patient P positioned thereon can be positioned under the offset main beam 12 in the patient receiving area A to facilitate transfer of the patient P to or from the offset main beam 12. As such, the position of the translating beam 302 at the lateral side $L_1$ enlarges the patient receiving area A so that the surgical table/gurney can be received therein to allow such transfer to or from the offset main beam 12.

Furthermore, with the translating beam 302 and its cross member 338 moved to be in the middle of the surgical frame 300 (FIGS. 29 and 30), a surgeon and/or a surgical assistant can have access to the patient P from either of the lateral sides $L_1$ or $L_2$. As such, the position of the translating beam 302 in the middle of the surgical frame 300 allows a surgeon and/or a surgical assistant to get close to the patient P supported by the surgical frame 300. As depicted in FIG. 30, for example, a surgeon and/or a surgical assistant can get close to the patient P from the lateral side $L_2$ without interference from the translating beam 302 and its cross member 338. The position of the translating beam 302 can be selected to accommodate access by both a surgeon and/or a surgical assistant by avoiding contact thereof with the feet and legs of a surgeon and/or a surgical assistant.

The position of the translating beam 302 and its cross member 338 can also be changed according to the rotational position of the offset main beam 12. To illustrate, the offset main beam 12 can be rotated a full 360° before, during, and even after surgery to facilitate various positions of the patient to afford various surgical pathways to the patient's spine depending on the surgery to be performed. For example, the offset main beam 12 can be positioned by the surgical frame 300 to place the patient P in a prone position (e.g., FIGS. 27 and 28), lateral positions (e.g., FIGS. 29 and 30), and in a position 45° between the prone and lateral positions. The translating beam 302 can be positioned to accommodate the rotational position of the offset main beam 12 to aid in the stability of the surgical frame 300. For example, when the patient P is in the prone position, the translating beam 302 can preferably be moved to the center of the surgical frame 300 underneath the patient P. Furthermore, when the patient P is in one of the lateral positions, the translating beam 302 can be moved toward one of the corresponding lateral sides $L_1$ and $L_2$ of the surgical frame 300 to position underneath the patient P. Such positioning of the translating beam 302 can serve to increase the stability of the surgical frame 300.

Surgical frames 400, 550, 700, and 900 incorporating adjustable pelvic supports 402, 552, 702, and 902, respectively, in accordance with embodiments of the present disclosure are described hereinbelow. The surgical frames 400, 550, 700, and 900 can incorporate the features of the above-discussed surgical frames, and the pelvic supports 402, 552, 702, and 902 can also be incorporated in the above-discussed surgical frames. Furthermore, features and componentry of the various ones of the pelvic supports 402, 552, 702, and 902 can be used with others of the pelvic supports 402, 552, 702, and 902. As discussed below, the articulation of the pelvic supports 402, 552, 702, and 902 can be done via manual adjustment or via controlled automation of the componentry thereof.

A preferred embodiment of the surgical frame incorporating a reconfigurable pelvic support is generally indicated by the numeral 400 in FIGS. 31-37. Like the surgical frames 10 and 300, the surgical frame 400 can serve as an exoskeleton to support the body of the patient P as the patient's body is manipulated thereby. In doing so, the surgical frame 400 serves to support the patient P such that the patient's spine does not experience unnecessary stress/torsion. As discussed below, the surgical frame 400 includes a first embodiment of an adjustable pelvic support generally indicated by the numeral 402 in FIGS. 31-37.

Like the surgical frame 300, the surgical frame 400 includes a translating beam 302 and a support structure 304 having a support platform 306 incorporating the translating beam 302. Besides the support platform 306, the support structure 304, as depicted in FIGS. 31 and 34-37, includes a first vertical support post 308A and a second vertical support post 308B. The first vertical support post 308A and the second vertical support post 308B are capable of expansion and contraction. The surgical frame 400 also incorporates a main beam 410 similar to the offset main beam 12, and, as discussed below, the main beam 410 can incorporate features associated with the offset main beam 12. To illustrate, the offset main beam 410, like the main beam 12, is used in supporting the patient P on the surgical frame 400 and includes various components similar to those incorporated in the surgical frames 10 and 300. For example, the main beam 410 can incorporate a head support (not shown), a chest support 412, arm supports 413, an upper leg support 414, and a lower leg support 416.

An operator such as a surgeon can control actuation of the various support components to manipulate the position of the patient's body. Soft straps (not shown) are used with these various support components to secure the patient P to the frame and to enable either manipulation or fixation of the patient P. Furthermore, reusable soft pads can be used on the load-bearing areas of the various support components. Additionally, the main beam 410 can be rotated a full 360° before, during, and even after surgery to facilitate various positions of the patient P to afford various surgical pathways to the patient's spine depending on the surgery to be performed. For example, the main beam 410 can be positioned by the surgical frame 400 to place the patient P in a prone position, lateral positions, and in a position 45° between the prone and lateral positions.

The surgical frame 400 can be used to facilitate access to different parts of the spine of the patient P. In particular, the surgical frame 400 can be used to facilitate access to portions of the patient's lumbar spine. To illustrate, the patient P is simultaneously supported by the chest support 412 and the upper leg support 414 on the main beam 410, and uninterrupted access is provided to portions of the patient's lumbar spine by the positions of the chest support 412 and the upper leg support 414. However, while uninterrupted access to the patient's lumbar spine is desirable during surgery, it may be necessary to support the pelvic area of patient P before, during, and after surgery. To that end, the pelvic support 402 is provided. The pelvic support 402 can be positioned and repositioned before, during, and after surgery between at least a retracted first position where the pelvic support 402 is withdrawn from the pelvic area, and an extended second position where the pelvic area is supported thereby. The pelvic support 402 can be used to support the patient P during rotation of the main beam 410 (e.g., FIGS. 34-37), and articulation of the other componentry of the surgical frame 400.

The main beam 410 is moveably attached relative to the first vertical support post 308A and the second vertical support post 308B. Like those of the surgical frames 10 and 300, the first vertical support post 308A and the second vertical support post 308B of the surgical frame 400 each include a clevis 420 supporting componentry facilitating rotation of the main beam 410.

In addition to the clevis 420, the first vertical support post 308A includes a support block portion 422, a pin portion 424 pivotally attaching the support block portion 422 to the clevis 420, and an axle portion 426 rotatably supported by the support block 422 and interconnected to the main beam 410. The support block portion 422, via interaction of the pin portion 424 with the clevis 420, is capable of pivotal movement relative to the clevis 420 to accommodate different heights for the first vertical support post 308A and the second vertical support post 308B. And the main beam 410, via interaction of the axle portion 426 with the support block portion 422, is capable of rotational movement relative to the support block portion 422 to accommodate rotation of the patient P supported by the main beam 410.

Furthermore, in addition to the clevis 420, the second vertical support post 308B includes a coupler 430 and a pin portion 432 pivotally attaching the coupler 430 to the clevis 420. The coupler 430 includes a base portion 434 that is pinned to the clevis 420 with the pin portion 432, a body portion 436 that includes a transmission (not shown), a motor 438 that drives the transmission in the body portion 436, and a head portion 440 that is rotatable with respect to the body portion 436 and driven rotationally by the transmission via the motor 438. The head portion 440 is interconnected with the main beam 410, and the head portion 440 (via the transmission and the motor 438) can rotate the main beam 410 a full 360° before, during, and even after surgery to facilitate various positions of the patient P.

The pelvic support 402, for example, can be attached relative to the first vertical support post 308A, the second vertical support post 308B, and/or the main beam 410. As depicted in FIGS. 31 and 34-37, the pelvic support 402 is attached relative to the second vertical support post 308B and the main beam 410. More specifically, a portion of the pelvic support 402 is attached between a portion of the second vertical support post 308B and the main beam 410. Furthermore, portions of the pelvic support 402 can be fixed or moveable with respect to the second vertical support post 308B and/or the main beam 410. A portion of the pelvic support 402 is moveably attached between the main beam 410 and the coupler 430, and, as such, the pelvic support 402 is moveable with coupler 430 and the main beam 410 relative to the second vertical support post 308B, and moveable with respect to the coupler 430 and/or the main beam 410.

The pelvic support 402 can include a base portion 442, a leg portion 444, and a moveable support 446. The pelvic support 402 can also include a first arm portion 450, a second arm portion 452, a pad support portion 454, and a pad portion 456 attached relative to the leg portion 444 and the moveable support 446. As discussed below, the pelvic support 402 is articulable in order to facilitate contact of the pad portion 456 with the patient P. Such contact allows the pelvic support 402 to support the pelvic area of the patient P before, during, and after surgery.

The base portion 442 includes a first portion 460 and a second portion 462 attached to one another. As discussed below, the first portion 460 is attached to the leg portion 444, and the second portion 462 is attached to the first arm portion 450.

Figure 31:
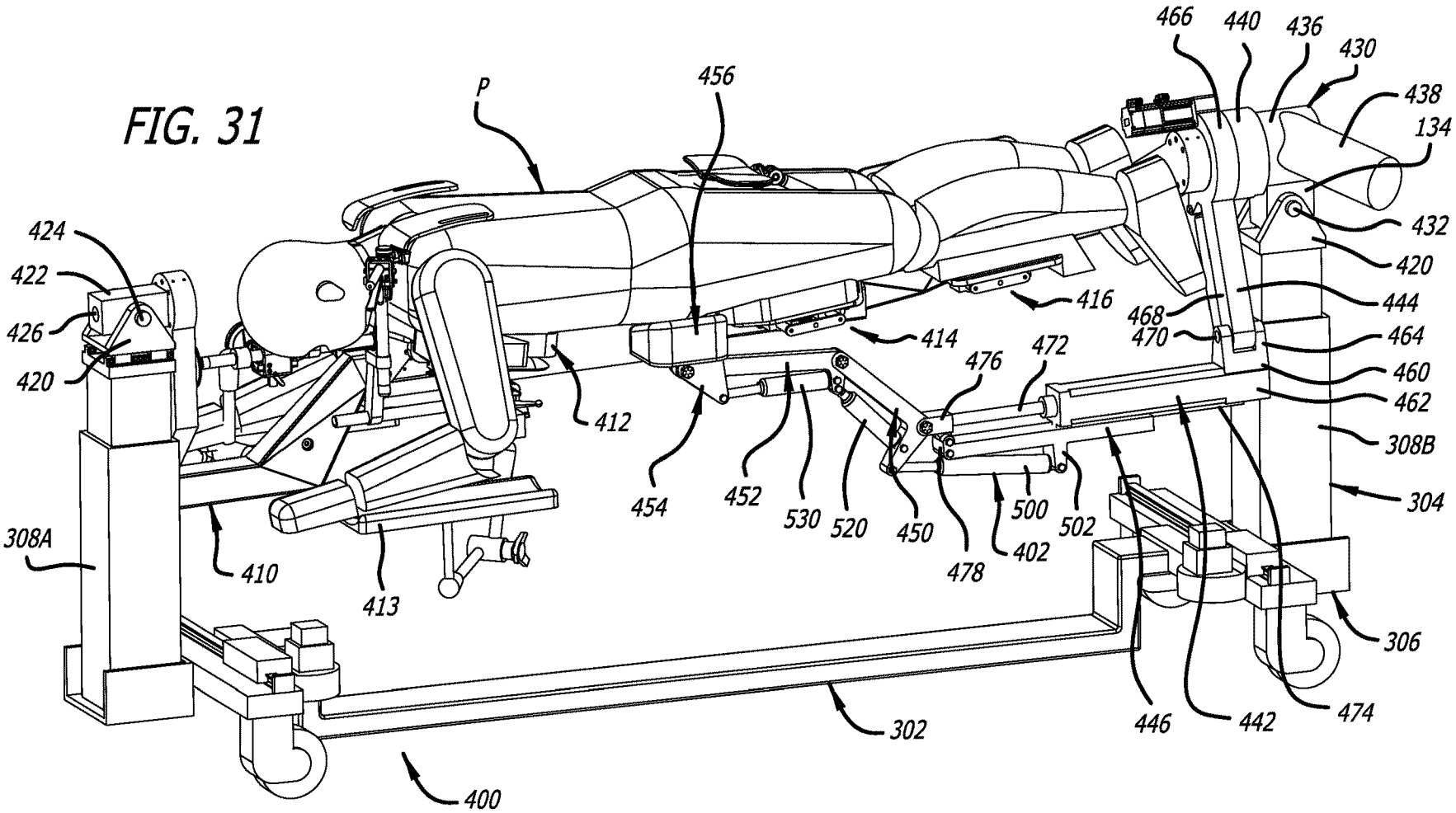
FIG. 31 is a side, perspective view that illustrates a surgical frame with a patient positioned thereon in a prone position incorporating a pelvic support of a first embodiment of the present disclosure.
Figure 36:
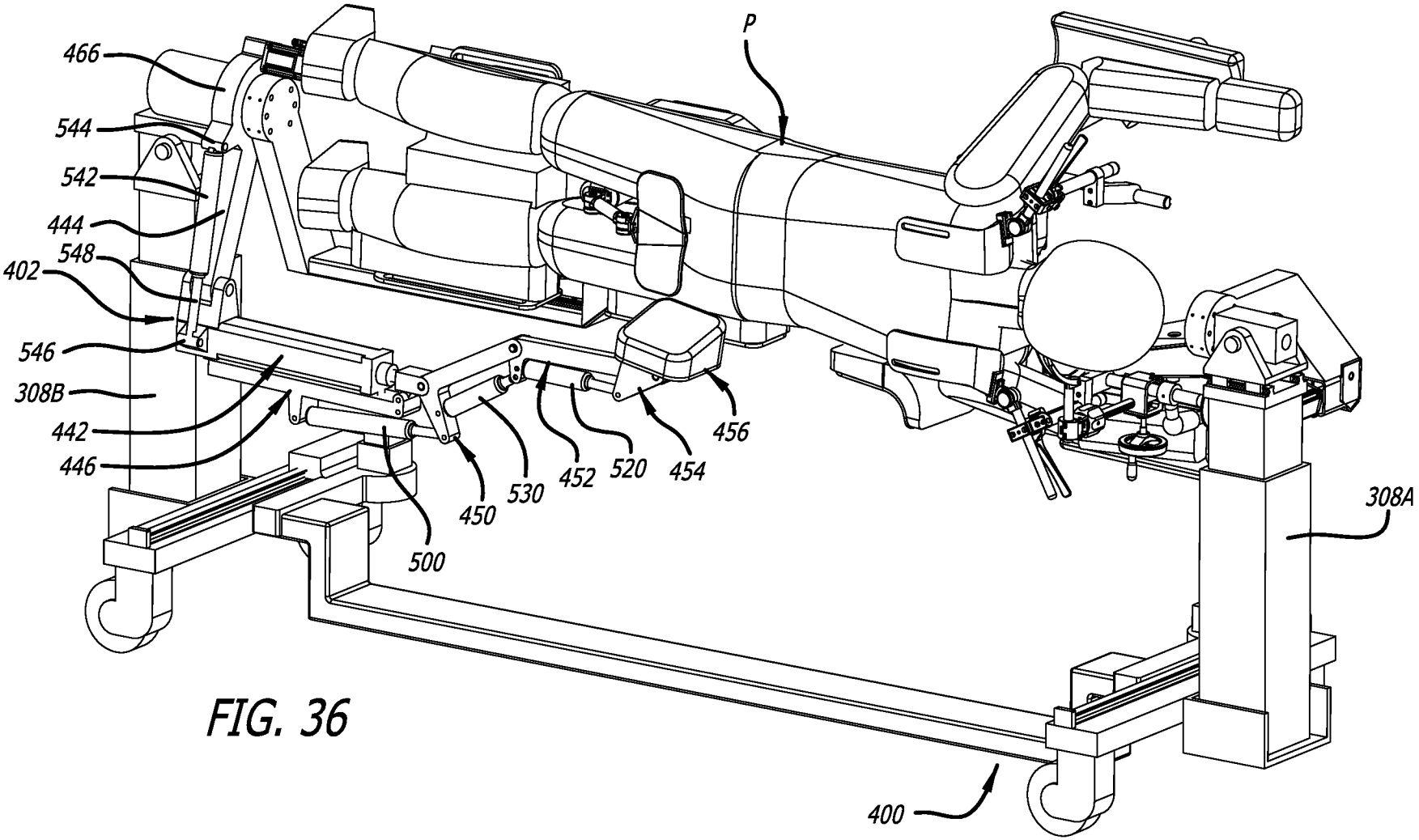
FIG. 36 is a top, side, perspective view that illustrates the surgical frame of FIG. 31 with the patient in a lateral position, and the pelvic support being moved to contact the patient.
Figure 37:
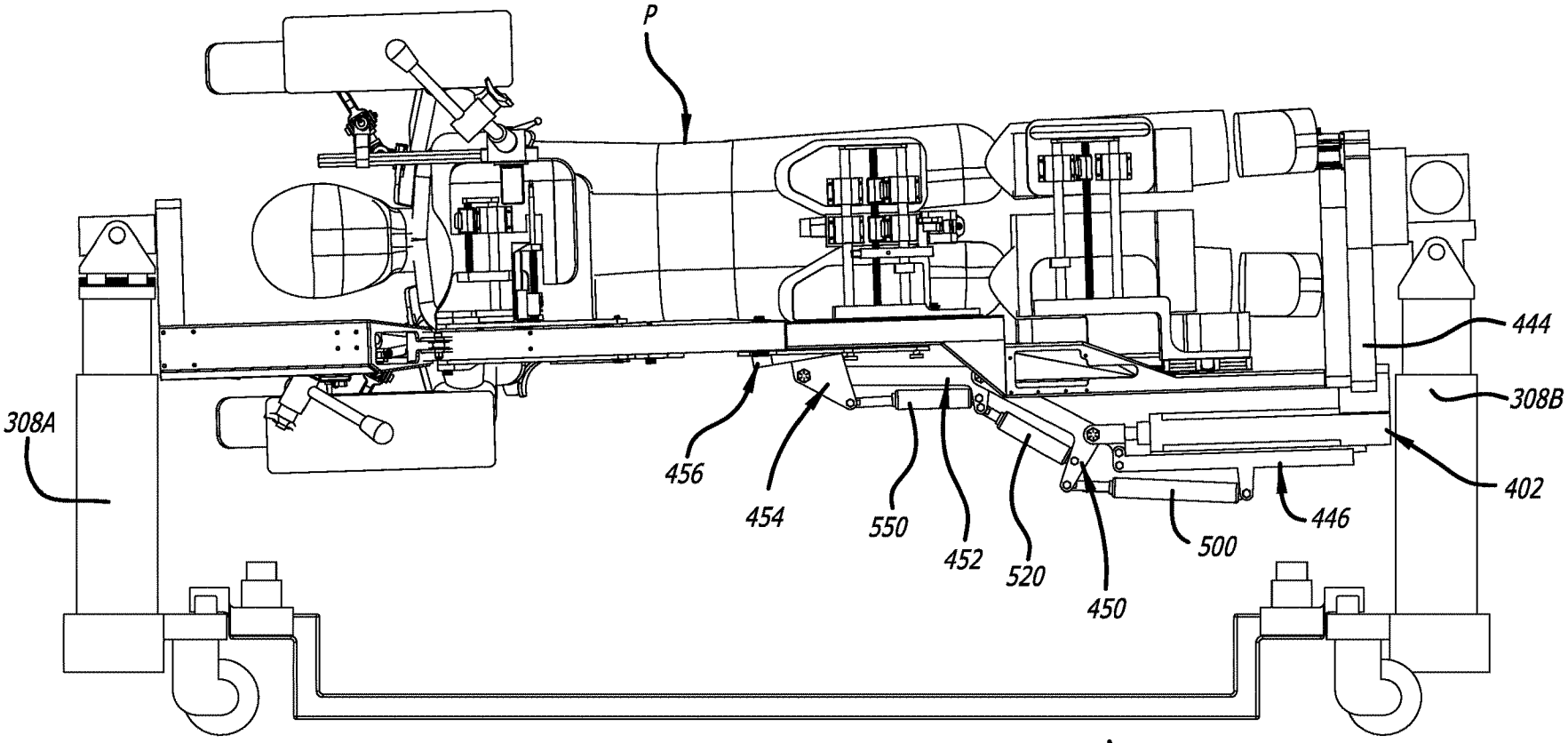
FIG. 37 is a side, elevational view that illustrates the surgical frame of FIG. 31 with the patient in a lateral position and supported in part by the pelvic support.

As depicted in FIG. 31, the first portion 460 of the base portion 442 includes a clevis portion 464, and the leg portion 444 includes a first end portion 466 and a second end portion 468. The first end portion 466 of the leg portion 444 can be moveably attached between the main beam 410 and the coupler 430, and the second end portion 468 of the leg portion 444 is pivotally attached to the clevis portion 464 using a pin 470. An actuator 542 can be provided to facilitate controlled pivotal movement of the base portion 442 relative to the leg portion 444. As depicted in FIG. 36, the actuator 542 is pivotally attached at one end to an attachment portion 544 extending outwardly from the first end portion 466, and pivotally attached at the other end to an attachment portion 546 extending outwardly from the base portion 442. A fastener or fasteners can be used to facilitate such pivotal attachment. The actuator 542 includes an actuatable telescoping shaft portion 548 moveable inwardly and outwardly with respect to portions of the actuator 542, and actuation of the telescoping shaft portion 548 serves to pivot the base portion 442 relative to the leg portion 444. As such, the leg portion 444 can move with or relative to the main beam 410, and the base portion 442 can pivot with respect to the leg portion 444. Such movement can facilitate placement of the pad portion 456 adjacent the pelvic area of the patient P.

Figure 32:
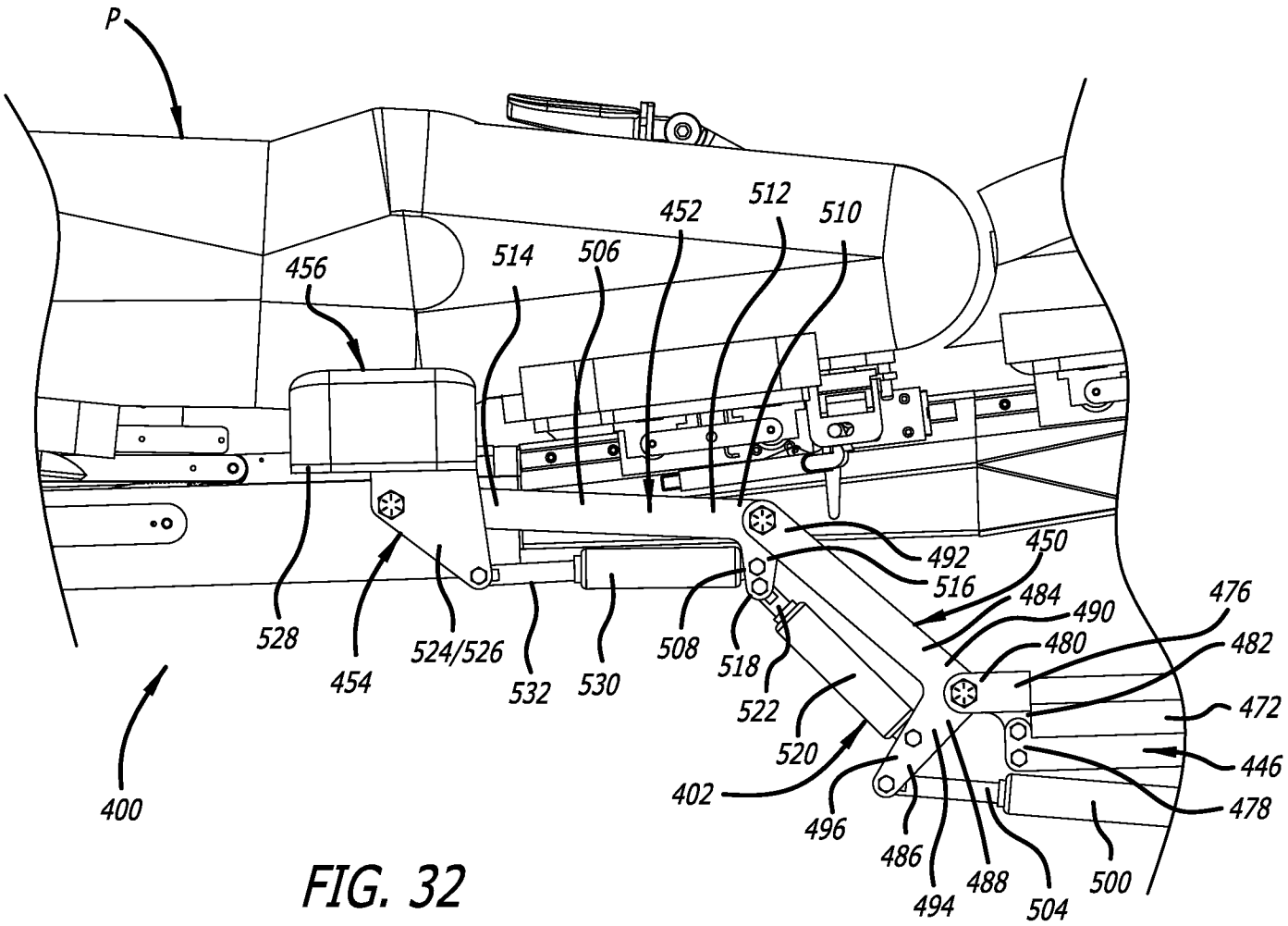
FIG. 32 is a side, elevational view that illustrates a portion of the pelvic support of FIG. 31 in a first position.
Figure 33:
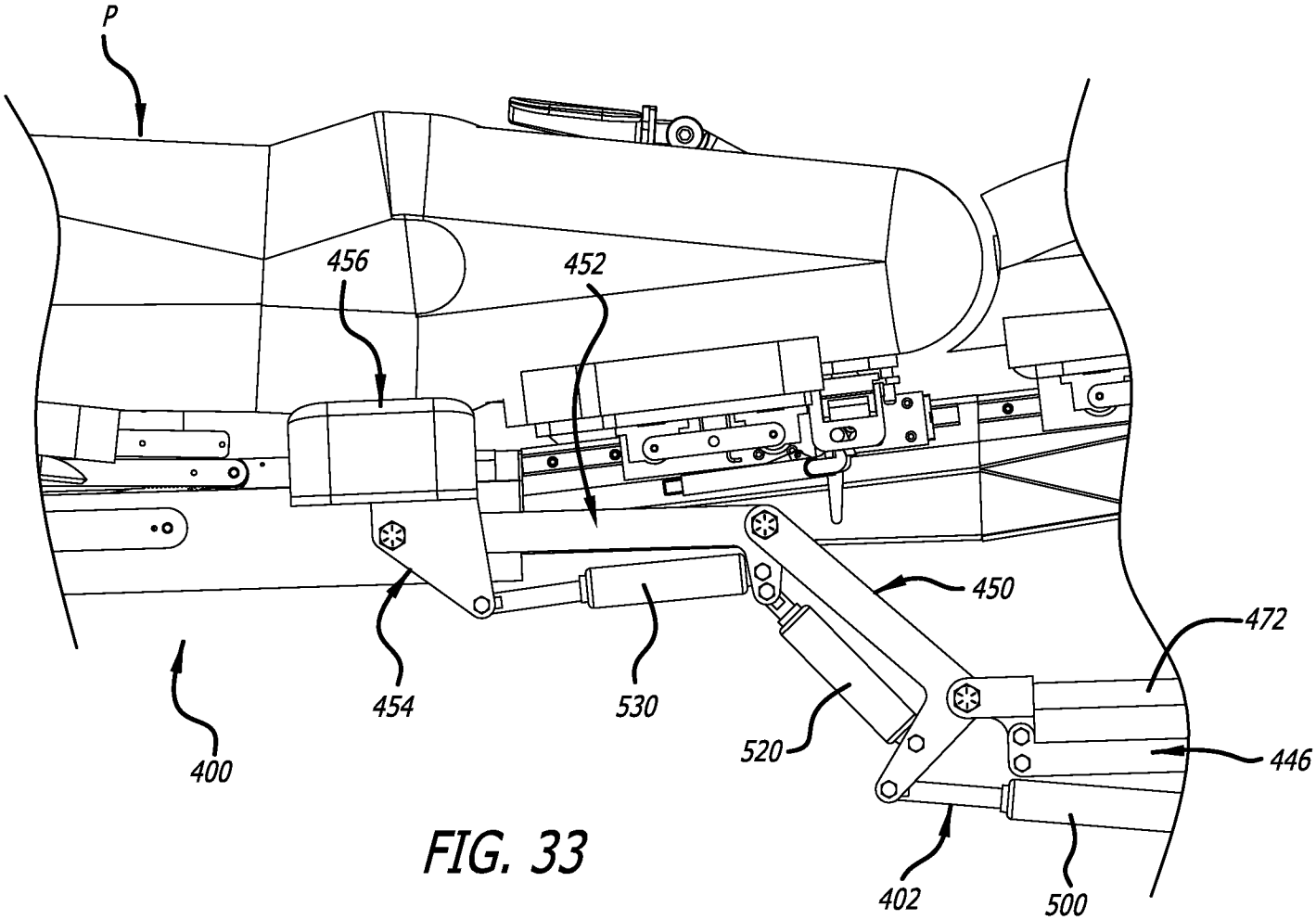
FIG. 33 is a side, elevational view that illustrates a portion of the pelvic support of FIG. 31 is a second position.
Figure 34:
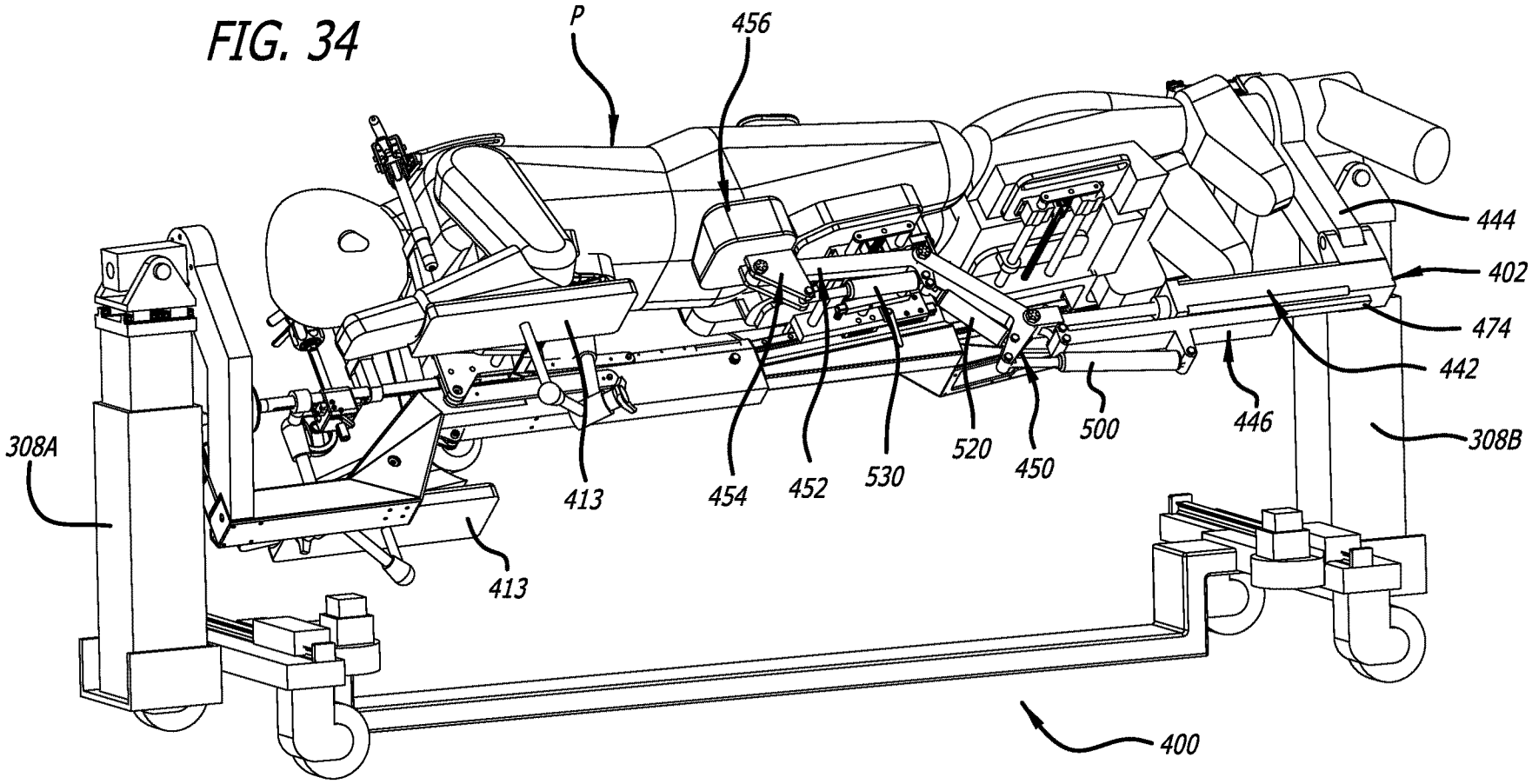
FIG. 34 is a side, perspective view that illustrates the surgical frame of FIG. 31 with the patient in a first rotational position and supported in part by the pelvic support.
Figure 35:
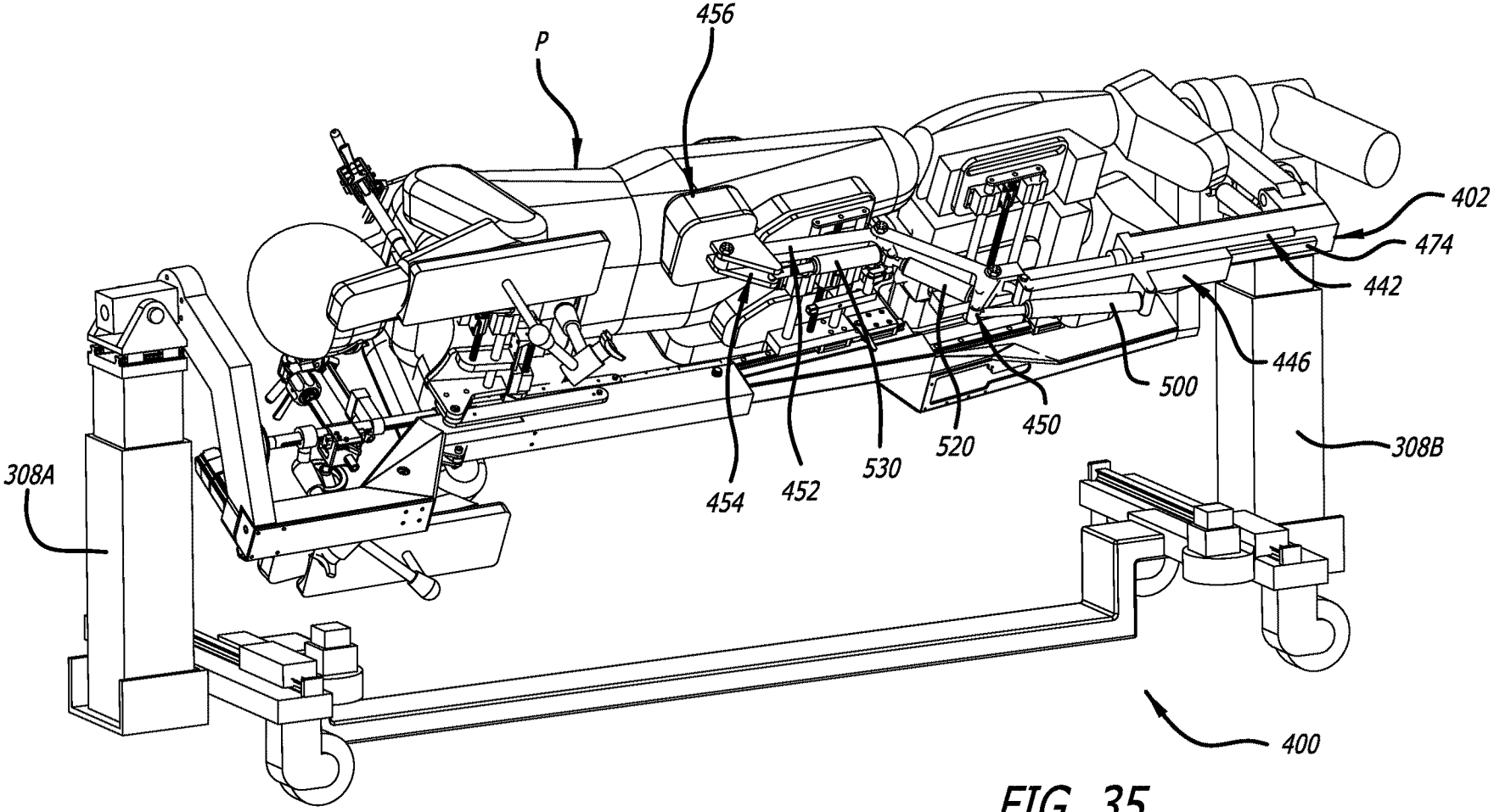
FIG. 35 is a side, perspective view that illustrates the surgical frame of FIG. 31 with the patient in a second rotational position and supported in part by the pelvic support.

Additionally, as depicted in FIGS. 31-33, the second portion 462 of the base portion 442 includes an actuatable telescoping shaft portion 472 telescopically moveable inwardly and outwardly relative to portions of the base portion 442, portions of the base portion 442 serve as an actuator for actuating the telescoping shaft portion 472, the moveable support 446 is supported by and moveable relative to the second portion 462, the moveable support 446 is interconnected with the telescoping shaft portion 472, and the movement of the telescoping shaft portion 472 inwardly and outwardly relative to portions of the base portion 442 facilitates movement of the moveable support 446.

The moveable support 446 is moveable relative to the second portion 462 via use of tracking 474 moveably attaching the moveable support 446 to the second portion 462. Furthermore, the telescoping shaft portion 472 includes an end portion 476, the moveable support 446 includes an end portion 478, and the end portions 476 and 478 are attached to one another. The end portion 476 can be formed as an "L-shaped" bracket including a first portion 480 and a second portion 482. As depicted in FIG. 32, the first portion 480 can be attached to the remainder of the telescoping shaft portion 472, and the second portion 482 can extend downwardly from the first portion 480. Also, as depicted in FIGS. 31 and 32, the end portion 478 can extend upwardly from the remainder of the moveable support 446. The end portion 478 and the second portion 482 of the end portion 476 can be attached to one another, and such attachment can be facilitated using, for example, a fastener or fasteners such as, for example, a bolt and a nut. Thus, because the telescoping shaft portion 472 is telescopically moveable inwardly and outwardly with respect to portions of the base portion 442, and the end portions 476 and 478 are attached to one another, actuation of the telescoping shaft portion 472 also moves the moveable support 446 along the second portion 462 of the base portion 442 using the tracking 474. As such, the first arm portion 450, the second arm portion 452, the pad support portion 454, and the pad portion 456 are moveable inwardly and outwardly with respect to the base portion 442. Such movement can facilitate placement of the pad portion 456 adjacent the pelvic area of the patient P.

The first arm portion 450, as depicted in FIG. 32, is "L-shaped" and includes a first portion 484, a second portion 486, and a connecting portion 488 attaching the first portion 484 and the second portion 486 to one another. The first portion 484 includes a first end 490 and a second end 492, and the second portion 486 includes a first end 494 and a second end 496. The first ends 490 and 494 are attached to the connecting portion 488, and the connecting portion 488 is pivotally attached to the first portion 480 of the end portion 476 of the telescoping shaft portion 472. To facilitate attachment of the connecting portion 488 to the first portion 480, the connecting portion 488 can serve as a tang, the first portion 480 can be partially shaped as a clevis for receiving the connecting portion 488, and a fastener or fasteners can be used to facilitate such pivotal attachment.

To provide for controlled pivotal movement of the first arm portion 450 relative to the base portion 442, a first actuator 500 is provided that is pivotally attached at one end to the second portion 486 at the second end 496 thereof, and pivotally attached at the other end to an attachment portion 502 extending outwardly from the moveable support 446. A fastener or fasteners can be used to facilitate such pivotal attachment. The first actuator 500 includes an actuatable telescoping shaft portion 504 moveable inwardly and outwardly with respect to portions of the first actuator 500, and actuation of the telescoping shaft portion 504 serves to pivot the first arm portion 450 relative to the base portion 442. Such movement can facilitate placement of the pad portion 456 adjacent the pelvic area of the patient P.

The second arm portion 452, as depicted in FIG. 32, is "L-shaped" and includes a first portion 506 and a second portion 508, and a connecting portion 510 attaching the first portion 506 and the second portion 508 to one another. The first portion 506 includes a first end 512 and a second end 514, and the second portion 508 includes a first end 516 and a second end 518. The first ends 512 and 516 are attached to the connecting portion 510, and the connecting portion 510 is pivotally attached to the first portion 484 of the first arm portion 450. To facilitate attachment of the connecting portion 510 to the first portion 484, the connecting portion 510 can serve as a tang, the first portion 484 at and adjacent the second end 492 can be shaped as a clevis for receiving the connecting portion 510, and a fastener or fasteners can be used to facilitate such pivotal attachment.

To provide for controlled pivotal movement of the second arm portion 452 relative to the first arm portion 450, a second actuator 520 is provided that is pivotally attached at one end to the second portion 508 at the second end 518 thereof, and pivotally attached at the other end to the second portion 486. A fastener or fasteners can be used to facilitate such pivotal attachment. The second actuator 520 includes an actuatable telescoping shaft portion 522 moveable inwardly and outwardly with respect to portions of the second actuator 520, and actuation of the telescoping shaft portion 522 serves to pivot the second arm portion 452 relative to the first arm portion 450. Such movement can facilitate placement of the pad portion 456 adjacent the pelvic area of the patient P.

The pad support portion 454, as depicted in FIGS. 31-37, supports the pad portion 456, and is pivotally attached to the second arm portion 452. The pad support portion 454 includes a first bracket 524, a second bracket 526, and a base plate 528. The pad portion 456 is attached to the base plate 528, the first bracket 524 and the second bracket 526 extend downwardly from the base plate 528, and the second arm portion 452 is pivotally attached to the first bracket 524 and the second bracket 526. To facilitate attachment of the pad support portion 454 to the second arm portion 452, the first portion 506 of the second arm portion 452 at and adjacent the second end 518 thereof can serve as a tang, and the first bracket 524 and the second bracket 526 can serve as a clevis for receiving the first portion 506, and a fastener or fasteners can be used to facilitate such pivotal attachment.

To provide for controlled pivotal movement of the plate support portion 454 relative to the second arm portion 452, a third actuator 530 is provided that is pivotally attached at one end to the second portion 508, and pivotally attached at the other end to the first bracket 524 and the second bracket 526. A fastener or fasteners can be used to facilitate such pivotal attachment. The third actuator 530 includes an actuatable telescoping shaft portion 532 moveable inwardly and outwardly with respect to portions of the third actuator 530, and actuation of the telescoping shaft portion 532 serves to pivot the pad support portion 454 relative to the second arm portion 452. Such movement can facilitate placement of the pad portion 456 adjacent the pelvic area of the patient P.

Additionally, the pad portion 456 could be rotatably attached to the pad support portion 454, or the base plate 528 (supporting the pad portion 456) could be rotatably attached to the remainder of the pad support portion 454. Either way, the pad portion 456 can be rotated relative to the remainder of the pelvic support 402. Such movement can facilitate placement of the pad portion 456 adjacent the pelvic area of the patient P.

The pad portion 456 can include a contact surface 540 with various contours for engaging the torso of the patient P. The articulation of the various components of the pelvic support 402 (e.g., FIGS. 32 and 33) affords placement of the contact surface 540 of the pad portion 456 relative to the patient P. As discussed above, actuation of the telescoping shaft portion 472 to move the moveable support 446 along the second portion 462 of the base portion 442 using the tracking 474, actuation of the telescoping shaft portion 504 to pivot the first arm portion 450 relative to the base portion 442, actuation of the telescoping shaft portion 522 to pivot the second arm portion 452 relative to the first arm portion 450, actuation of the telescoping shaft portion 532 to pivot the pad support portion 454 relative to the second arm portion 452, and/or rotation of the pad portion 456 can serve in placing the pad portion 456 relative to the patient P. As such, using the articulation of the componentry of the pelvic support 402, the pad portion 456 can be positioned into contact with the pelvic area of the patient P, and such contact allows the pelvic support 402 to support the patient P before, during, and after surgery. The articulation of the pelvic support 402 can be done via manual adjustment or via controlled automation of the componentry thereof. Portions of the base portion 442, the first actuator 500, the second actuator 520, and/or the third actuator 530 can be automated, for example, using servomotors and piston actuators via pneumatics and/or hydraulics to facilitate the above-discussed movement of the pelvic support.

As discussed below, a surgical frame 550 includes a second embodiment of an adjustable pelvic support generally indicated by the numeral 552 in FIGS. 38-40. Aside from the main beam 410 and the componentry attached thereto, and the second vertical support 308B, the remainder of the surgical frame 550 is not depicted in FIGS. 38-40. Nevertheless, but for the configuration of the pelvic support 552 (instead of pelvic support 402) and the componentry thereof, the surgical frame 550 can be substantially identical to the surgical frame 400. To illustrate, the surgical frame 900 can include the first vertical support 308A in addition to the second vertical support 308B.

Figure 40:
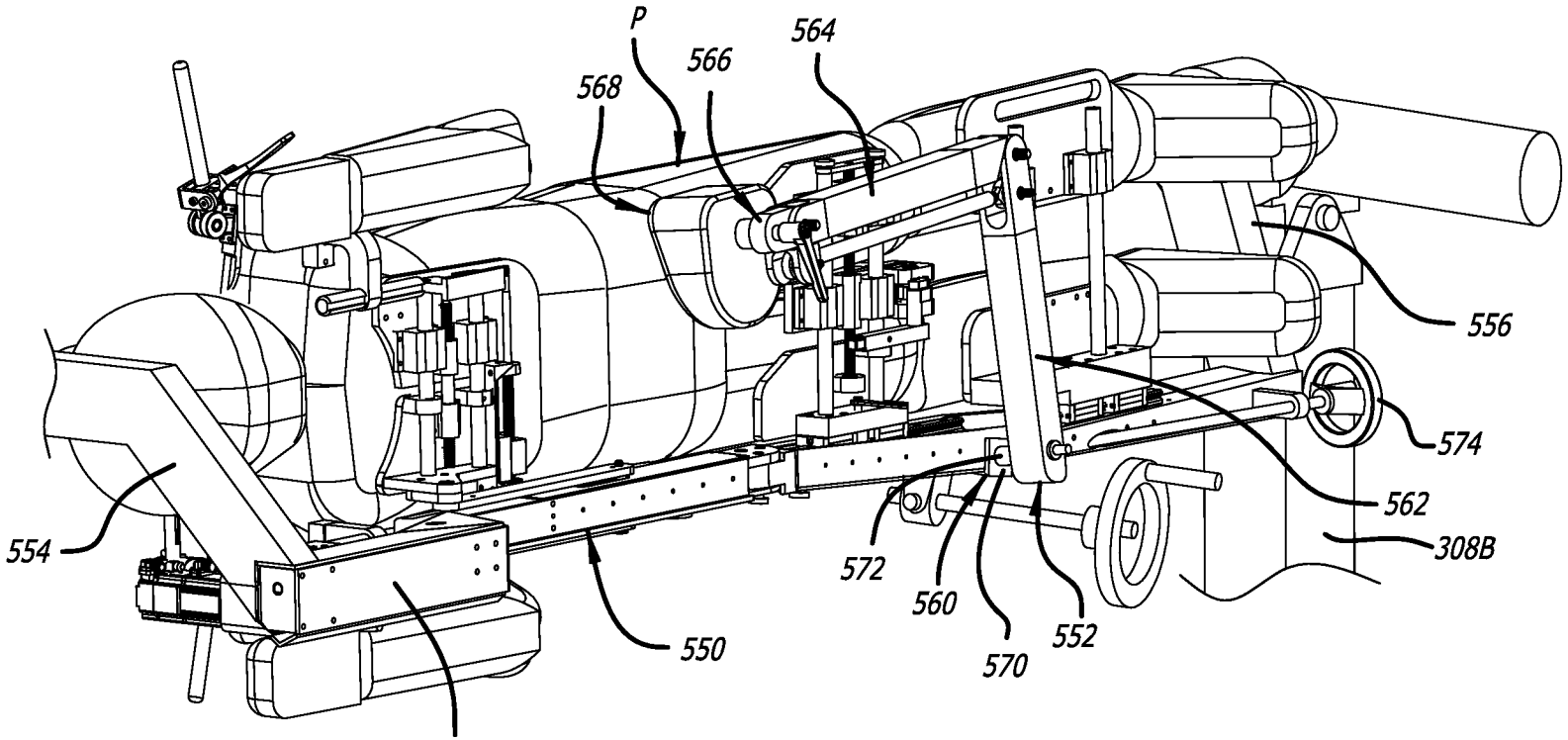
FIG. 40 is a partial, side, perspective view that illustrates the surgical frame of the FIG. 38 with the patient in the lateral position, and the pelvic support in the first position and tilted toward the patient.
Figure 41:
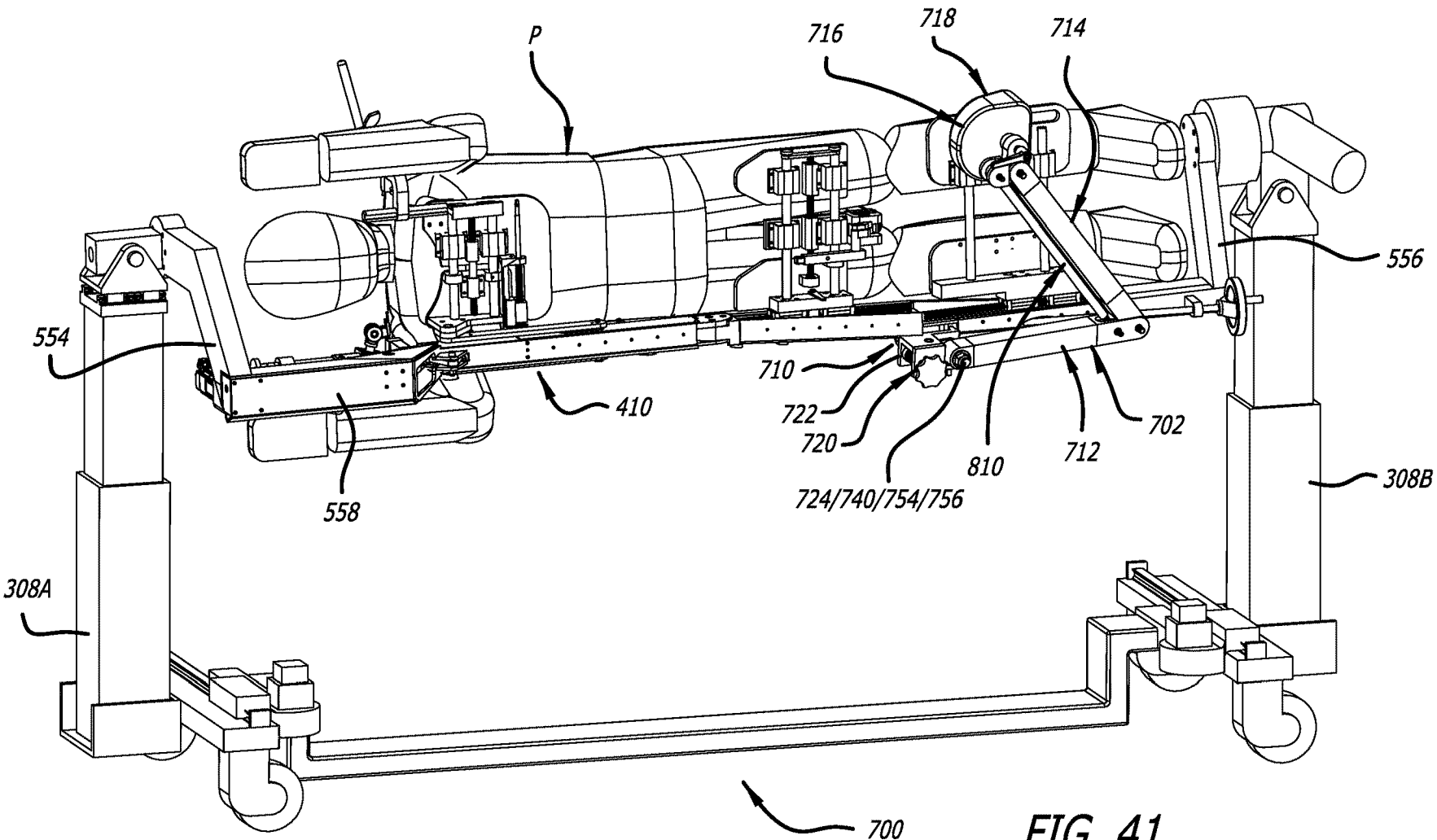
FIG. 41 is a side, perspective view that illustrates a surgical frame with a patient positioned thereon in a lateral position incorporating a pelvic support of a third embodiment of the present disclosure with pelvic support in a first position and tilted away from the patient.

The pelvic support 552 can be positioned and repositioned before, during, and after surgery between at least a retracted first position (not shown) where the pelvic support 552 is withdrawn from the pelvic area of the patient P, and an extended second position where the pelvic area is supported thereby (e.g., FIG. 40). Like the surgical frames 10, 300, and 400, the surgical frame 550 can serve as an exoskeleton to support the body of the patient P as the patient's body is manipulated thereby. In doing so, the surgical frame 550 serves to support the patient P such that the patient's spine does not experience unnecessary stress/torsion. But for the configuration of the pelvic support 552 (instead of pelvic support 402) and componentry thereof, the surgical frame 550 is substantially identical to the surgical frame 400, and the corresponding description of the surgical frame 400 is applicable to the surgical frame 550.

The pelvic support 552, for example, can be attached relative to various portions of the main beam 410. As depicted in FIGS. 38 and 40, the main beam 410 includes at least a first portion 554, a second portion 556, and a third portion 558 that is elongated and extends between the first portion 554 and the second portion 556. The first portion 554 is moveably attached relative to the first vertical support 308A, the second portion 556 is moveably attached relative to the second vertical support 308B. More specifically, as depicted in FIGS. 38-40, portions of the pelvic support 552 are attached to and/or relative to the third portion 558 of the main beam 410. As such, the pelvic support 552 is moveable with the main beam 410 relative to the first vertical support portion 308A and the second vertical support post 308B. The pelvic support 552 can be used to support the patient P during rotation of the main beam 410 and articulation of the other componentry of the surgical frame 550.

Figure 38:
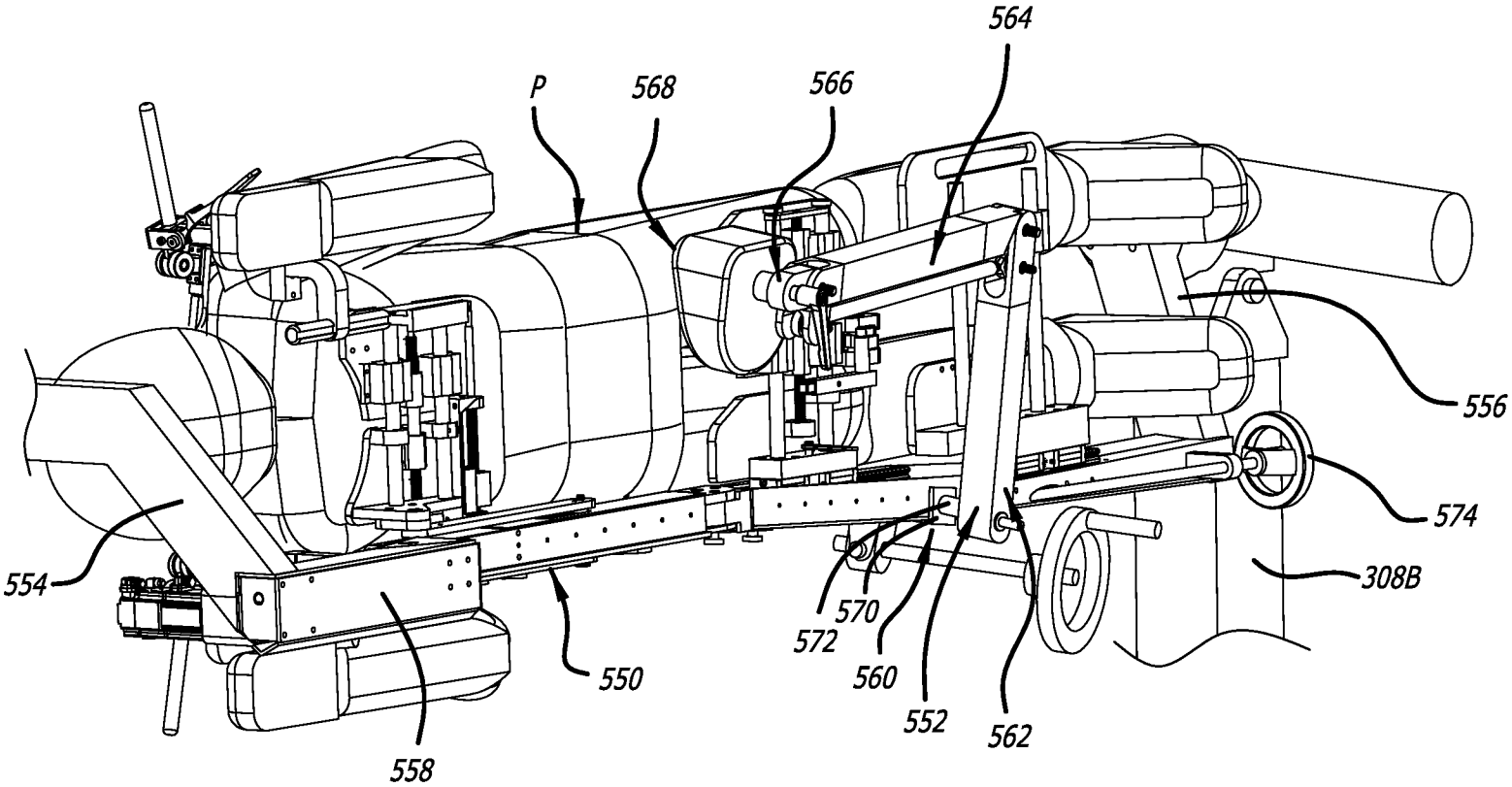
FIG. 38 is a partial, side, perspective view that illustrates a portion of a surgical frame with a patient positioned thereon in a lateral position incorporating a pelvic support of a second embodiment of the present disclosure with the pelvic support in a first position and tilted away from the patient.
Figure 39:
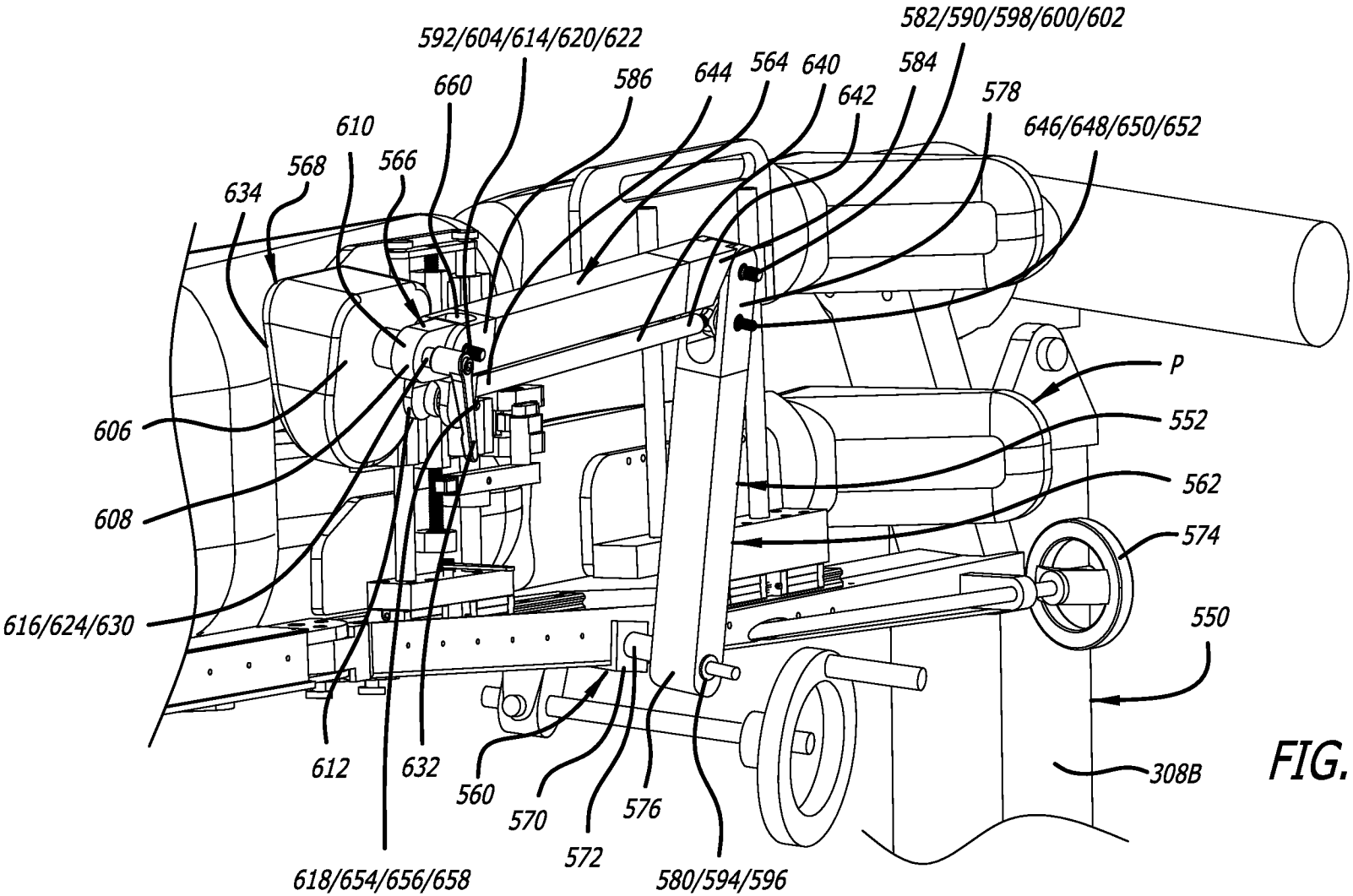
FIG. 39 is an enlarged view of the pelvic support of FIG. 38.

The pelvic support 552, as depicted in FIGS. 38-40, can include a tilt positioner 560, a first arm portion 562, a second arm portion 564, a head portion 566, and a pad portion 568. The pelvic support 552 is articulable in order to facilitate contact of the pad portion 568 with the patient P. Such contact allows the pelvic support 552 to support the pelvic area of the patient P before, during, and after surgery. For example, the pelvic support 552 can be used to support the pelvic area of the patient P during rotation of the main beam 410.

As depicted in FIGS. 38-40, portions of the tilt positioner 560 are attached to and/or incorporated into a portion of the third portion 558 of the main beam 410, and can be positioned in various locations along the main beam 410 to provide a point of attachment for other portions of the pelvic support 552. The tilt positioner 560 includes a base portion 570 and a post portion 572. The base portion 570 is attached to and/or incorporated into the main beam 410, and the post portion 572 extends outwardly from the base portion 570. The post portion 572 is used for pivotally attaching the first arm portion 562 thereto, and serves to support the first arm portion 562, the second arm portion 564, the head portion 566, and the pad portion 568. A portion of the base portion 570 (and the post portion 572 attached thereto) can also be tilted inwardly and outwardly relative to the patient P supported on the main beam 410. The tilt positioner 560, as depicted in FIGS. 38-40, can incorporate an actuator/wheel 574 and a transmission (not shown) to facilitate pivotal movement of the base portion 570 and/or the post portion 572. To illustrate, actuation of the actuator/wheel 574 and corresponding actuation of the transmission can serve to pivot the base portion 570 and/or the post portion 572 attached thereto. Such pivotal movement (e.g., FIGS. 38 and 40) can be used to tilt the pelvic support 552 toward and away from the patient P.

The first arm portion 562 includes a first end portion 576 and a second end portion 578 having a first aperture 580 and a second aperture 582, respectively, formed therethrough. Furthermore, the second arm portion 564 can include a first end portion 584 and a second end portion 586 having a first aperture 590 and a second aperture 592, respectively, formed therethrough.

To pivotally engage the first arm portion 562 to the tilt positioner 560, the post portion 572 can be inserted into the first aperture 580 of the first end portion 576 of the first arm portion 562, and a cap/nut 594 can be received on the post portion 572 to prevent the disengagement of the first arm portion 562 from the tilt positioner 560. A joint 596 formed by the interaction of the post portion 572 in the first aperture 580 facilitates pivotal movement of the first arm portion 562 relative to the main beam 410 that allows the first arm portion 562 to at least partially rotate with respect to the main beam 410. The joint 596 can be a friction joint that holds the position of the first arm portion 562, and requires a certain amount of force to move the first arm portion 562. Thus, absent any force applied to the first arm portion 562, the joint 596 maintains the position of the first arm portion 562 relative to the main beam 410. Given such pivotal movement, the first arm portion 562 (and the second arm portion 564, the head portion 566, and the pad portion 568 attached thereto) can be positioned and repositioned relative to the main beam 410. The first arm portion 562 is at least moveable between a first position and a second position, where when in the first position the first arm portion 562 is pivoted to a position away from the torso of patient P, and where when in the second position the first arm portion 562 is pivoted to a position toward the torso of the patient P.

Rather than using the tilt positioner 560, a post portion (not shown) can be incorporated in one of the third portion 558 and the first arm portion 562, and at least one aperture for receiving this post portion can be incorporated in the other of the third portion 558 and the first arm portion 562. As such, using this post portion and aperture, the first arm portion 562 would be capable of pivotable (but not tiltable) movement with respect to the main beam 410.

A joint 598 facilitating pivotal movement of the first arm portion 562 and the second arm portion 564 relative to one another can be provided that allows the second arm portion 564 to at least partially rotate with respect to the first arm portion 562. The joint 598 is formed by pivotally engaging the second arm portion 564 to the first arm portion 562, where one of the second end portion 578 of the first arm portion 562 and the first end portion 584 of the second arm portion 564 can be a clevis, and the other of the second end portion 578 and the first end portion 584 can be a tang. As depicted in FIG. 39, the second end portion 578 of the first arm portion 562 is a clevis, and the first end portion 584 of the second arm portion 564 is a tang. A bolt/pin 600 can be received in the apertures 582 and 590, and a cap/nut 602 can be received on the bolt/pin 600 to prevent disengagement of the first arm portion 562 and the second arm portion 564. Given such pivotal engagement, the second arm portion 564 (and the head portion 566 and the pad portion 568 attached thereto) can be positioned and repositioned with respect to the first arm portion 562. The second arm portion 564 is at least moveable between a first position and a second position, where when in the first position the second arm portion 564 is retracted to a position adjacent the first arm portion 562, and where when in the second position the second arm portion 564 is extended to a position away from the first arm portion 562. Furthermore, the joint 598 can be a friction joint that holds the position of the second arm portion 564 relative to the first arm portion 562, and requires a certain amount of force to articulate the second arm portion 564 relative to the first arm portion 562. Thus, absent any force applied to the first arm portion 562, the joint 598 maintains the position of the second arm portion 564 relative to the first arm portion 562.

A joint 604 facilitating pivotal movement of the head portion 566 relative to the second arm portion 564 can be provided that allows the head portion 566 to at least partially rotate with respect to the second arm portion 564. The joint 604 is formed by pivotally engaging a portion of the head portion 566 to the second arm portion 564, where one of the portion of the head portion 566 and the second end portion 586 of the second arm portion 564 can be a clevis, and the other of the portion of the head portion 566 and the second end portion 586 of the second arm portion 564 can be a tang. As depicted in FIG. 39, the second end portion 586 of the second arm portion 564 is a clevis, and a portion of the head portion 566 is a tang.

The head portion 566 can include a base portion 606 and a bracket portion 608 attached to one another. The base portion 606 supports the pad portion 568 thereon. Furthermore, the bracket portion 608 serves as the tang of the joint 604, and hence, the bracket portion 608 is the portion of the head portion 566 pivotally engaged to the second arm portion 564. The bracket portion 608 can be L-shaped with a first portion 610 and a second portion 612. A first aperture 614 and a second aperture 616 can be formed in the first portion 610, and third apertures 618 can be formed in the second portion 612. A bolt/pin 620 can be received in the apertures 592 and 614, and a cap/nut 622 can be received on the bolt/pin 620 to prevent disengagement of the second arm portion 564 and the bracket portion 608. Given such pivotable engagement, the bracket portion 608 of the head portion 566 can be positioned and repositioned with respect to the second arm portion 564. The joint 604 can be a friction joint that holds the position of the bracket portion 608 relative to the second arm portion 564, and requires a certain amount of force to articulate the bracket portion 608 relative to the second arm portion 564. Thus, absent any force applied to the bracket portion 608, the joint 604 maintains the position of the bracket portion 608 relative to the second arm portion 564.

Additionally, a joint 624 facilitating movement of the base portion 606 relative to the bracket portion 608 can be provided. The joint 624 is formed by pivotally engaging the base portion 606 to the bracket portion 608. The base portion 606 can include an upper surface and a lower surface, where the pad portion 568 can be attached to the upper surface, and a post portion (not shown) can be attached to the lower surface. To form the joint 624, the post portion can be received through the second aperture 616 of the bracket portion 608, and a cap/nut 630 can be received on the post portion to prevent disengagement of the base portion 606 from the bracket portion 608. Given such pivotal engagement, the base portion 606 of the head portion 566 can be repositioned and repositioned with respect to the bracket portion 608. The joint 624 can be a friction joint that holds the position of the base portion 606 relative to the bracket portion 608, and requires a certain amount of force to articulate the base portion 606 relative to the bracket portion 608. Thus, absent any force applied to the base portion 606, the joint 624 maintains the position of the base portion 606 relative to the bracket portion 608. A handle portion 632 can be attached to the post portion and/or the cap/nut 630 to facilitate pivotal adjustment of the base portion 606 relative to the bracket portion 608.

The pad portion 568 can include a contact surface 634 with various contours for engaging the torso of the patient P. The pad portion 568, via pivotal movement of the bracket portion 608 relative to the second arm portion 564, is moveable between a first position and a second position relative to the second arm portion 564; and the pad portion 568, via pivotal movement of the base portion 606 relative to the bracket portion 608, is moveable between a first position and a second position relative to the bracket portion 608. Such pivotal movement affords positioning the contact surface 634.

A connecting linkage 640 can be used to control/constrain movement of the first arm portion 562 and the second arm portion 564 relative to one another. The connecting linkage 640 can be an actuator (such as, for example, servomotor and/or a piston actuator) used to hold and/or move the second arm portion 564 relative to the first arm portion 562. As discussed below, interaction of the bracket portion 608 with the second end portion 586 of the second arm portion 564 due to the connecting linkage 640 serves to control/constrain the degree of movement of the first arm portion 562 and the second arm portion 564 relative to one another.

As depicted in FIG. 39, the connecting linkage 640 includes a first end portion 642 and a second end portion 644. The first end portion 642 is pivotally attached to the first arm portion 562, and the second end portion 644 is pivotally attached to the bracket portion 608 of the head portion 566. To illustrate, the second end portion 578 of the first arm portion 562 can include apertures 646, the first end portion 642 of the connecting linkage 640 can include an aperture 648, the first end portion 642 can be received in the clevis formed by the second end portion 578 of the first arm portion 562, a bolt/pin 650 can be received through the apertures 646 and 648, and a cap/nut 652 can be received on the bolt/pin 650 to prevent disengagement of the first arm portion 562 and the connecting linkage 640. Furthermore, the second portion 612 of the bracket portion 608 includes the third apertures 618, the second end portion 644 of the connecting linkage 640 can include an aperture 654, the second end portion 644 can be received in a clevis formed by the second portion 612 of the bracket portion 608, a bolt/pin 656 can be received through the apertures 618 and 654, and a cap/nut 658 can be received on the bolt/pin 656 to prevent disengagement of the bracket portion 608 and the connecting linkage 640.

Because the bracket portion 608 is pivotally attached to the second arm portion 564, and the connecting linkage 640 is pivotally attached to the first arm portion 562 and the bracket portion 608 of the head portion 566, the bracket portion 608 pivots as the first arm portion 562 and the second arm portion 564 are moved relative to one another. Ultimately, such pivoting of the bracket portion 608 (as the first arm portion 562 and the second arm portion 564 are moved apart from one another) causes at least a portion of the second portion 612 of the bracket portion 608 to contact the second end portion 586 of the second arm portion 564. In doing so, at least one surface of the second portion 612 of the bracket portion 608 is ultimately contacted to at least one surface of the second end portion 586 of the second arm portion 564 to prevent further movement of the first arm portion 562 and the second arm portion 564 apart from one another. As depicted in FIG. 39, the at least one surface (not shown) is formed on the bracket portion 608 adjacent the connection of the connecting linkage 640 to the bracket portion 608, and at least one surface 660 is formed between portions of the clevis formed by the second end portion 586 of the second arm portion 564. As such, use of the connecting linkage 640 serves in constraining movement of the first arm portion 562 and the second arm portion 564 relative to one another by limiting movement of the first arm portion 562 and the second arm portion 564 apart from one another.

The articulation of the various components of the pelvic support 552 affords placement of the contact surface 634 of the pad portion 568 relative to the patient P. As discussed above, the first arm portion 562 can pivot toward/away from and pivotally rotate with respect to the main beam 410; the second arm portion 564 can pivotally rotate with respect to the first arm portion 562; bracket portion 608 of the head portion 566 can pivotally rotate with respect to the second arm portion 564; and the base portion 606 of the head portion 566 can pivotally rotate with respect to the bracket portion 608. As such, using the articulation of the componentry of the pelvic support 552, the contact surface 634 of the pad portion 568 can be positioned into contact with the pelvic area of the patient P, and such contact allows the pelvic support 552 to support the patient P before, during, and after surgery. The tilt positioner 560 and the actuator/wheel 574, and the componentry surrounding each of the joints 596, 598, 604, and 624 (such as, for example, the connecting linkage 640) can be automated using servomotors, pneumatics, and/or hydraulics. As such, the articulation of the pelvic support 552 can be done via manual adjustment or via controlled automation of the componentry thereof.

As discussed below, a surgical frame 700 includes a third embodiment of an adjustable pelvic support generally indicated by the numeral 702 in FIGS. 41-46. The pelvic support 702 can be positioned and repositioned before, during, and after surgery between at least a retracted first position where the pelvic support 702 is withdrawn from the pelvic area (e.g., FIG. 41), and an extended second position where the pelvic area of the patient P is supported thereby (e.g., FIG. 45). Like the surgical frames 10, 300, 400, and 550, the surgical frame 700 can serve as an exoskeleton to support the body of the patient P as the patient's body is manipulated thereby. In doing so, the surgical frame 700 serves to support the patient P such that the patient's spine does not experience unnecessary stress/torsion. But for the configuration of the pelvic support 702 (instead of pelvic supports 402 and 552) and componentry thereof, the surgical frame 700 is substantially identical to the surgical frames 400 and 550, and the corresponding description of the surgical frames 400 and 550 are applicable to the surgical frame 700.

The pelvic support 702, for example, can be attached relative to various portions of the main beam 410. As discussed above and depicted in FIGS. 41 and 43-45, the main beam 410 includes at least the first portion 554, the second portion 556, and the third portion 558 that is elongated and extends between the first portion 554 and the second portion 556. As depicted in FIGS. 41-46, portions of the pelvic support 702 are attached to and/or relative to the third portion 558 of the main beam 410. As such, given that the first portion 554 is moveably attached relative to the first vertical support 308A and the second portion 556 is moveably attached relative to the second vertical support 308B, the pelvic support 702 is moveable with the main beam 410 relative to the first vertical support portion 308A and the second vertical support post 308B. The pelvic support 702 can be used to support the patient P during rotation of the main beam 410 and articulation of the other componentry of the surgical frame 700.

The pelvic support 702, as depicted in FIGS. 41-46, can include a tilt positioner 710, a first arm portion 712, a second arm portion 714, a head portion 716, a pad portion 718, and a stop mechanism 720. The pelvic support 702 is articulable in order to facilitate contact of the pad portion 718 with the patient P. Such contact allows the pelvic support 702 to support the pelvic area of the patient P before, during, and after surgery. For example, the pelvic support 702 can be used to support the pelvic area of the patient P during rotation of the main beam 410.

As depicted in FIGS. 41-46, portions of the tilt positioner 710 are attached to and/or incorporated into a portion of the third portion 558 of the main beam 410, and can be positioned in various locations along the main beam 410 to provide a point of attachment for other portions of the pelvic support 702. The tilt positioner 710 includes a base plate portion 722 and a post portion 724. The base plate portion 722 is hingedly attached to and/or incorporated into the main beam 410, and the post portion 724 extends outwardly from the base plate portion 722. The post portion 724 is used for pivotally attaching the first arm portion 712 thereto, and serves to support the first arm portion 712, the second arm portion 714, the head portion 716, and the pad portion 718.

Figure 42:
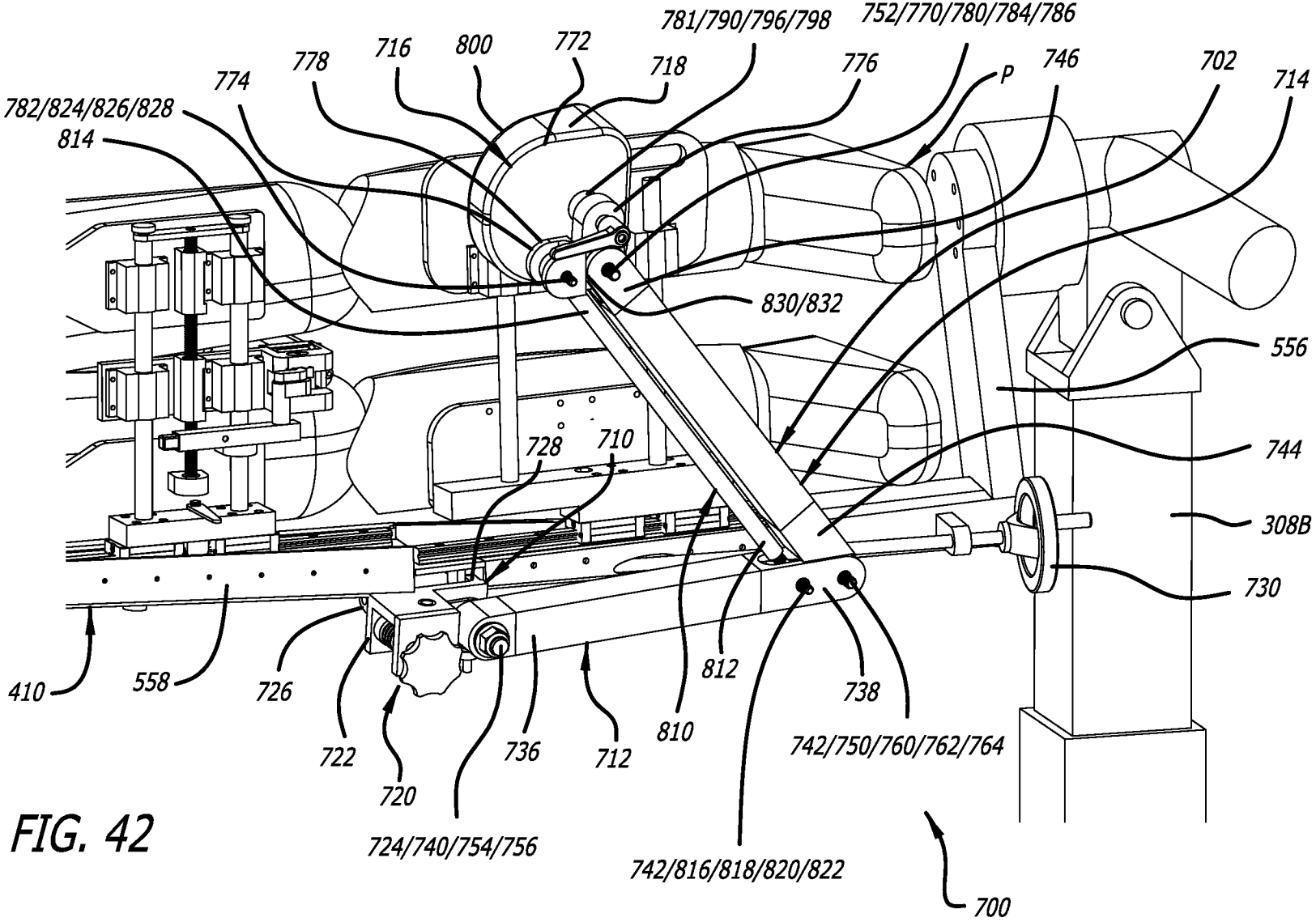
FIG. 42 is an enlarged view of the pelvic support of FIG. 41.
Figure 43:
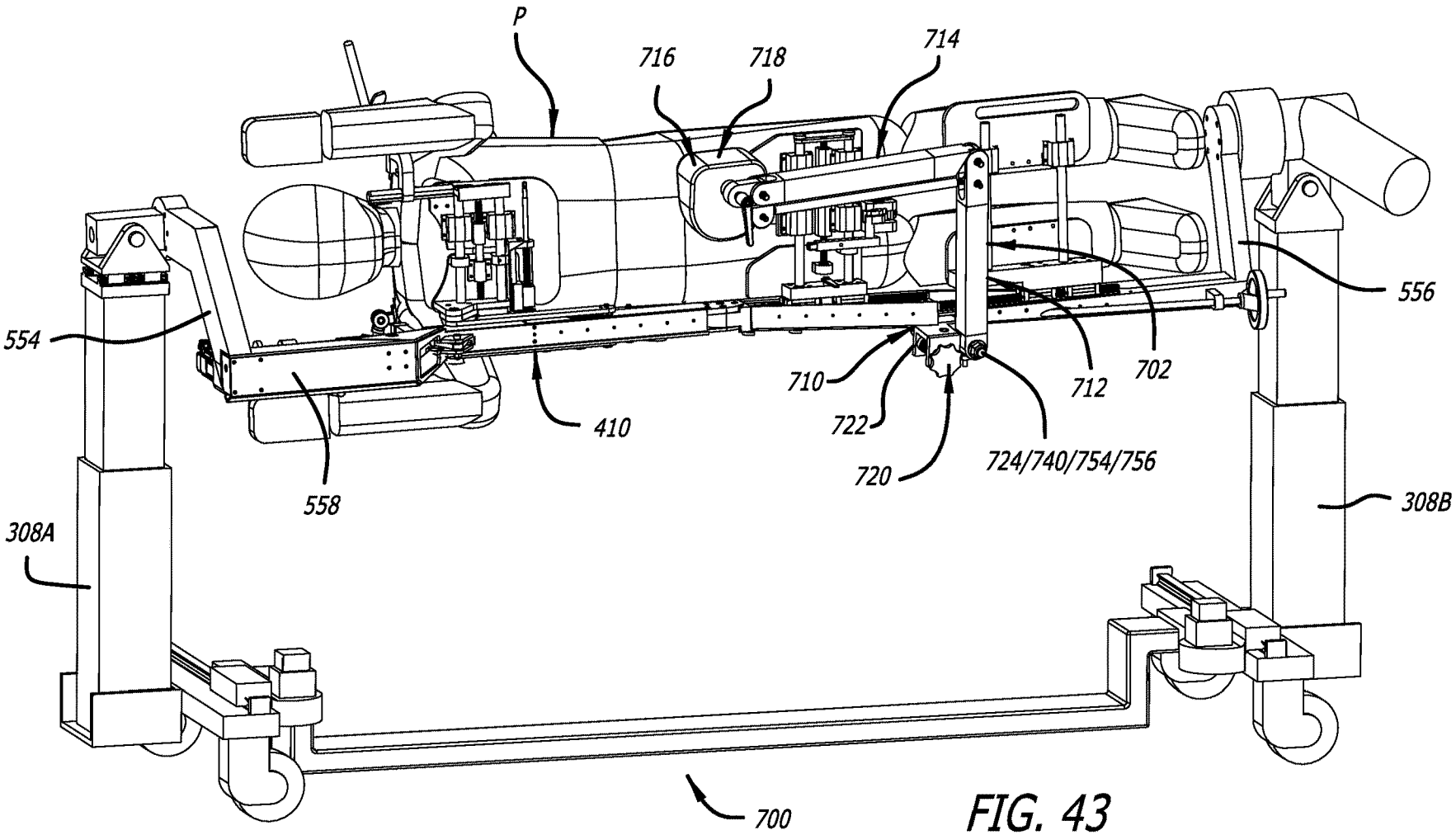
FIG. 43 is a side, perspective view that illustrates the surgical frame of FIG. 41 with the patient in the lateral position, and the pelvic support in a second position and tilted away from the patient.
Figure 44:
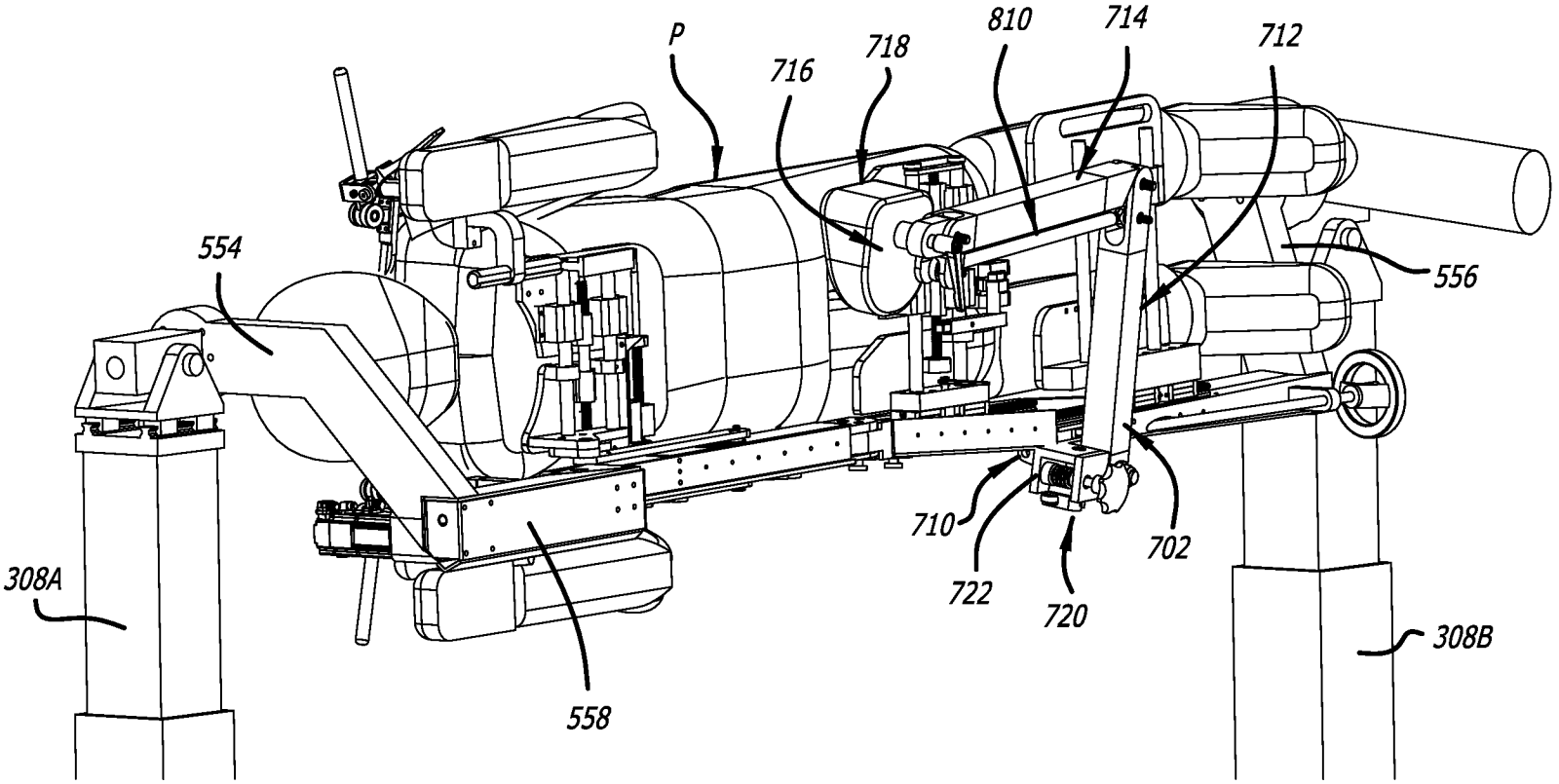
FIG. 44 is a partial, side, perspective view that illustrates the surgical frame of FIG. 41 with the patient in the lateral position, and the pelvic support in the second position and tilted away from the patient.
Figure 45:
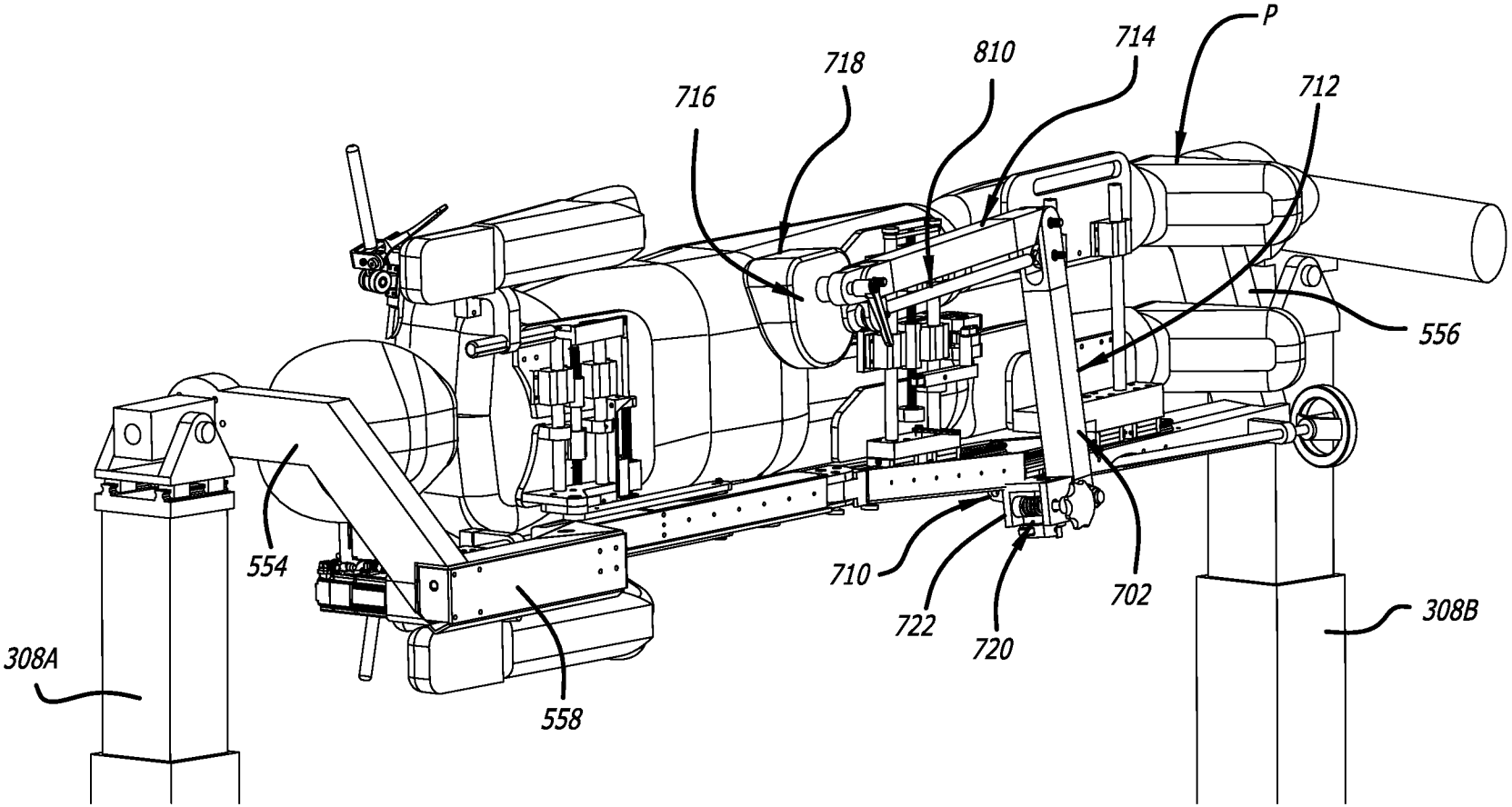
FIG. 45 is a partial, side, perspective view that illustrates the surgical frame of FIG. 41 with the patient in the lateral position, and the pelvic support in the second position and tilted toward the patient.
Figure 46:
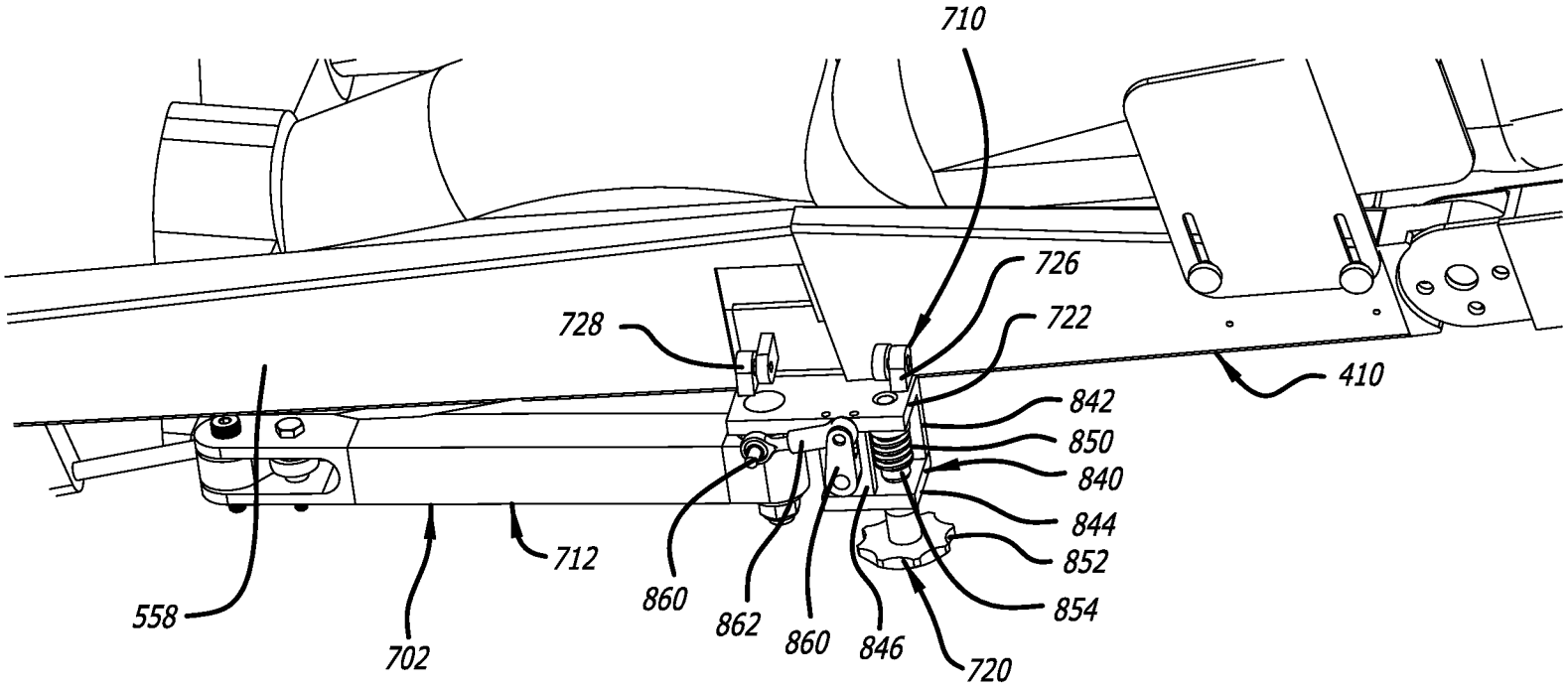
FIG. 46 is a top, side, perspective view that illustrates an adjustable stop and a portion of a tilt positioner of the pelvic support of FIG. 41.

As depicted in FIGS. 42 and 46, the base plate portion 722 is hingedly attached to the main beam 410 using a first hinge portion 726 and a second hinge portion 728, and the base plate portion 722 (and the post portion 724 attached thereto) can be tilted inwardly and outwardly relative to the patient P (e.g. FIGS. 44 and 45) supported on the main beam 410. The tilt positioner 710 can incorporate an actuator/wheel 730 and a transmission (not shown) to facilitate pivotal movement of the base plate portion 722 and the post portion 724. To illustrate, actuation of the actuator/wheel 730 and corresponding actuation of the transmission can serve to pivot the base portion 722 and the post portion 724 attached thereto on the first hinge portion 726 and the second hinge portion 728. Such pivotal movement can be used to tilt the pelvic support 702 toward and away from the patient P.

The first arm portion 712 includes a first end portion 736 and a second end portion 738 having a first aperture 740 and a second aperture 742, respectively, formed therethrough. Furthermore, the second arm portion 714 can include a first end portion 744 and a second end portion 746 having a first aperture 750 and a second aperture 752, respectively, formed therethrough.

To pivotally engage the first arm portion 712 to the tilt positioner 710, the post portion 724 can be inserted into the first aperture 740 of the first end portion 736 of the first arm portion 712, and a cap/nut 754 can be received on the post portion 724 to prevent the disengagement of the first arm portion 712 from the tilt positioner 710. A joint 756 formed by the interaction of the post portion 724 in the first aperture 740 facilitates pivotal movement of the first arm portion 712 relative to the main beam 410 that allows the first arm portion 712 to at least partially rotate with respect to the main beam 410. The joint 756 can be a friction joint that holds the position of the first arm portion 712, and requires a certain amount of force to move the first arm portion 712. Thus, absent any force applied to the first arm portion 712, the joint 756 maintains the position of the first arm portion 712 relative to the main beam 410. Given such pivotal movement, the first arm portion 712 (and the second arm portion 714, the head portion 716, and the pad portion 718 attached thereto) can be positioned and repositioned. The first arm portion 712 is at least moveable between a first position and a second position, where when in the first position the first arm portion 712 is pivoted to a position away from the torso of patient P, and where when in the second position the first arm portion 712 is pivoted to a position toward the torso of the patient P.

Rather than using the tilt positioner 710, a post portion (not shown) can be incorporated in one of the third portion 558 and the first arm portion 712, and at least one aperture for receiving this post portion can be incorporated in the other of the third portion 558 and the first arm portion 712. As such, using this post portion and aperture, the first arm portion 712 would be capable of pivotable (but not tiltable) movement with respect to the main beam 410.

A joint 760 facilitating pivotal movement of the first arm portion 712 and the second arm portion 714 relative to one another can be provided that allows the second arm portion 714 to at least partially rotate with respect to the first arm portion 712. The joint 760 is formed by pivotally engaging the second arm portion 714 to the first arm portion 712, where one of the second end portion 738 of the first arm portion 712 and the first end portion 744 of the second arm portion 714 can be a clevis, and the other of the second end portion 738 and the first end portion 744 can be a tang. As depicted in FIG. 42, the second end portion 738 of the first arm portion 712 is a clevis, and the first end portion 744 of the second arm portion 714 is a tang. A bolt/pin 762 can be received in the apertures 742 and 750, and a cap/nut 764 can be received on the bolt/pin 762 to prevent disengagement of the first arm portion 712 and the second arm portion 714. Given such pivotal engagement, the second arm portion 714 (and the head portion 716 and the pad portion 718 attached thereto) can be positioned and repositioned with respect to the first arm portion 712. The second arm portion 714 is at least moveable between a first position and a second position, where when in the first position the second arm portion 714 is retracted to a position adjacent the first arm portion 712, and where when in the second position the second arm portion 714 is extended to a position away from the first arm portion 712. Furthermore, the joint 760 can be a friction joint that holds the position of the second arm portion 714 relative to the first arm portion 712, and requires a certain amount of force to articulate the second arm portion 714 relative to the first arm portion 712. Thus, absent any force applied to the first arm portion 712, the joint 760 maintains the position of the second arm portion 714 relative to the first arm portion 712.

A joint 770 facilitating pivotal movement of the head portion 716 relative to the second arm portion 714 can be provided that allows the head portion 716 to at least partially rotate with respect to the second arm portion 714. The joint 770 is formed by pivotally engaging a portion of the head portion 716 to the second arm portion 714, where one of the portion of the head portion 716 and the second end portion 746 of the second arm portion 714 can be a clevis, and the other of the portion of the head portion 716 and the second end portion 746 of the second arm portion 714 can be a tang. As depicted in FIG. 42, the second end portion 746 of the second arm portion 714 is a clevis, and a portion of the head portion 716 is a tang.

The head portion 716 can include a base portion 772 and a bracket portion 774 attached to one another. The base portion 772 supports the pad portion 718 thereon. Furthermore, the bracket portion 774 serves as the tang of the joint 770, and hence, the bracket portion 774 is the portion of the head portion 716 pivotally engaged to the second arm portion 714. The bracket portion 774 can be L-shaped with a first portion 776 and a second portion 778. A first aperture 780 and a second aperture 781 can be formed in the first portion 776, and third apertures 782 can be formed in the second portion 778. A bolt/pin 784 can be received in the apertures 752 and 780, and a cap/nut 786 can be received on the bolt/pin 784 to prevent disengagement of the second arm portion 714 and the bracket portion 774. Given such pivotable engagement, the bracket portion 774 of the head portion 716 can be positioned and repositioned with respect to the second arm portion 714. The joint 770 can be a friction joint that holds the position of the bracket portion 774 relative to the second arm portion 714, and requires a certain amount of force to articulate the bracket portion 774 relative to the second arm portion 714. Thus, absent any force applied to the bracket portion 774, the joint 770 maintains the position of the bracket portion 774 relative to the second arm portion 714.

Additionally, a joint 790 facilitating movement of the base portion 772 relative to the bracket portion 774 can be provided. The joint 790 is formed by pivotally engaging the base portion 772 to the bracket portion 774. The base portion 772 can include an upper surface and a lower surface, where the pad portion 718 can be attached to the upper surface, and a post portion (not shown) can be attached to the lower surface. To form the joint 790, the post portion can be received through the second aperture 781 of the bracket portion 774, and a cap/nut 796 can be received on the post portion to prevent disengagement of the base portion 772 from the bracket portion 774. Given such pivotal engagement, the base portion 772 of the head portion 716 can be repositioned and repositioned with respect to the bracket portion 774. The joint 790 can be a friction joint that holds the position of the base portion 772 relative to the bracket portion 774, and requires a certain amount of force to articulate the base portion 772 relative to the bracket portion 774. Thus, absent any force applied to the base portion 772, the joint 790 maintains the position of the base portion 772 relative to the bracket portion 774. A handle portion 798 can be attached to the post portion and/or the cap/nut 796 to facilitate pivotal adjustment of the base portion 772 relative to the bracket portion 774.

The pad portion 718 can include a contact surface 800 with various contours for engaging the torso of the patient P. The pad portion 718, via pivotal movement of the bracket portion 774 relative to the second arm portion 714, is moveable between a first position and a second position relative to the second arm portion 714; and the pad portion 718, via pivotal movement of the base portion 772 relative to the bracket portion 774, is moveable between a first position and a second position relative to the bracket portion 774. Such pivotal movement affords positioning the contact surface 800.

A connecting linkage 810 can be used to control/constrain movement of the first arm portion 712 and the second arm portion 714 relative to one another. The connecting linkage 810 can be an actuator (such as, for example, servomotor and/or a piston actuator) used to hold and/or move the second arm portion 714 relative to the first arm portion 712. As discussed below, interaction of the bracket portion 774 with the second end portion 746 of the second arm portion 714 due to the connecting linkage 810 serving to control/constrain the degree of movement of the first arm portion 712 and the second arm portion 714 relative to one another.

As depicted in FIG. 42, the connecting linkage 810 includes a first end portion 812 and a second end portion 814. The first end portion 812 is pivotally attached to the first arm portion 712, and the second end portion 814 is pivotally attached to the bracket portion 774 of the head portion 716. To illustrate, the second end portion 738 of the first arm portion 712 can include apertures 816, the first end portion 812 of the connecting linkage 810 can include an aperture 818, the first end portion 812 can be received in the clevis formed by the second end portion 738 of the first arm portion 712, a bolt/pin 820 can be received through the apertures 816 and 818, and a cap/nut 822 can be received on the bolt/pin 820 to prevent disengagement of the first arm portion 712 and the connecting linkage 810. Furthermore, the second portion 778 of the bracket portion 774 includes the third apertures 782, the second end portion 814 of the connecting linkage 810 can include an aperture 824, the second end portion 814 can be received in a clevis formed by the second portion 778 of the bracket portion 774, a bolt/pin 826 can be received through the apertures 782 and 824, and a cap/nut 828 can be received on the bolt/pin 826 to prevent disengagement of the bracket portion 774 and the connecting linkage 810.

Because the bracket portion 774 is pivotally attached to the second arm portion 714, and the connecting linkage 810 is pivotally attached to the first arm portion 712 and the bracket portion 774 of the head portion 716, the bracket portion 774 pivots as the first arm portion 712 and the second arm portion 714 are moved relative to one another. Ultimately, such pivoting of the bracket portion 774 (as the first arm portion 712 and the second arm portion 714 are moved apart from one another) causes at least a portion of the second portion 778 of the bracket portion 774 to contact the second end portion 746 of the second arm portion 714. In doing so, at least one surface 830 of the second portion 778 of the bracket portion 774 is ultimately contacted to at least one surface 832 of the second end portion 746 of the second arm portion 714 to prevent further movement of the first arm portion 712 and the second arm portion 714 apart from one another. As depicted in FIG. 42, the at least one surface 830 is formed adjacent the connection of the connecting linkage 810 to the bracket portion 774, and the at least one surface 832 is formed between portions of the clevis formed by the second end portion 746 of the second arm portion 714. As such, use of the connecting linkage 810 serves in constraining movement of the first arm portion 712 and the second arm portion 714 relative to one another by limiting movement of the first arm portion 712 and the second arm portion 714 apart from one another.

Additionally, the stop mechanism 720 can be fixed or adjustable, and can be used to constrain movement of the first arm portion 712 relative to tilt positioner 710 (and the main beam 410). The stop mechanism 720, as depicted in FIG. 46, is adjustable, and includes a bracket portion 840 attached to the base plate portion 722 of the tilt positioner 710. As depicted in FIG. 46, the bracket portion 840 can include a first plate portion 842, a second plate portion 844, and a third plate portion 846. The first plate portion 842 is attached between the base plate portion 722 and the second plate portion 844, the second plate portion 844 is attached between the first plate portion 842 and the third plate portion 846, and the third plate portion 846 is attached between the second plate portion 844 and the base plate portion 722.

The stop mechanism 720 includes a worm gear 850 positioned between the base plate portion 722 and the second plate portion 844. The worm gear 850 is interconnected with a handle portion 852 via a shaft portion 854 that extends through the second plate portion 844. Actuation of the handle portion 852 serves to rotate the worm gear 850. The stop mechanism 720 further includes a spur gear (not shown) rotatably positioned between the first plate portion 842 and the third plate portion 846 that is driven by the worm gear 850. As such, rotation of the worm gear 850 serves to rotate the spur gear.

As depicted in FIG. 46, the stop mechanism 720 includes a first linkage portion 860 and a second linkage portion 862 pivotally attached to one another. The spur gear is interconnected with the first linkage portion 860 via a shaft portion (not shown), and rotation of the spur gear serves to pivot the first linkage portion 860 and the second linkage portion 862 between a first position and a second position. The stop mechanism 720 further includes a collar portion 864, and the collar portion 864 is rotatable about the post portion 724. The collar portion 864 is interconnected with the second linkage portion 862, and the collar portion 864 is moveable via movement of the first linkage portion 860 and the second linkage portion 862 between a first position (corresponding to the first position of the first linkage portion 860 and the second linkage portion 862) and a second position (corresponding to the second position of the first linkage portion 860 and the second linkage position 862). The collar portion 864 includes a detent 866 formed thereon for contacting a corresponding detent (not shown) formed on the first arm portion 712 to control/constrain pivotal movement of the first arm portion 712 about the post portion 724, and the detent 866 can be positioned and repositioned via movement of the collar portion 864. Using the stop mechanism 720, the detent 866 can be positioned and repositioned via actuation of the handle portion 852, corresponding rotation of the worm gear 850, corresponding rotation of the spur gear, corresponding pivotal movement first linkage portion 860 and the second linkage portion 862, and corresponding movement of the collar portion 864.

The articulation of the various components of the pelvic support 702 affords placement of the contact surface 800 of the pad portion 718 relative to the patient P. As discussed above, the first arm portion 712 can pivot toward/away from and pivotally rotate with respect to the main beam 410; the second arm portion 714 can pivotally rotate with respect to the first arm portion 712; bracket portion 774 of the head portion 716 can pivotally rotate with respect to the second arm portion 714; and the base portion 772 of the head portion 716 can pivotally rotate with respect to the bracket portion 774. As such, using the articulation of the componentry of the pelvic support 702, the contact surface 800 of the pad portion 718 can be positioned into contact with the pelvic area of the patient P, and such contact allows the pelvic support 702 to support the patient P before, during, and after surgery. The tilt positioner 710 actuator/wheel 730 thereof, the handle portion 852, and the componentry surrounding each of the joints 756, 760, 770, and 790 (such as, for example, the connecting linkage 810) can be automated using servomotors, pneumatics, and/or hydraulics. As such, the articulation of the pelvic support 702 can be done via manual adjustment or via controlled automation of the componentry thereof.

As discussed below, a portion of a surgical frame 900 includes a fourth embodiment of an adjustable pelvic support generally indicated by the numeral 902 in FIGS. 47-52. Aside from the main beam 410 and componentry attached thereto, the remainder of the surgical frame 900 is not depicted in FIGS. 47-52. Nevertheless, but for the configuration of the pelvic support 902 (instead of pelvic supports 402, 552, and 702) and the componentry thereof, the surgical frame 900 can be substantially identical to the surgical frames 400, 550, and 700. To illustrate, the surgical frame 900 can include the first vertical support 308A and the second vertical support 308B.

Figure 50:
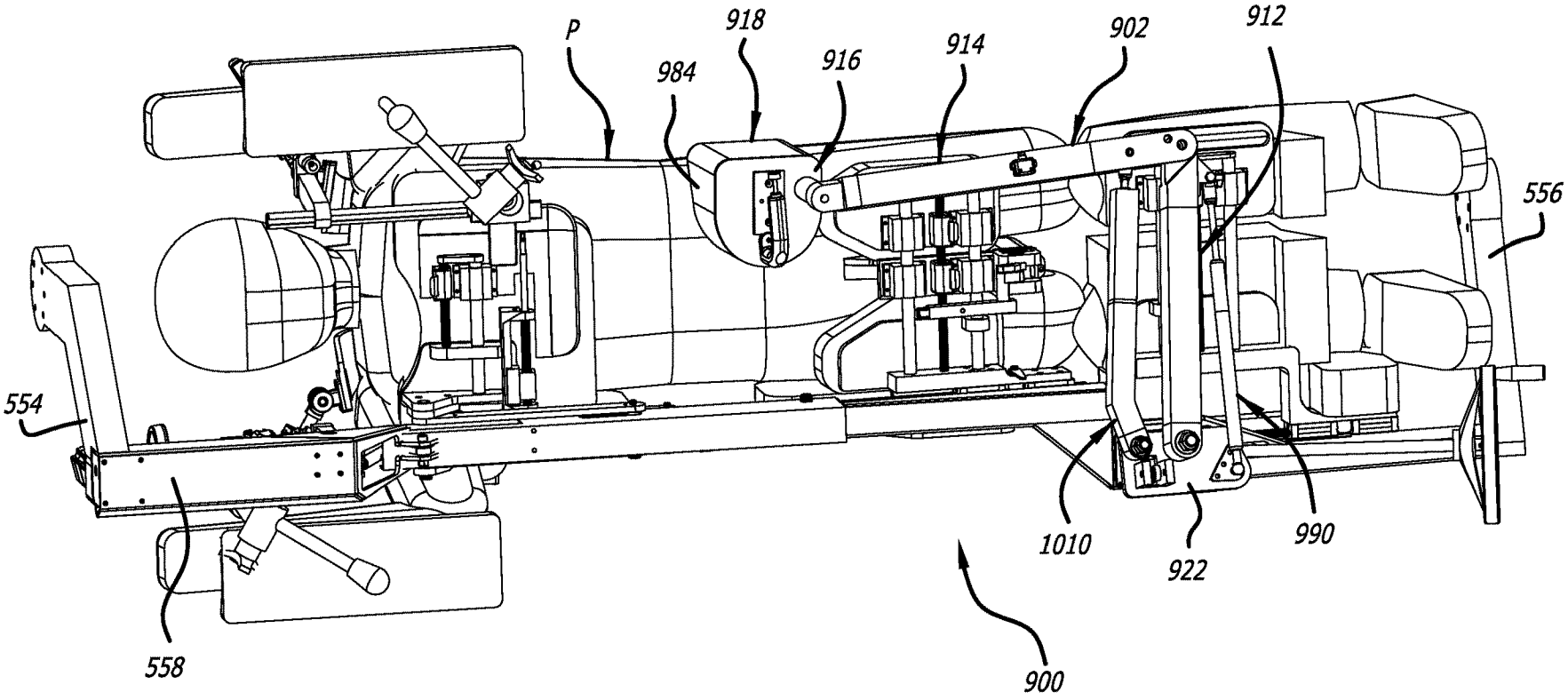
FIG. 50 is a partial, side, perspective view that illustrates the surgical frame of FIG. 47 with the patient in the lateral position, and the pelvic support in the second position and tilted toward the patient.
Figure 51:
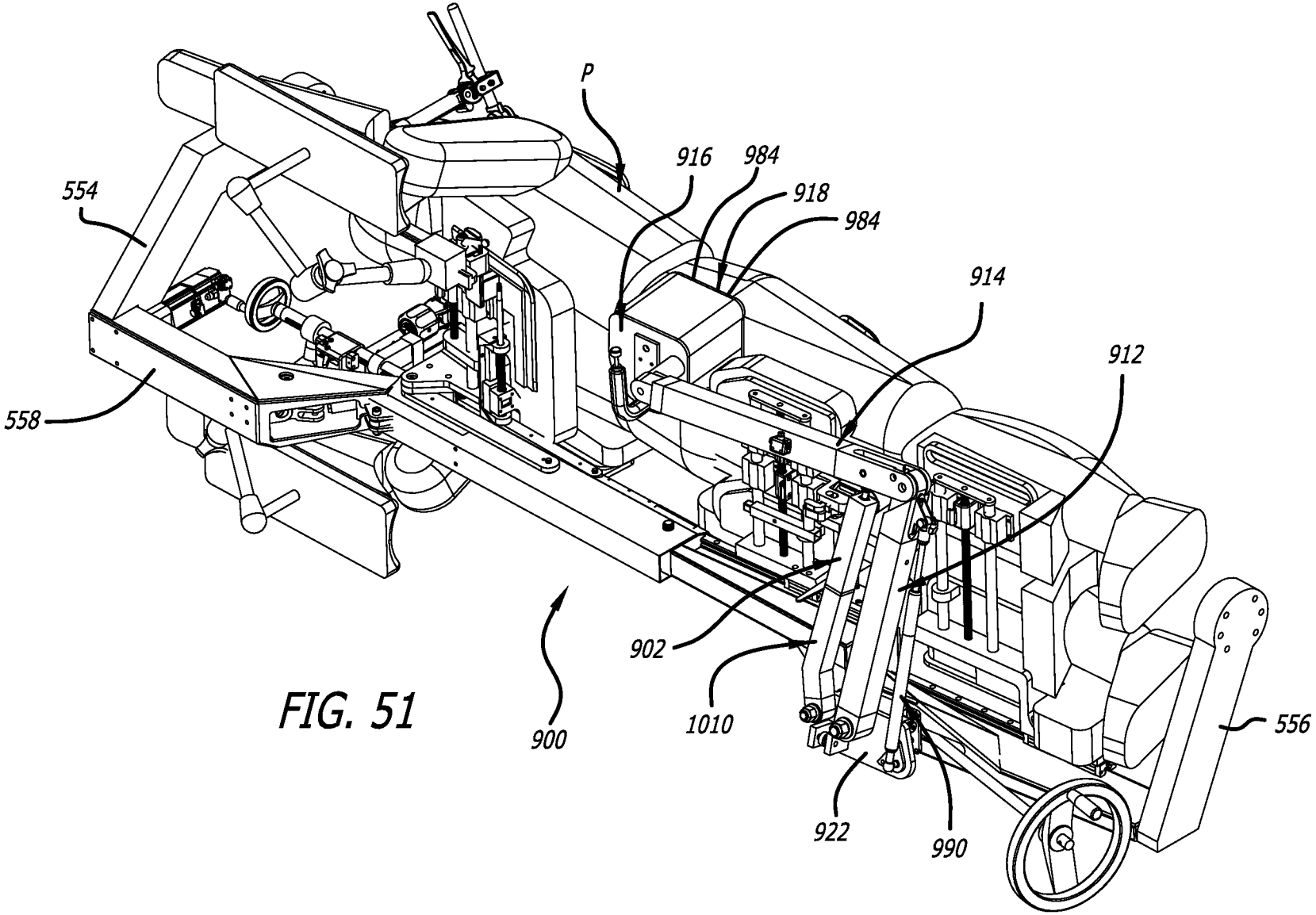
FIG. 51 is another partial, top, side perspective view that illustrates the surgical frame of FIG. 47 with the patient in the lateral position, and the pelvic support in the second position and tilted toward the patient.
Figure 52:
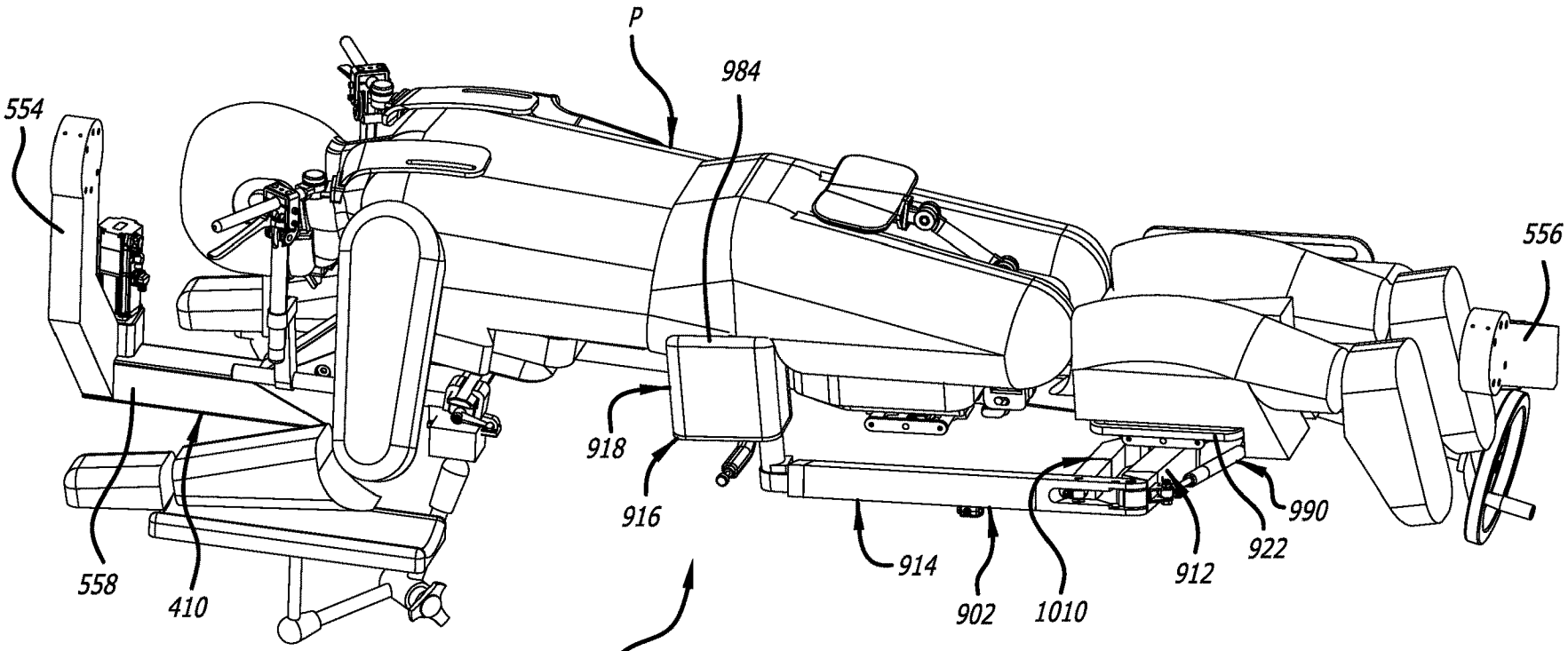
FIG. 52 is a partial, top, side perspective view that illustrates the surgical frame of FIG. 47 with the patient in the supine position, and the pelvic support in the second position and tilted toward the patient.

The pelvic support 902 can be positioned and repositioned before, during, and after surgery between at least a retracted first position where the pelvic support 902 is withdrawn from the pelvic area (e.g., FIG. 47), and an extended second position where the pelvic area is supported thereby (e.g., FIG. 50). Like the surgical frames 10, 300, 400, 550, and 700 the surgical frame 900 can serve as an exoskeleton to support the body of the patient P as the patient's body is manipulated thereby. In doing so, the surgical frame 900 serves to support the patient P such that the patient's spine does not experience unnecessary stress/torsion. But for the pelvic support 702 (instead of pelvic supports 402 and 552), the surgical frame 700 can include componentry identical to the surgical frames 400 and 550, and the corresponding description of the surgical frames 400 and 550 are applicable to the surgical frame 700.

The pelvic support 902, for example, can be attached relative to various portions of the main beam 410. As discussed above and depicted in FIGS. 47 and 49-52, the main beam 410 includes at least the first portion 554, the second portion 556, and the third portion 558 that is elongated and extends between the first portion 554 and the second portion 556. As depicted in FIGS. 47-52, portions of the pelvic support 902 are attached to and/or relative to the third portion 558 of the main beam 410. As such, given that the first portion 554 can be moveably attached relative to the first vertical support 308A and the second portion 556 can be moveably attached relative to the second vertical support 308B, the pelvic support 902 can be moveable with the main beam 410 relative to the first vertical support portion 308A and the second vertical support post 308B. The pelvic support 902 can be used to support the patient P during rotation of the main beam 410 and articulation of the other componentry of the surgical frame 900.

Figure 47:
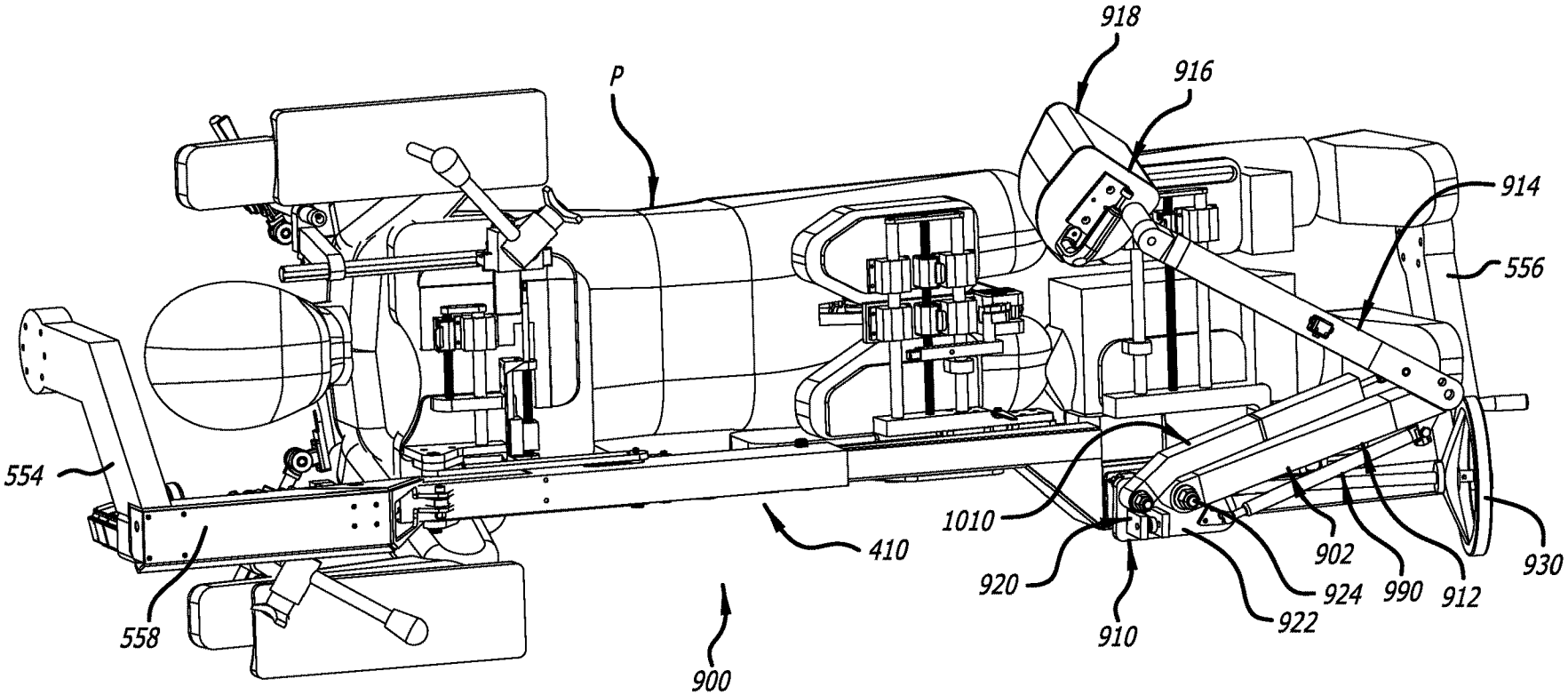
FIG. 47 is a partial, side, perspective view that illustrates a portion of a surgical frame with a patient positioned thereon in a lateral position incorporating a pelvic support of a fourth embodiment of the present disclosure with the pelvic support in a first position and tilted away from the patient.
Figure 48:
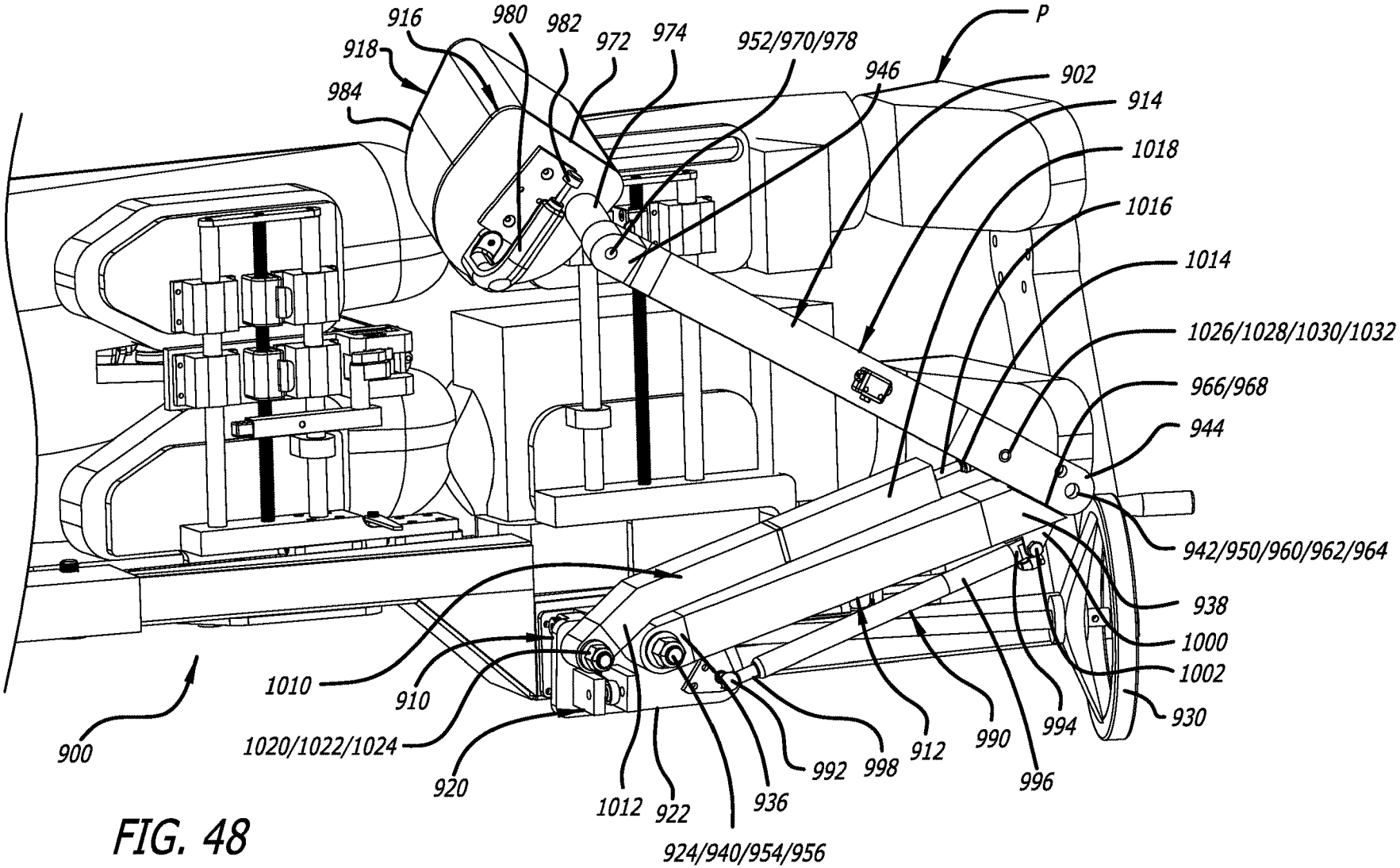
FIG. 48 is an enlarged view of the pelvic support of FIG. 47.
Figure 49:
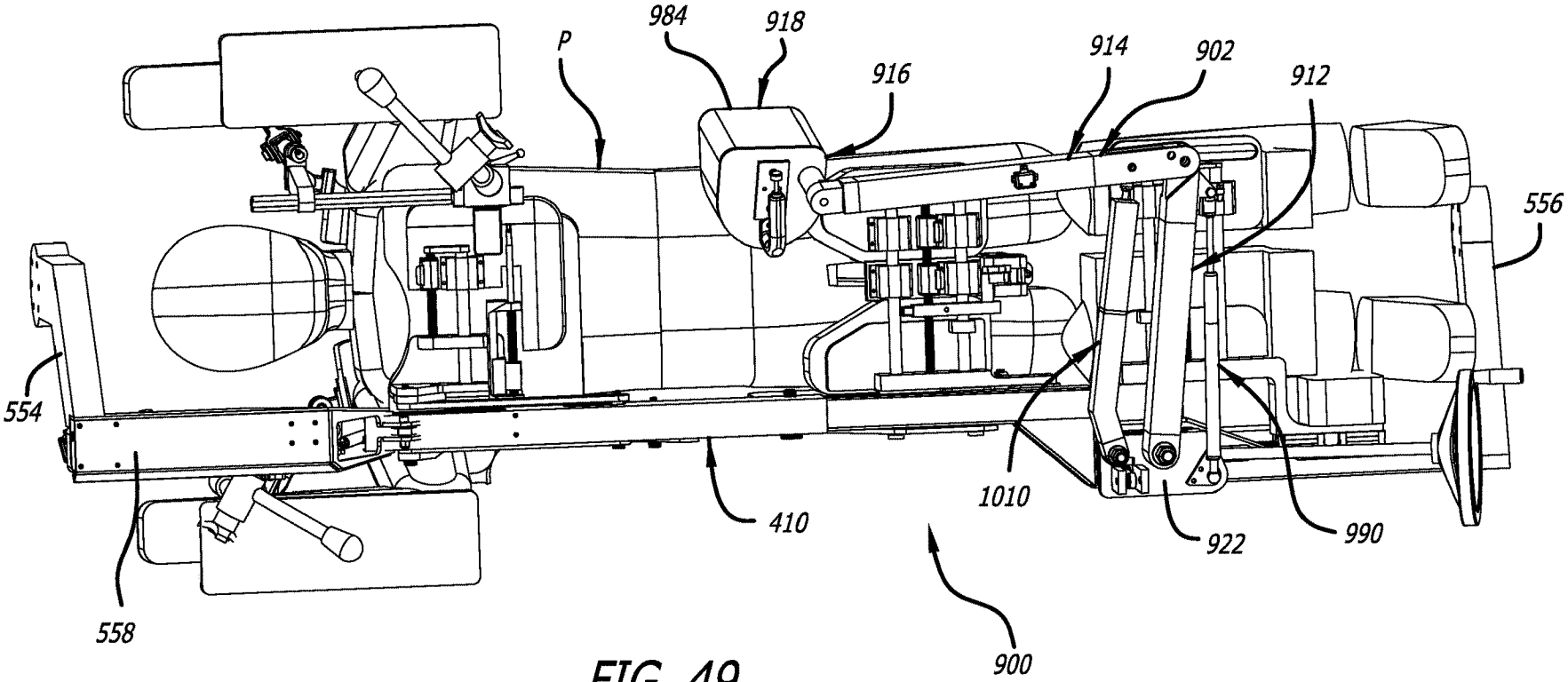
FIG. 49 is a partial, side, perspective view that illustrates the surgical frame of FIG. 47 with the patient in the lateral position, and the pelvic support in a second position and tilted away from the patient.

The pelvic support 902, as depicted in FIGS. 47 and 48, can include a tilt positioner 910, a first arm portion 912, a second arm portion 914, a head portion 916, and a pad portion 918. The pelvic support 902 is articulable in order to facilitate contact of the pad portion 918 with the patient P. Such contact allows the pelvic support 902 to support the pelvic area of the patient P before, during, and after surgery. For example, the pelvic support 902 can be used to support the pelvic area of the patient P during rotation of the main beam 410.

As depicted in FIGS. 47 and 48, portions of the tilt positioner 910 are attached to and/or incorporated into a portion of the third portion 558 of the main beam 410, and can be positioned in various locations along the main beam 410 to provide a point of attachment for other portions of the pelvic support 702. As discussed below, the tilt positioner 910 includes a base plate portion 922 and a post portion 924. The base plate portion 922, as discussed below, is moveably attached to and/or incorporated into the main beam 410, and the post portion 924 extends outwardly from the base plate portion 922. The post portion 924 is used for pivotally attaching the first arm portion 912 thereto, and serves to support the first arm portion 912, the second arm portion 914, the head portion 916, and the pad portion 918.

The moveable attachment of the base plate portion 922 can be accomplished by use of a positioner (not shown) interposed between the base plate portion 922 and the main beam 410 and/or incorporated into the main beam. The positioner can be incorporated with the tilt positioner 910, and the positioner can be used to tilt the base plate portion 922 (and the post portion 924 attached thereto) inwardly and outwardly relative to the patient P (e.g., FIGS. 49 and 50) supported on the main beam 410. The tilt positioner 910 can also incorporate an actuator/wheel 930 and a transmission (not shown) to drive the positioner to provide pivotal movement of the base plate portion 922 and the post portion 924. To illustrate, actuation of the actuator/wheel 930 and corresponding actuation of the transmission and/or the positioner can serve to pivot the base portion 922 and the post portion 924 attached thereto tilt the pelvic support 702 toward and away from the patient P.

The first arm portion 912 includes a first end portion 936 and a second end portion 938 having a first aperture 940 and a second aperture 942, respectively, formed therethrough. Furthermore, the second arm portion 914 can include a first end portion 944 and a second end portion 946 having a first aperture 950 and a second aperture 952, respectively, formed therethrough. The second end portion 946, as depicted in FIG. 48, can be rotationally attached to the remainder of the second arm portion 914.

To pivotally engage the first arm portion 912 to the tilt positioner 910, the post portion 924 can be inserted into the first aperture 940 of the first end portion 936 of the first arm portion 912, and a cap/nut 954 can be received on the post portion 924 to prevent the disengagement of the first arm portion 912 from the tilt positioner 910. A joint 956 formed by the interaction of the post portion 924 in the first aperture 940 facilitates pivotal movement of the first arm portion 912 relative to the main beam 410 that allows the first arm portion 912 to at least partially rotate with respect to the main beam 410. The joint 956 can be a friction joint that holds the position of the first arm portion 912, and requires a certain amount of force to move the first arm portion 912. Thus, absent any force applied to the first arm portion 912, the joint 956 maintains the position of the first arm portion 912 relative to the main beam 410. Given such pivotal movement, the first arm portion 912 (and the second arm portion 914, the head portion 916, and the pad portion 918 attached thereto) can be positioned and repositioned. The first arm portion 912 is at least moveable between a first position and a second position, where when in the first position the first arm portion 912 is pivoted to a position away from the torso of patient P, and where when in the second position the first arm portion 912 is pivoted to a position toward the torso of the patient P.

Rather than using the tilt positioner 910, a post portion (not shown) can be incorporated in one of the third portion 558 and the first arm portion 912, and at least one aperture for receiving this post portion can be incorporated in the other of the third portion 558 and the first arm portion 912. As such, using this post portion and aperture, the first arm portion 912 would be capable of pivotable (but not tiltable) movement with respect to the main beam 410.

A joint 960 facilitating pivotal movement of the first arm portion 912 and the second arm portion 914 relative to one another can be provided that allows the second arm portion 914 to at least partially rotate with respect to the first arm portion 912. The joint 960 is formed by pivotally engaging the second arm portion 914 to the first arm portion 912, where one of the second end portion 938 of the first arm portion 912 and the first end portion 944 of the second arm portion 914 can be a clevis, and the other of the second end portion 938 and the first end portion 944 can be a tang. As depicted in FIG. 48, the second end portion 938 of the first arm portion 912 is a tang, and the first end portion 944 of the second arm portion 914 is a clevis. A bolt/pin 962 can be received in the apertures 942 and 950, and a cap/nut 964 can be received on the bolt/pin 962 to prevent disengagement of the first arm portion 912 and the second arm portion 914. Given such pivotal engagement, the second arm portion 914 (and the head portion 916 and the pad portion 918 attached thereto) can be positioned and repositioned with respect to the first arm portion 912. The second arm portion 914 is at least moveable between a first position and a second position, where when in the first position the second arm portion 914 is retracted to a position adjacent the first arm portion 912, and where when in the second position the second arm portion 914 is extended to a position away from the first arm portion 912. A stop can be formed by a first stop surface 966 and a second stop surface 968 constrain movement of the joint 960 by limiting movement of the second arm portion 914 relative to the first arm portion 912 at the first position with respect to one another. Furthermore, the joint 960 can be a friction joint that holds the position of the second arm portion 914 relative to the first arm portion 912, and requires a certain amount of force to articulate the second arm portion 914 relative to the first arm portion 912. Thus, absent any force applied to the first arm portion 912, the joint 960 maintains the position of the second arm portion 914 relative to the first arm portion 912.

A joint 970 facilitating pivotal movement of the head portion 916 relative to the second arm portion 914 can be provided that allows the head portion 916 to at least partially rotate with respect to the second arm portion 914. The joint 970 is formed by pivotally engaging a portion of the head portion 916 to the second arm portion 914, where one of the portion of the head portion 916 and the second end portion 946 of the second arm portion 914 can be a post, and the other of the portion of the head portion 916 and the second end portion 946 of the second arm portion 914 can be a carrier for pivotally attaching the post thereto.

As depicted in FIG. 48, a base portion 972 of the head portion 916 includes a post portion 974, and the second end portion 946 of the second arm portion 914 serves as a carrier facilitating pivotal attachment of the post portion 974 thereto. The second end portion 946, as depicted in FIG. 48, includes the aperture 952 for receiving a pin 978. The pin 978 can be inserted through the aperture 952 and into the post portion 974 to form the joint 970, and pivotally attach the post portion 974 (and the remainder of the head portion 916) to the second arm portion 914. The joint 970 can facilitate complete rotation or limited rotation of the head portion 916 relative to the second arm portion 914. Furthermore, the joint 970 can be a friction joint that holds the position of the head portion 916 relative to the second arm portion 914, and requires a certain amount of force to articulate the head portion 916 relative to the second arm portion 914. Thus, absent any force applied to the head portion 916, the joint 970 maintains the position of the head portion 916 relative to the second arm portion 914.

The base portion 972 supports the pad portion 918 thereon. And, in addition to the base portion 972 and the post portion 974, the head portion 916 can also include a handle portion 980 and a button actuator 982. The pad portion 918 can include a contact surface 984 with various contours for engaging the torso of the patient P. The handle portion 980 affords manipulation of the pelvic support 902 by affording adjustment of the joints 956, 960, and 970 to afford positioning and repositioning of the contact surface 984 of the pad portion 918 relative to the patient P. Furthermore, the button actuator 982 can be used to facilitate engagement and disengagement of below-discussed connecting linkages used in holding the positions of the first arm portion 912 relative to the main beam 410, and of the second arm portion 914 relative to the first arm portion 912. For example, with the button actuator 982 engaged, the connecting linkages can be disengaged to permit movement of the first arm portion 912 and the second arm portion 914, and with the button actuator 982 disengaged, the connecting linkages can be engaged to prevent movement of the first arm portion 912 and the second arm portion 914.

A first connecting linkage 990 can be used to directly control/constrain movement of the first arm portion 912 relative to the base plate portion 922 (and the main beam 410). The first connecting linkage 990 includes a first end 992 and a second end 994, and is formed as a telescoping structure with a body portion 996 and an extendable portion 998 moveable inwardly and outwardly relative to the body portion 996. The first end 992 of the first connecting linkage 990 can be pivotally attached to the plate portion 922, and the second end 994 of the first connecting linkage 990 can be pivotally attached to the first arm portion 912. For example, one of the plate portion 922 and the first end 992 of the first connecting linkage 990 can include a ball, and the other of the plate portion 922 and the first end 922 of the first connecting linkage 990 can include a socket to pivotally attach the first connecting linkage 990 and the plate portion 922 to one another. As depicted in FIG. 48, the plate portion 922 includes the ball, and the first end 992 of the first connecting linkage 990 includes a socket. Furthermore, the second end 994 of the first connecting linkage 990 is pivotally attached to an attachment portion 1000 extending outwardly from the first arm portion 912. A fastener or fasteners 1002 can be used to facilitate such pivotal attachment of the second end 994 of the first connecting linkage 990 to the attachment portion 1000. The first connecting linkage 990 can be an actuator (such as, for example, servomotor and/or a piston actuator) used to hold and/or move the first arm portion 912 in and into position relative to the plate portion 922 (and the main beam 410).

A second connecting linkage 1010 can be used to control/constrain movement of the first arm portion 912 and the second arm portion 914 relative to one another. The second connecting linkage 1010 includes a first end 1012 and a second end 1014, and is formed as a telescoping structure with an extendable portion 1016 and a body portion 1018 moveable inwardly and outwardly relative to the body portion 1018. The first end 1012 of the second connecting linkage 1010 can be pivotally attached to the plate portion 922, and the second end 1014 of the second connecting linkage 1010 can be pivotally attached to the second arm portion 914. For example, one of the plate portion 922 and the first end 1012 of the second connecting linkage 1010 can include a post, and the other of the plate portion 922 and the first end 1012 of the second connecting linkage 1010 can include an aperture for receiving the post. As depicted in FIG. 48, the plate portion 922 includes a post portion 1020 and first end 1012 of the second connecting linkage 1010 includes an aperture 1022 for receiving the post portion 1020, and a cap/nut 1024 can be received on the post portion 1020 to facilitate pivotal attachment of the first end 1012 to the plate portion 922. Furthermore, the second end 1014 of the second connecting linkage 1010 is pivotally attached to the second arm portion 914. To illustrate, the second arm portion 1014 can include apertures 1026, the second end 1014 can include an aperture 1028, a bolt/pin 1030 can be received through the apertures 1026 and 1028, and a cap/nut 1032 can be received on the bolt/pin 1030 to prevent disengagement of the second connecting linkage 1010 from the second arm portion 914. The second connecting linkage 1010 can be an actuator (such as, for example, servomotor and/or a piston actuator) used to hold and/or move the second arm portion 914 relative to the first arm portion 912.

The articulation of the various components of the pelvic support 902 affords placement of the contact surface 984 of the pad portion 918 relative to the patient P. As discussed above, the first arm portion 912 can pivot toward/away from and pivotally rotate with respect to the main beam 410; the second arm portion 914 can pivotally rotate with respect to the first arm portion 912; and the base portion 972 of the head portion 916 can pivotally rotate with respect to the second arm portion 914. As such, using the articulation of the componentry of the pelvic support 902, the contact surface 984 of the pad portion 918 can be positioned into contact with the pelvic area of the patient P, and such contact allows the pelvic support 902 to support the patient P before, during, and after surgery. The tilt positioner 910 and the actuator/wheel 930 thereof and the componentry surrounding each of the joints 956, 960, and 970 (such as, for example, the first connecting linkage 990 and the second connecting linkage 1010) can be automated using servomotors, pneumatics, and/or hydraulics. As such, the articulation of the pelvic support 902 can be done via manual adjustment or via controlled automation of the componentry thereof.

The pelvic supports 402, 552, 702, and 902 are reconfigurable and articulable before, during, and after surgery to facilitate positioning of the respective pad portions 456, 568, 718, and 918 to support the pelvic area of a patient P at least during rotation of the patient on a rotatable main beam. The pelvic supports 402, 552, 702, and 902 are articulable between at least a retracted first position where the pelvic supports 402, 552, 702, and 902 are withdrawn from the pelvic area of the patient P, and an extended second position where the pelvic area is supported thereby.

It should be understood that various aspects disclosed herein may be combined in different combinations than the combinations specifically presented in the description and the accompanying drawings. It should also be understood that, depending on the example, certain acts or events of any of the processes of methods described herein may be performed in a different sequence, may be added, merged, or left out altogether (e.g., all described acts or events may not be necessary to carry out the techniques). In addition, while certain aspect of this disclosure are described as being performed by a single module or unit for purposes of clarity, it should be understood that the techniques of this disclosure may be performed by a combination of units or modules associated with, for example, a medical device.

We claim:

1. A positioning frame for supporting a patient during surgery including an adjustable pelvic support, the positioning frame comprising:

a first vertical support portion and a second vertical support portion;

a main beam having a first end, a second end, and a length extending between the first and second end, the main beam defining an axis of rotation relative to the first vertical support portion and the second vertical support portion, the main beam being rotatable about the axis of rotation between at least a first rotational position and a second rotational position, the axis of rotation substantially corresponding to a cranial-caudal axis of the patient when the patient is supported on the positioning frame, the main beam including a first portion at the first end rotatably interconnected relative to the first vertical support portion, a second portion at the second end rotatably interconnected relative the second vertical support portion, and an elongated portion extending between the first portion and the second portion of the main beam, a chest support portion and a leg support portion attached to the elongated portion of the main beam; and an adjustable pelvic support including a tilt positioner, a first arm portion, a second arm portion, a head portion, and a connecting linkage, the first arm portion including a first end portion and a second end portion, the second arm portion including a first end portion and a second end portion, the head portion including a pad portion for contacting a portion of the pelvic area of the patient, the first end portion of the first arm portion being pivotally attached relative to the elongated portion of the main beam, the first end portion of the second arm portion being pivotally attached relative to the second end portion of the first arm portion, the head portion comprising a bracket portion being pivotally attached relative to the second end portion of the second arm portion, the connecting linkage attached between the first arm portion and the bracket portion of the head portion, a first end of the connecting linkage being pivotally attached to the second end portion of the first arm portion, and a second end of the connecting linkage being pivotally attached to the bracket portion of the head portion, the first arm portion being moveable between a first rotational position and a second rotational position relative to the elongated portion of the main beam, and the second arm portion being moveable between a first rotational position and a second rotational position relative to the first arm portion to facilitate positioning and repositioning of the pad portion of head portion to contact the portion of the pelvic area of the patient during rotation of the main beam between the first rotational position and the second rotational position, the tilt positioner connecting the main beam to the first arm portion, the tilt positioner being attached to the elongated portion of the main beam, the first arm portion being pivotally attached to the tilt positioner to facilitate movement between the first rotational positron end the second rotational position thereof, the tilt positioner being configured to tilt the first arm portion between a first tilt position and a second tilt position relative to the main beam, wherein movement of the first arm portion and the second arm portion relative to one another causes pivotal movement of the bracket portion relative to the second arm portion via the interaction of the connecting linkage between the first arm portion and the bracket portion.

2. The positioning frame of claim 1, wherein the head portion of the adjustable pelvic support includes a plate portion supporting the pad portion, and the plate portion pivotally attached relative to the second end portion of the second arm portion.

3. The positioning frame of claim 1, wherein, when in the first tilt position, the pad portion of the head portion is positioned away from the patient, and, when in the second tilt position, the pad portion of the head portion is positioned toward the patient.

4. The positioning frame of claim 3, wherein one of the tilt positioner and the first end portion of the first arm portion includes a post portion, and the other of the tilt positioner and the first end portion of the first arm portion includes an aperture for receiving the post portion, a connection between the tilt positioner and the first end portion of the first arm portion afforded by receipt of the post portion in the aperture.

5. The positioning frame of claim 1, wherein one of the second end portion of the first arm portion and the first end portion and the second arm portion forms a clevis and the other of the second end portion of the first arm portion and the first arm portion of the second arm portion is a tang, the clevis and the tang forming the attachment between the first arm portion and the second arm portion.

6. The positioning frame of claim 5, wherein one of the bracket portion and the second end portion of the second arm portion forms a clevis and the other of the bracket portion and the second arm portion forms a tang, the clevis and the tang forming the attachment between the head portion and the second arm portion.

7. The positioning frame of claim 1, wherein the second end portion of the second arm portion includes a first contact surface, and the bracket portion includes a second contact surface, and wherein the pivotal movement of the bracket portion via the interaction of the connecting linkage between the first arm portion and the bracket portion caused by the pivotal movement of the first arm portion and the second arm portion contacts the first contact surface and the second contact surface together, and contact between the first contact surface and the second contact surface prevents further pivotal movement of the first arm portion and the second arm portion relative to one another.

8. The positioning frame of claim 1, further comprising a stop mechanism attached relative to the elongated portion of the main beam, the stop mechanism being configured to limit movement of the first arm portion relative to the elongated portion of the main beam.

9. A positioning frame for supporting a patient during surgery including an adjustable pelvic support, the positioning frame comprising:

a first vertical support portion and a second vertical support portion;

a main beam having a first end, a second end, and a length extending between the first and second end, the main beam defining an axis of rotation relative to the first vertical support portion and the second vertical support portion, the main beam being rotatable about the axis of rotation between at least a first rotational position and a second rotational position, the axis of rotation substantially corresponding to a cranial-caudal axis of the patient when the patient is supported on the positioning frame, the main beam including a first portion at the first end rotatably interconnected relative to the first vertical support portion, a second portion at the second end rotatably interconnected relative the second vertical support portion, and an elongated portion extending between the first portion and the second portion of the main beam, a chest support portion and a leg support portion attached to the elongated portion of the main beam; and an adjustable pelvic support including a tilt positioner, a first arm portion, a second arm portion, a head portion, a first connecting linkage, and a second connecting linkage, the tilt positioner being attached to the main beam, the first arm portion including a first end portion and a second end portion, the second arm portion including a first end portion and a second end portion, the head portion including a pad portion for contacting a portion of the pelvic area of the patient, the first end portion of the first arm portion being pivotally attached to the tilt positioner, the first end portion of the second arm portion being pivotally attached to the second end portion of the first arm portion, the head portion being attached relative to the second end portion of the second arm portion, the first connecting linkage extending between a first portion of the tilt positioner and the second end portion of the first arm portion, the first connecting linkage being hingedly attached to the first portion of the tilt positioner and the second end portion of the first end portion, the second connecting linkage extending between a second portion of the tilt positioner and the first end portion of the second arm portion, the second connecting linkage being hingedly attached to the second portion of the tilt positioner and the first end portion of the second end portion, the tilt positioner being configured to tilt the first arm portion between a first tilt position away from the patient and a second tilt position toward the patient, and the first arm portion being moveable between a first rotational position and a second rotational position relative to the elongated portion of the main beam, and the second arm portion being moveable between a first rotational position and a second rotational position relative to the first arm portion to facilitate positioning and repositioning of the pad portion of head portion to contact the portion of the pelvic area of the patient during rotation of the main beam between the first rotational position and the second rotational position.

10. The positioning frame of claim 9, wherein the first connecting linkage is configured to limit movement of the first arm portion relative to the elongated portion of the main beam between the first rotational position and the second rotational position thereof, and the second connecting linkage is configured to limit movement of the second arm portion relative to the first arm portion between the first rotational position and the second rotational position thereof.

11. The positioning frame of claim 10, wherein the first connecting linkage comprises an actuator configured to hold the first arm portion in a position between the first rotational position and the second rotational position thereof, and the second connecting linkage comprises an actuator configured to hold the second arm portion in a position thereof between the first rotational position and the second rotational position thereof.

12. The positioning frame of claim 11, wherein one of the tilt positioner and the first end portion of the first arm portion includes a post portion, and the other of the tilt positioner and the first end portion of the first arm portion includes an aperture for receiving the post portion, a connection between the tilt positioner and the first end portion of the first arm portion afforded by receipt of the post portion in the aperture.

13. The positioning frame of claim 9, wherein one of the second end portion of the first arm portion and the first end portion and the second arm portion forms a clevis and the other of the second end portion of the first arm portion and the first arm portion of the second arm portion is a tang, the clevis and the tang forming the attachment between the first arm portion and the second arm portion.

14. A positioning frame for supporting a patient during surgery including an adjustable pelvic support, the positioning frame comprising:

a first vertical support portion and a second vertical support portion;

a main beam having a first end, a second end, and a length extending between the first and second end, the main beam defining an axis of rotation relative to the first vertical support portion and the second vertical support portion, the main beam being rotatable about the axis of rotation between at least a first rotational position and a second rotational position, the axis of rotation substantially corresponding to a cranial-caudal axis of the patient when the patient is supported on the positioning frame, the main beam including a first portion at the first end rotatably interconnected relative to the first vertical support portion, a second portion at the second end rotatably interconnected relative the second vertical support portion, and an elongated portion extending between the first portion and the second portion of the main beam, a chest support portion and a leg support portion attached to the elongated portion of the main beam, the chest support being configured for support of at least a portion of a chest of the patient and the leg support being configured for support of a portion of at least one leg of the patient; and an adjustable pelvic support including a first arm portion, a second arm portion, a head portion, a first connecting linkage, and a second connecting linkage, the first arm portion including a first end portion and a second end portion, the second arm portion including a first end portion and a second end portion, the head portion including a pad portion for contacting a portion of the pelvic area of the patient, the first end portion of the first arm portion being pivotally attached relative to the elongated portion of the main beam, the first end portion of the second arm portion being pivotally attached relative to the second end portion of the first arm portion, the head portion being attached relative to the second end portion of the second arm portion, the first connecting linkage being connected relative to the main beam and the second end of the first arm portion, the second connecting linkage being connected relative to the main beam and the first end portion of the second arm portion, the first arm portion being moveable between a first rotational position and a second rotational position relative to the elongated portion of the main beam, and the second arm portion being moveable between a first rotational position and a second rotational position relative to the first arm portion to facilitate positioning and repositioning of the pad portion of head portion to contact the portion of the pelvic area of the patient during rotation of the main beam between the first rotational position and the second rotational, the first connecting linkage being configured to stop movement of the first arm portion in various positions between the first rotational position and the second rotational position thereof, and the second connecting linkage between configured to stop movement of the second arm portion in various positions between the first rotational position and the second rotational position thereof.

15. The positioning frame of claim 14, wherein the first connecting linkage comprises an actuator configured to hold the first arm portion in one of the various positions between the first rotational position and the second rotational position thereof, and the second connecting linkage comprises an actuator configured to hold the second arm portion in one of the various positions thereof between the first rotational position and the second rotational position thereof.

16. The positioning frame of claim 15, further comprising a tilt positioner connecting the main beam to the first arm portion, the first connecting linkage, and the second connecting linkage, the tilt positioner being attached to the elongated portion of the main beam, the first arm portion, the first connecting linkage, and the second connecting linkage being pivotally attached to the tilt positioner, the tilt positioner being configured to tilt the first arm portion, the first connecting linkage, and the second connecting linkage between a first tilt position away from the patient and a second tilt position toward the patient.

17. The positioning frame of claim 14, wherein one of the second end portion of the first arm portion and the first end portion and the second arm portion forms a clevis and the other of the second end portion of the first arm portion and the first arm portion of the second arm portion is a tang, the clevis and the tang forming the attachment between the first arm portion and the second arm portion.

18. The positioning frame of claim 14, wherein the first connecting linkage is configured to limit movement of the first arm portion relative to the elongated portion of the main beam between the first rotational position and the second rotational position thereof, and the second connecting linkage is configured to limit movement of the second arm portion relative to the first arm portion between the first rotational position and the second rotational position thereof.

19. The positioning frame of claim 14, wherein one of the tilt positioner and the first end portion of the first arm portion includes a post portion, and the other of the tilt positioner and the first end portion of the first arm portion includes an aperture for receiving the post portion, a connection between the tilt positioner and the first end portion of the first arm portion afforded by receipt of the post portion in the aperture.

* * * * *